US007123864B2

(12) United States Patent
Miyaguchi et al.

(10) Patent No.: US 7,123,864 B2
(45) Date of Patent: Oct. 17, 2006

(54) DEVELOPING DEVICE USING ELECTROSTATIC TRANSPORT MEMBER

(75) Inventors: Yohichiro Miyaguchi, Kanagawa (JP); Masanori Horike, Kanagawa (JP); Nobuaki Kondoh, Kanagawa (JP); Katsuo Sakai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 47 days.

(21) Appl. No.: 10/805,362

(22) Filed: Mar. 22, 2004

(65) Prior Publication Data

US 2004/0240907 A1 Dec. 2, 2004

(30) Foreign Application Priority Data

Mar. 20, 2003 (JP) ..... 2003-079139
May 20, 2003 (JP) ..... 2003-141228

(51) Int. Cl.
*G03G 15/08* (2006.01)

(52) U.S. Cl. ..... 399/254; 399/258

(58) Field of Classification Search ..... 399/252, 399/253, 254, 255, 256, 258, 260
See application file for complete search history.

(56) References Cited

U.S. PATENT DOCUMENTS 2,550,738 A * 5/1951 Walkup ..... 399/252
3,532,071 A * 10/1970 McCarroll ..... 399/254
3,599,604 A * 8/1971 Chawda et al. ..... 399/252
3,865,081 A * 2/1975 Charland et al. ..... 399/254
3,934,256 A * 1/1976 Isonaka et al. ..... 399/381
4,607,938 A * 8/1986 Hosoi et al. ..... 399/259
4,847,631 A 7/1989 Naruse et al.
5,182,601 A * 1/1993 Hodoshima et al. ..... 399/258
5,317,438 A 5/1994 Suzuki et al.
5,412,413 A 5/1995 Sekiya et al.
5,600,356 A 2/1997 Sekiya et al.
5,682,579 A * 10/1997 Nomura et al. ..... 399/113
5,708,939 A * 1/1998 Oikawa et al. ..... 399/252
5,710,960 A * 1/1998 Hart et al. ..... 399/253
5,722,018 A * 2/1998 Hart et al. ..... 399/258
6,108,511 A * 8/2000 Kutsuwada et al. ..... 399/359
6,367,914 B1 4/2002 Ohtaka et al.
6,597,884 B1 7/2003 Miyaguchi et al.
6,631,250 B1 * 10/2003 Playfair et al. ..... 399/253
6,708,014 B1 3/2004 Miyaguchi et al.

OTHER PUBLICATIONS

U.S. Appl. No. 11/370,057, filed Mar. 8, 2006, Yamada et al.
U.S. Appl. No. 11/370,823, filed Mar. 9, 2006, Nakagawa et al.
U.S. Appl. No. 11/376,434, filed Mar. 16, 2006, Takahashi et al.

* cited by examiner

*Primary Examiner*—Diego Gutierrez
*Assistant Examiner*—Travis Reis
(74) *Attorney, Agent, or Firm*—Oblon, Spivak, McClelland, Maier & Neustadt, P.C.

(57) ABSTRACT

A toner supply device for preventing adverse influence caused by a charging failure of toner without scattering toner and generating ozone due to corona discharge and realizing low potential development according to an ETH phenomenon. The toner supply device is provided with the specific electrostatic toner transport substrate on which a plurality electrodes are disposed.

27 Claims, 84 Drawing Sheets

FIG. 53

| DIVISION | RANGE | AVERAGE GAP | BIAS VOLTAGE | AVERAGE ELECTRIC FIELD (V/um) | |
|---|---|---|---|---|---|
| | mm | mm | Volts | IMAGE PORTION | NON-IMAGE PORTION |
| 1 | 0.0~1.0 | 0.202 | 50.8 | 0.416 | 1.243 |
| 2 | ~2.0 | 0.211 | 54.6 | 0.417 | 1.208 |
| 3 | ~3.0 | 0.228 | 61.7 | 0.417 | 1.149 |
| 4 | ~4.0 | 0.253 | 72.1 | 0.417 | 1.077 |
| 5 | ~5.0 | 0.286 | 85.8 | 0.416 | 1 |

FIG. 56

| DEVELOPING BIAS | CARRYING ELECTRODE POTENTIAL | | | PHOTOSENSITIVE MEMBER SURFACE POTENTIAL | | | NUMBER OF TONER PARTICLES HAVING REACHED NON-IMAGE PORTION | NUMBER OF TONER PARTICLES USED FOR DEVELOPMENT |
|---|---|---|---|---|---|---|---|---|
| | HIGH | LOW | AVERAGE | NON-IMAGE PORTION | LINE IMAGE | SOLID IMAGE | | |
| POTENTIAL (V) | POTENTIAL (V) | POTENTIAL (V) | POTENTIAL (V) | POTENTIAL (V) | POTENTIAL (V) | POTENTIAL (V) | NUMBER | NUMBER |
| 20 | 20 | -80 | -13.3 | -110.4 | -28.8 | -0.3 | 0 | 1 |
| 10 | 10 | -90 | -23.3 | -110.7 | -29.0 | -0.6 | 0 | 4 |
| 0 | 0 | -100 | -33.3 | -110.9 | -29.3 | -0.8 | 0 | 8 |
| -10 | -10 | -110 | -43.3 | -111.1 | -29.5 | -1.0 | 1 | 8 |
| -20 | -20 | -120 | -53.3 | -111.4 | -29.7 | -1.3 | 1 | 10 |
| -30 | -30 | -130 | -63.3 | -111.6 | -30.0 | -1.5 | 9 | 13 |
| -40 | -40 | -140 | -73.3 | -111.8 | -30.2 | -1.7 | 17 | 14 |

DEVELOPING DEVICE USING ELECTROSTATIC TRANSPORT MEMBER

BACKGROUND OF THE INVENTION

1. Field of the Invention

The present invention relates to an image forming apparatus such as a copying machine, a facsimile machine or a printer, and more specifically, to a toner supply device for supplying toner to an electrostatic transport member which carries the toner to a developing position with an electrostatic force and a developing device including the toner supply device.

2. Related Background Art

An image forming apparatus such as a copying machine, a facsimile machine, or a printer is constructed to form an electrostatic latent image on a latent image carrying member such as a photosensitive member, to visualize the electrostatic latent image as a toner image using a one-component developer composed of toner, or a two-component developer composed of toner and carrier, and to directly transfer the toner image to a recording medium such as a transfer paper or indirectly transfer the toner image to a transfer paper via an intermediate transfer member such as an intermediate transfer belt. An example of such an image forming apparatus is disclosed in JP 9-197781 A and JP 9-329947 A. In the prior art image forming apparatus, toner on a surface of a developer carrying member such as a developing roller is transported to a developing to develop an electrostatic latent image on a photosensitive member.

However, there is a problem in the image forming apparatus that that the toner adheres and sticks to the surface of one of the photosensitive member and the developing roller due to friction therebetween to adversely affect an image in quality. In addition, the toner at an developing position is electrostatically moved by a potential difference between the surface of the developing roller and the electrostatic latent image on the photosensitive member. In this case, this potential difference has to be considerably large because, prior to electrostatically moving the toner, the toner should be applied with a force which can overcome an adhesive force between the toner and the developing roller due to a Van der Waals force, an image force so that the toner is released from the adhered state.

On the other hand, an image forming apparatus for developing a toner image without using a developer carrying member such as a developing roller is disclosed in JP2002-341656A. The prior art image forming apparatus is constructed to transport toner to a developing position in an Electrostatic Transport & Hopping (ETH) phenomenon which occurs on a surface of an electrostatic transport substrate on which plural electrodes are disposed at a predetermined pitch. In the ETH phenomenon, energy in a phase shift electric field acting on powder or fine particles is converted into mechanical energy so that the fine particles themselves are dynamically varied. In other words, the ETH phenomenon causes the fine particles to jump with a component in a traveling direction owing to the phase shift electric field on the surface of the electrostatic transport substrate so that both the movement or carrying in a direction along the surface of the substrate and the movement or hopping in a direction perpendicular to the surface of the substrate are performed. Therefore, when the toner on the surface of the electrostatic transport substrate is carried to the developing position while eliminating the adhesive force in the ETH phenomenon, a desirable low potential development, which cannot be expected in the developing device of the structure using the developer carrying member, can be realized. For example, it is also possible to selectively adhere toner to an electrostatic latent image which has a potential difference of only several tens of volts betoween an image portion and a non-image portion of the electrostatic latent image.

In the developing device of the prior art image forming apparatus, however, a sufficiently charged toner cannot be supplied to the electrostatic transport substrate, with the result that a satisfactory development can not be performed. Usually, toner can be charged due to friction by an agitator in a toner hopper or a doctor blade when the toner is drawn up to a surface of a charging roller from the toner hopper. However, there is a problem that the toner cannot be charged sufficiently by the agitator or the doctor blade with such a low friction.

To solve the problem, the toner may be charged by a corona discharging device. However, it is likely that a large quantity of toner is scattered by impact caused. by the corona discharge. In addition, since ozone is generated by the corona discharge, this is not preferable for the environment.

Moreover, it is to be noted that a developer should be supplied to a photosensitive member such that the developer is distributed uniformly over an entire length of the photosensitive member. Thus, conventionally, a toner agitating and transport screw device having a spiral screw formed on an outer periphery of a main shaft is used for agitating and transporting toner to a toner supply device. Examples of such a toner agitating and transport screw device are disclosed in JP 2001-331024 A, JP 2001-331025 A, and JP 10-221937 A, or JP 3319844 B.

However, as an amount of toner consumption per unit time in a developing device of a recent image forming apparatus increases in accordance with an increase in copying or speed, it has been demanded to supply toner rapidly and mix and agitate the toner sufficiently in short time to increase a charging amount of the toner to a suitable level for development. However, the prior art agitating and transport screw device having a screw-like vane cannot meet such a demand for the developing device of the recent image forming apparatus.

SUMMARY OF THE INVENTION

It is an object of the present invention to provide a toner supply device provided with an electrostatic transport member which can carry out a desirable low potential development according an ETH phenomenon without scattering toner and generating ozone due to corona discharge.

It is another object of the present invention to provide a developing device which is excellent in agitating and transport characteristics and an image forming apparatus including the developing device.

BRIEF DESCRIPTION OF THE DRAWINGS

The above and other objects, features and advantages of the present invention will become more apparent from the following detailed description taken with the accompanying drawings in which:

FIG. 53 is a diagram showing a gap between a photosensitive member and an electrostatic transport substrate and a relation of a plus bias voltage with respect to the gap;

FIG. 56 is a diagram showing a relation among a potential of carrying electrodes, a surface potential of a photosensitive member, and the like;

DETAILED DESCRIPTION OF THE PREFERRED EMBODIMENTS

The present invention will be hereinafter described in detail with reference to the accompanying drawings.

First, the specific terms for explaining behaviors of toner in the ETH phenomenon will be used in this specification in manner that the movement of toner in a direction along a surface of an electrostatic transport substrate is represented as "carrying", that a velocity, a direction and a distance of the movement of toner in the direction are represented as "carrying velocity", "carrying direction" and "carrying distance", respectively, that the movement of toner in a direction perpendicular to the surface of the substrate is represented as "hopping", and that a velocity, a direction and a distance of the movement of toner in the direction are represented as "hopping velocity", "hopping direction", and "hopping height or distance", respectively. Further, the terms carrying and hopping are generally represented as "transport".

Figure 1:
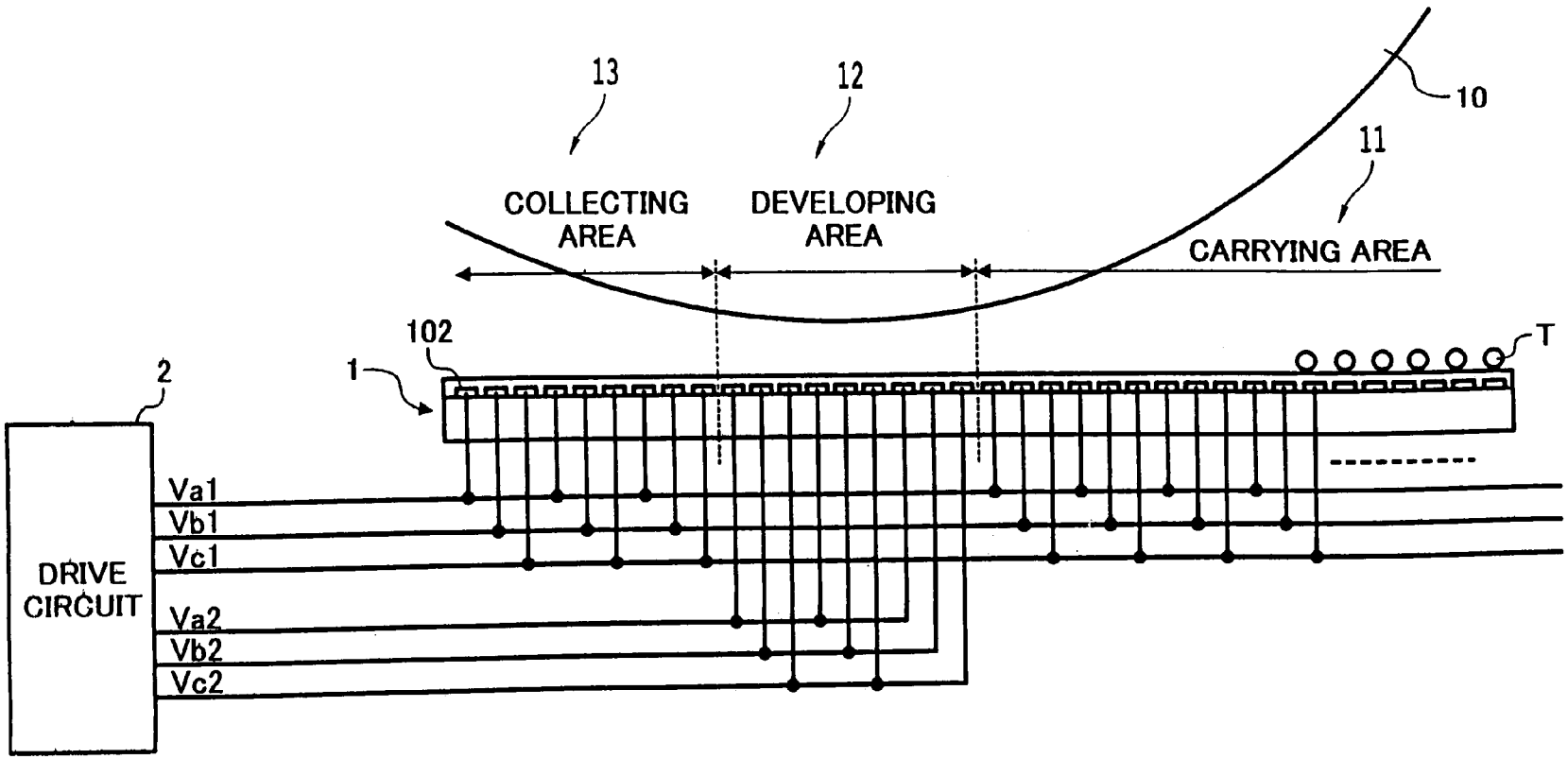
FIG. 1 is a schematic diagram showing a structure of a developing device of a copying machine in accordance with an embodiment of the present invention.

FIG. 1 shows a structure of a developing device of a copying machine in accordance with an embodiment of the present invention. The developing device comprises an electrostatic transport substrate 1 and a drive circuit 2 for driving the electrostatic transport substrate 1. A photosensitive member 10 of a drum shape serves as a latent image carrying member of the copying machine. The electrostatic transport carrying substrate 1 includes plural electrodes 102 for generating an electric field which carries and hops toner T. Different drive signals Va1 to Vc1 and Va2 to Vc2 of n phases (in this case, three phases) for generating a predetermined electric field are applied to the electrodes 102 from the drive circuit 2.

The electrostatic transport substrate 1 is divided into a carrying area 11, a developing area 12, and a collecting area 13 according to a relation between the range of the electrodes 102 to which the drive signals Va1 to Vc1 and Va2 to Vc2 are applied to and the photosensitive member 10. The carrying area 11 is an area for transporting the toner T to the photosensitive member 10, the developing area 12 is an area for developing an electrostatic latent image on the photosensitive member 10 with the toner T to form a toner image, and the collecting area 13 is an area where toner, which has not contributed to the development, is collected after passing the developing area 12.

In the carrying area 11, the toner T is transferred toward the developing area 12 of the photosensitive member 10. Formed in the developing area 12 is an electric field in a direction of attracting the toner T toward the electrostatic latent image on the photosensitive member 10 and, on the other hand, moving the toner T away from a non-image portion of the photosensitive member 10. Further, formed in the collecting area 13 is an electric field in a direction of moving the toner T away from both the electrostatic latent image and the non-image portion of the photosensitive member 10. Thus, in the developing area 12, the toner T adheres to the electrostatic latent image on the photosensitive member 10 so as to form a toner image. Further, the toner T, which has not contributed to the development, is collected onto the electrostatic transport substrate 1 in the collecting area 13 at a downstream side in a direction of movement or rotation of the photosensitive member 10. As a result, the toner is prevented from being scattered.

FIGS. 2 to 6 show a structure of the electrostatic transport substrate 1. This electrostatic carrying substrate 1 includes a base substrate 101. Plural electrode sets each consisting of three electrodes 102*a*, 102*b*, and 102*c* (these are also referred to as "electrodes 102") extending in a direction perpendicular to a toner carrying direction are disposed on this base substrate 101 so as to be arranged in the toner carrying direction at a predetermined pitch. A protective layer 103 consisting of an inorganic or organic insulation material is coated on the electrode sets, whereby a toner carrying surface is formed. More specific examples of a material for the protective layer 103 include a material with a low moisture-absorption characteristic and a small surface coefficient of friction such as $SiO_2$, $Si_3N_4$, $Ta_2O_5$, $TiO_2$, SiON, or $Si_3N_4$. Providing the protective layer 103 consisting of such a material can prevent toner from adhering to an electrostatic transport substrate for transfer 442.

Figure 2:
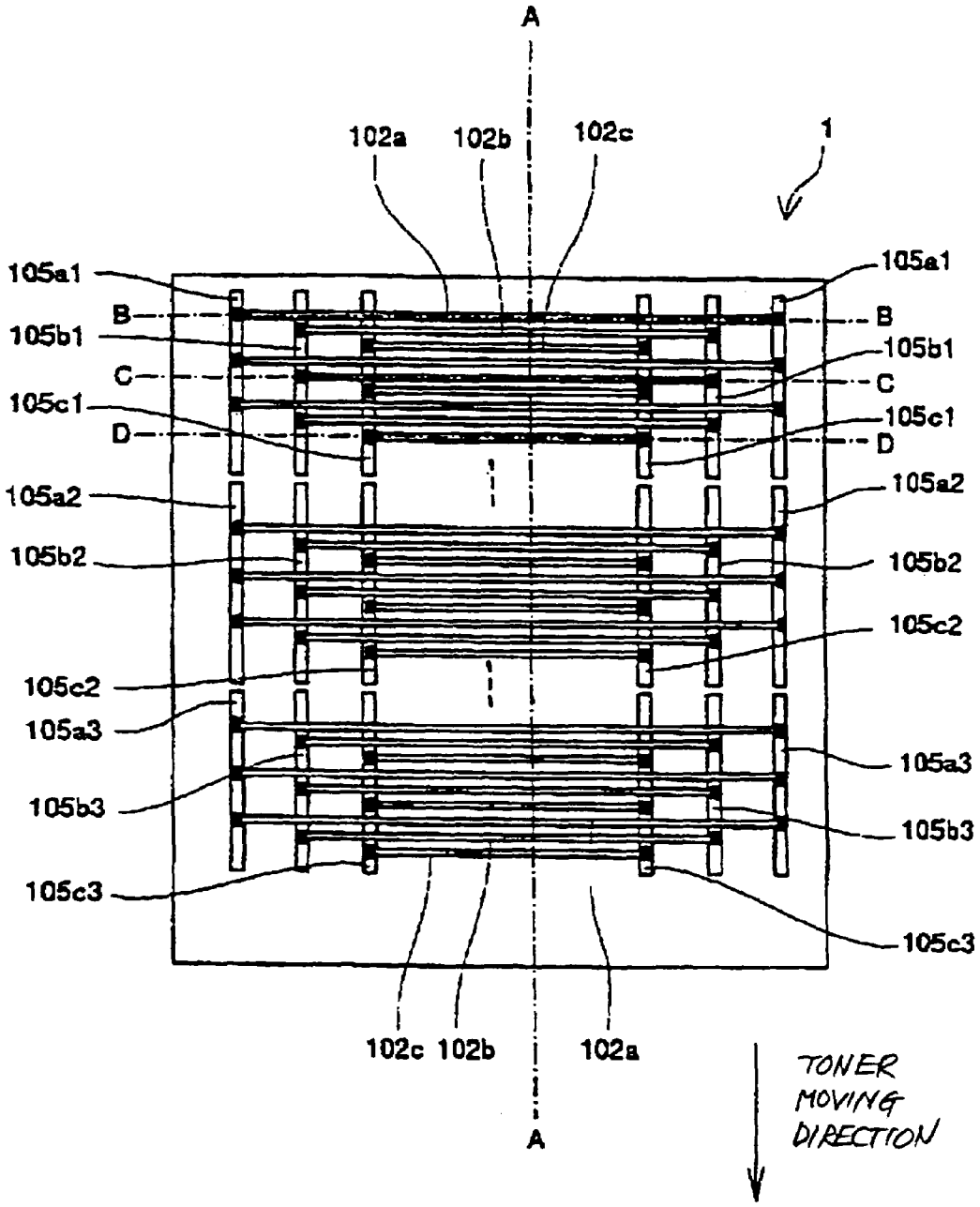
FIG. 2 is a plan view showing a structure of an electrostatic carrying substrate of the developing device.
Figure 3:
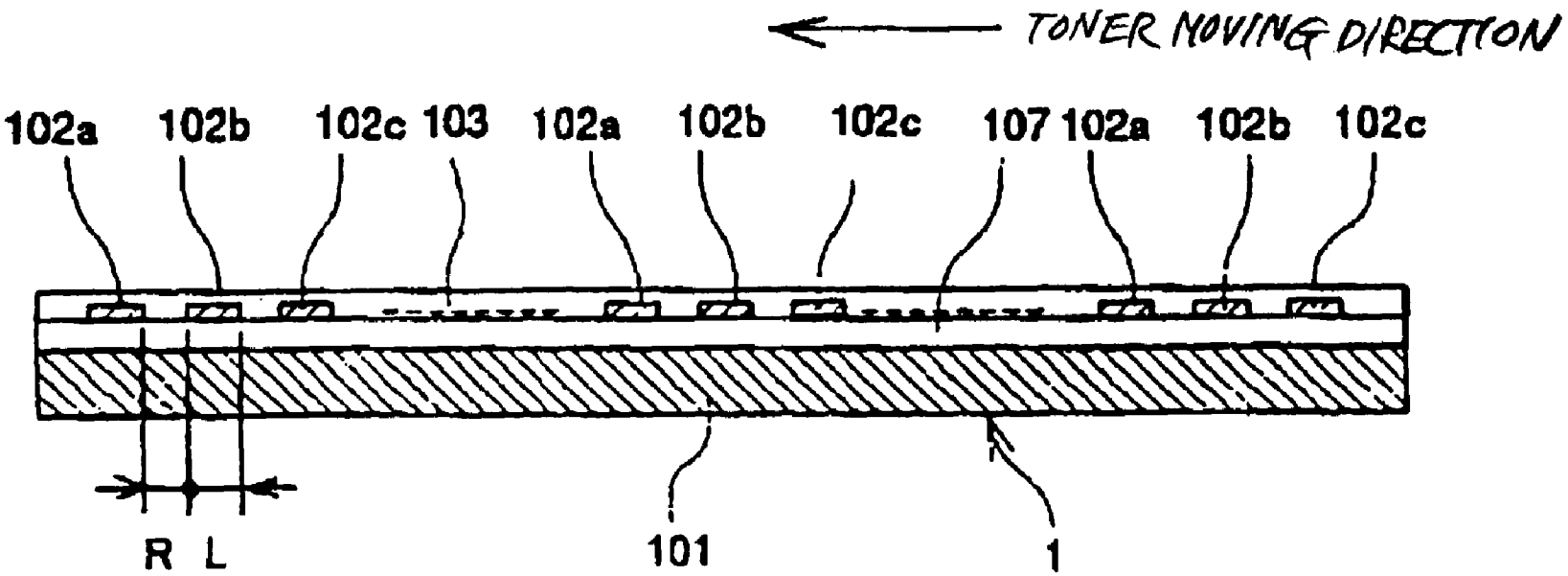
FIG. 3 is a sectional view along a line A—A of FIG. 2.
Figure 4:
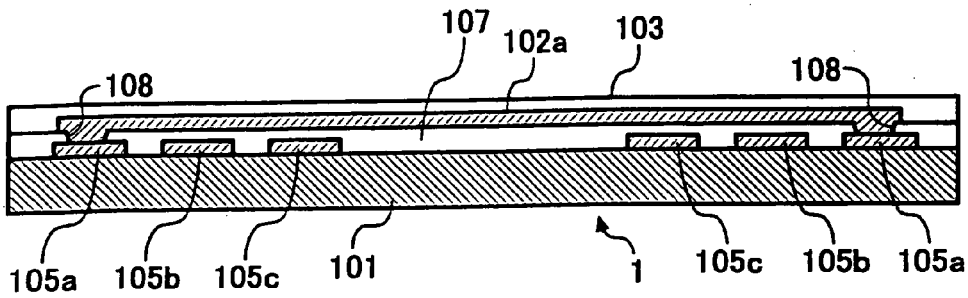
FIG. 4 is a sectional view along a line B—B of FIG. 2.

Common electrodes 105*a*, 105*b* and 105*c* (these are also referred to as "common electrodes 105"), which are mutually connected to the electrodes 102*a*, 102*b* and 102*c* at both ends thereof, respectively, are provided on both sides of the electrode sets so as to be arranged along the toner carrying direction. A width (length in a direction perpendicular to the toner carrying direction) of the common electrodes 105 is greater than a width (length in a latitudinal direction) of the electrodes 102. As shown in FIG. 2, the common electrodes 105 existing in the carrying area 11, the developing area 12 and the collecting area 13 are denoted by reference signs 105*a*1, 105*b*1 and 105*c*1, reference signs 105*a*2, 105*b*2, and 105*c*2, and reference signs 105*a*3, 105*b*3 and 105*c*3, respectively.

The electrodes 102*a*, 102*b* and 102*c* and the common electrodes 105*a*, 105*b* and 105*c* are mutually connected as described below. That is, after a pattern of the common electrodes 105*a*, 105*b* and 105*c* are formed on the base substrate 101, an interlayer insulating film 107, which may consist of a material same as or different from a material of the surface protective layer 103, is formed. Then, after the a contact hole 108 is formed in the interlayer insulating film 107, the electrodes 102*a*, 102*b* and 102*c* are formed so that the electrodes 102*a*, 102*b*, and 102*c* and the common electrodes 105*a*, 105*b*, and 105*c* are mutually connected. It is possible to form electrodes in a three-layer structure or a mix mutual connection by integral formation and a mutual connection by a contact hole. In detail, after interlayer insulating film 107 is formed on a pattern obtained by integrally forming the electrode 102*a* and the common electrode 105*a*, a pattern obtained by integrally forming the electrode 102*b* and the common electrode 105*b* is formed on the interlayer insulating film 107. Then, a pattern obtained by integrally forming the electrode 102*c* and the common electrode 105*c* is formed on the interlayer insulating film 107.

The common electrode 105*a*, 105*b*, and 105*c* are provided with drive signal applying input terminals for inputting drive signals Va, Vb and Vc from the drive circuit 2. The drive signal inputting terminals (not shown) may be provided on a back side of the base substrate 101 and connected to the common electrodes 105 via through-holes or may be provided on the interlayer insulating film 107.

The base substrate 101 is, for example, a substrate obtained by coating an insulating film of $SiO_2$ or the like over a base layer consisting of an insulating material such as a glass substrate, resin, or ceramics or a conductive material such as SUS. A layer consisting of a deformable material such as a polyimide film may be used as the base layer.

The electrodes 102 are such that a conductive material such as Al or Ni—Cr coated on the base substrate 101 to a thickness of 0.1 to 0.2 μm is patterned in a predetermined shape by a photolithography method or the like. A width of the plural electrodes 102 in the toner carrying direction is adjusted in the range of one to twenty times an average particle diameter of the toner. In addition, a distance among the electrodes 102 in the toner carrying direction is also adjusted in the range of one to twenty times the average particle diameter of the toner.

The protective layer 103 is obtained by forming a film of $SiO_2$, $TiO_2$, $TiO_4$, SiON, BN, TiN, $Ta_2O_5$, or the like to a thickness of 0.5 to 3 μm. The protective layer 103 may be a film consisting of an inorganic nitride compound such as SiN, Bn, or W. Since a charging amount of toner tends to decrease in a course of carrying when the amount of surface hydroxyl groups (SiOH, silatol group) increases, it is effective to use an inorganic nitride compound with a less amount of surface hydroxyl groups.

Figure 7:
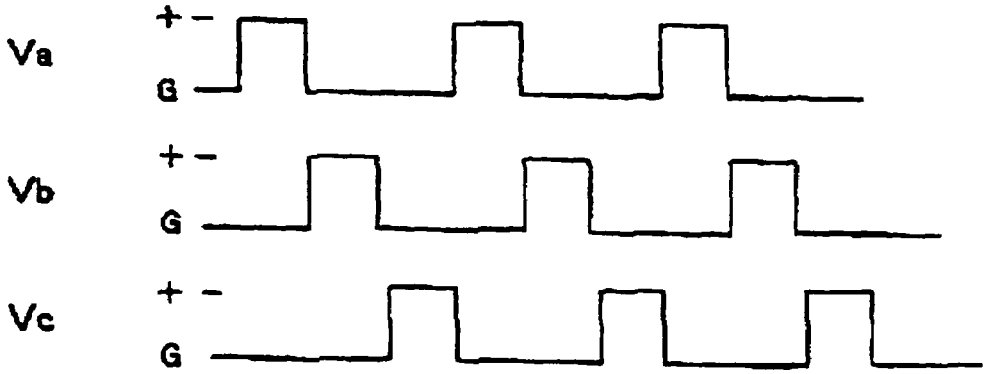
FIG. 7 is a diagram showing an example of a waveform of a drive signal applied to the electrostatic transport substrate.
Figure 8:
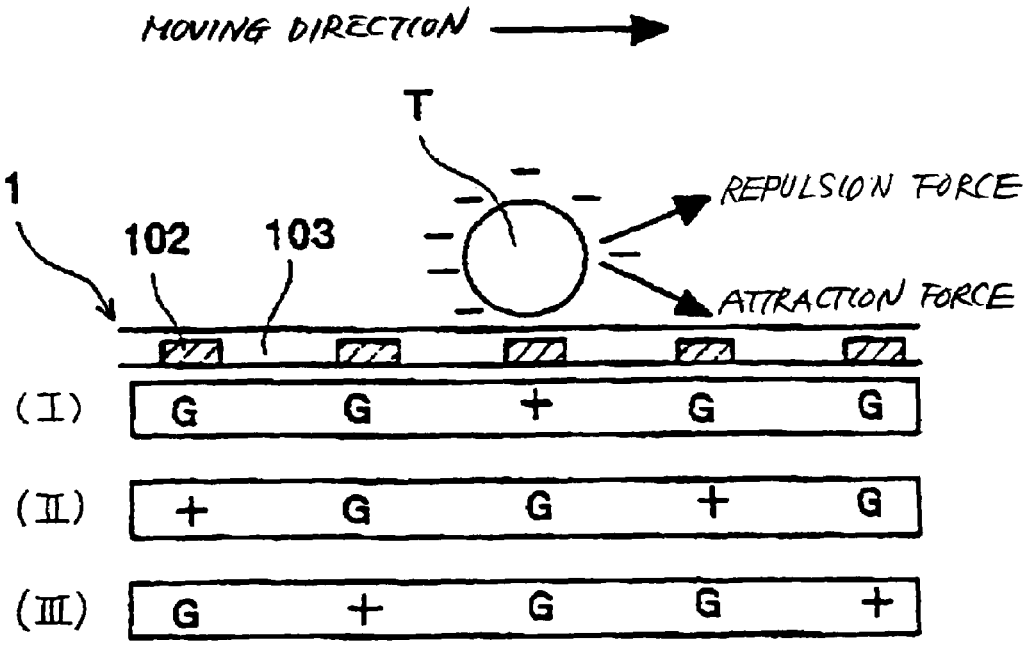
FIG. 8 is a diagram for explaining carrying and hopping of toner.

When a drive signals of n phases is applied from the drive circuit 2 to the electrodes 102 of the electrostatic transport substrate 1, a phase shift electric field (progressive wave electric field) is generated among the plural electrodes 102. Accordingly, charged toner on the electrostatic transport substrate 1 is affected by a repulsion force or an attraction force to move in a carrying direction while hopping. For example, a pulse-like drive signals Va, Vb and Vc of three phases such as A phase, B phase and C phase, which changes between the ground G (0 V) and a positive (+) voltage as shown in FIG. 7, is applied to the plural electrodes 102 of the electrostatic transport substrate 1 at staggered timing. It is assumed that the toner T of a negative (−) charging property exists on the electrostatic transport substrate 1, and voltages "G", "G", "+", "G", and "G" are applied to the consecutive plural electrodes 102 on the electrostatic transport substrate 1 as indicated by (I) in FIG. 8. Then, the toner T moves onto the electrode 102 of the voltage "+". Next, when voltages "+", "G", "G", "+", and "G" are applied to the plural electrodes 102 as indicated by (II), a repulsion force acts between the toner T and the electrode 102 of the voltage "G" on the left side in the figure. At the same time, an attraction force also acts between the toner T and the electrode 102 of the voltage "+" on the right side in FIG. 8. As a result, the toner T moves onto the electrode 102 of the voltage "+". Moreover, when voltages "G", "+", "G", "G", and "+" are applied to the plural electrodes 102 as indicated by (III), a repulsion force and an attraction force act on the toner T in the same manner, and the toner T further moves onto the electrode 102 of the voltage "+".

Since drive signals of plural phases with varying voltages are applied to the plural electrodes 102 as mentioned above ,a progressive wave electric field is generated on the electrostatic transport substrate 1 so that toner is carried in the traveling direction of this progressive wave electric field while hopping. If toner of a positive (+) charging property is used, a similar carrying can be realized by reversing a changing pattern of the drive waveform.

Figure 9A:
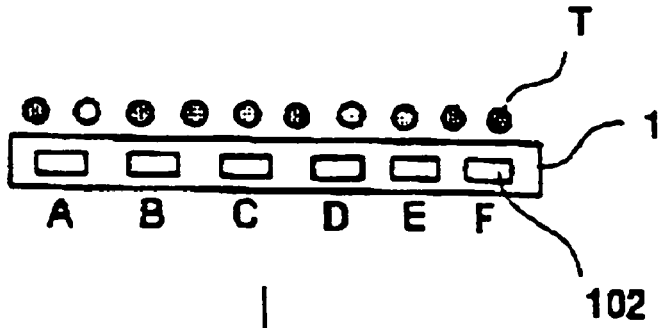
FIGS. 9A to 9D are diagrams for explaining carrying and hopping of the toner in more detail.
Figure 9B:
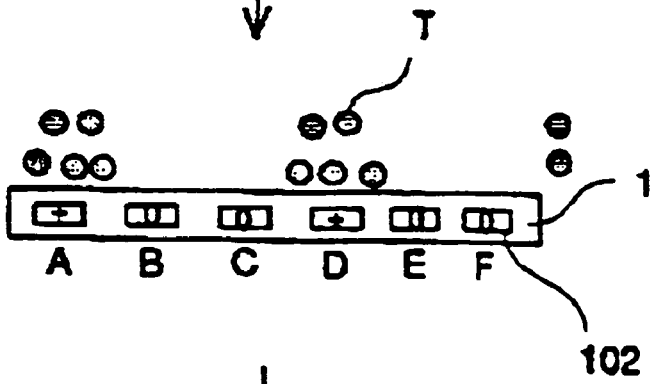
Figure 9C:
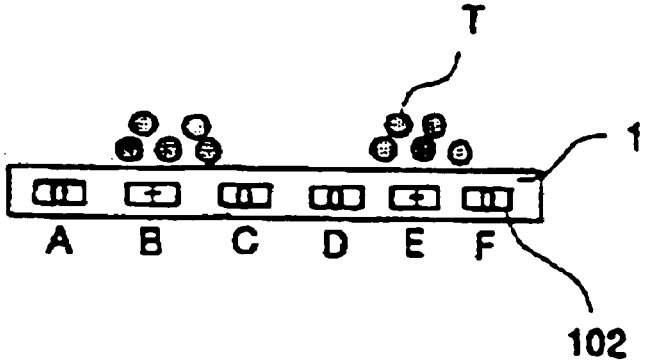
Figure 9D:
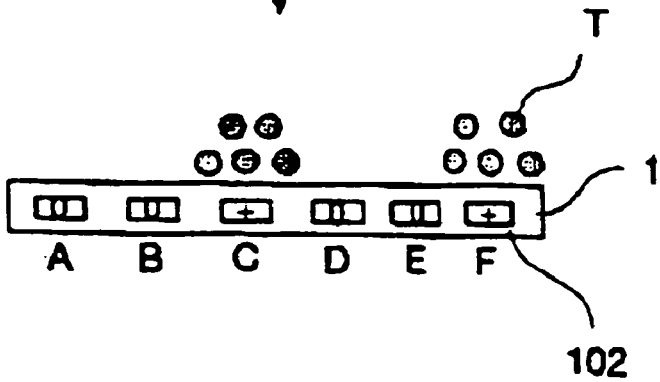

The carrying operation will be described in more detail with reference to FIGS. 9A to 9D. When all the electrodes A to F of the electrostatic transport substrate 1 carrying the toner T have 0 V (G) as shown in FIG. 9A, a voltage "+" is applied to each of the electrodes A and D as shown in FIG. 9B. Then, the toner T is attracted by the electrodes A and D to move onto these electrodes A and D. Subsequently, when the voltages of both the electrodes A and D change to 0 V, and a voltage "+" is applied to each of the electrodes B and E as shown in FIG. 9C, the toner T on the electrodes A and D receives a repulsion force as well as an attraction force of the electrodes B and E and is transported onto the electrodes B and E. Moreover, as shown in FIG. 9D, when the voltages of both the electrodes B and E change to "0", and a voltage "+" is applied to each of the electrodes C and F, the toner T on the electrodes B and F receives a repulsion force as well as an attraction force of the electrodes C and F and is transferred onto the electrodes C and F. Thus, a progressive wave electric field capable of transporting toner sequentially is generated so that the toner T is transported from the left to the right in FIGS. 9A to 9D.

Figure 10:
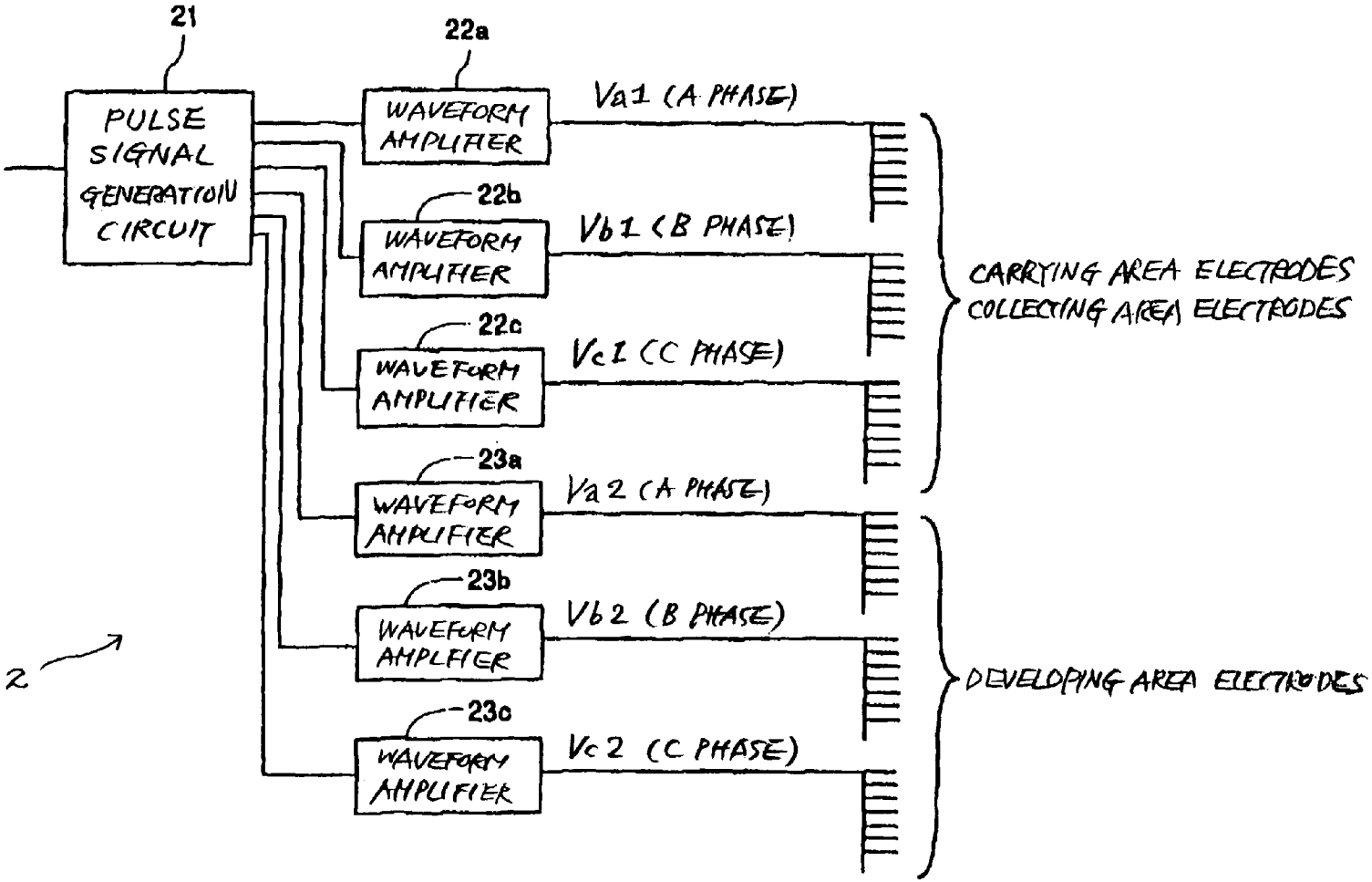
FIG. 10 is a block diagram showing an example of a structure of a drive circuit of the developing device.

FIG. 10 shows an example of a structure of the drive circuit 2. The drive circuit 2 includes a pulse signal generation circuit 21, waveform amplifiers 22*a*, 22*b*, 22*c*, 23*a*, 23*b* and 23*c*. The waveform amplifiers 22*a*, 22*b*, and 22*c* output drive signals Va1, Vb1 and Vc1, respectively in response to a pulse signal from the pulse signal generation circuit 21. The waveform amplifiers 23*a*, 23*b* and 23*c* output drive signals Va2, Vb2, and Vc2 in response to a pulse signal from the pulse signal generation circuit 21.

The pulse signal generation circuit 21 receives, for example, an input pulse having a logic level and drives a switching means included in the waveform amplifiers 22*a* to 22*c* and 23*a* to 23*c* of the next stage by two set of pulses with phases shifted 120° from each other. Then, the pulse signal generation circuit 21 outputs a pulse signal of an output voltage 10 to 15 V of a level at which switching of 100 V can be performed.

Figure 11:
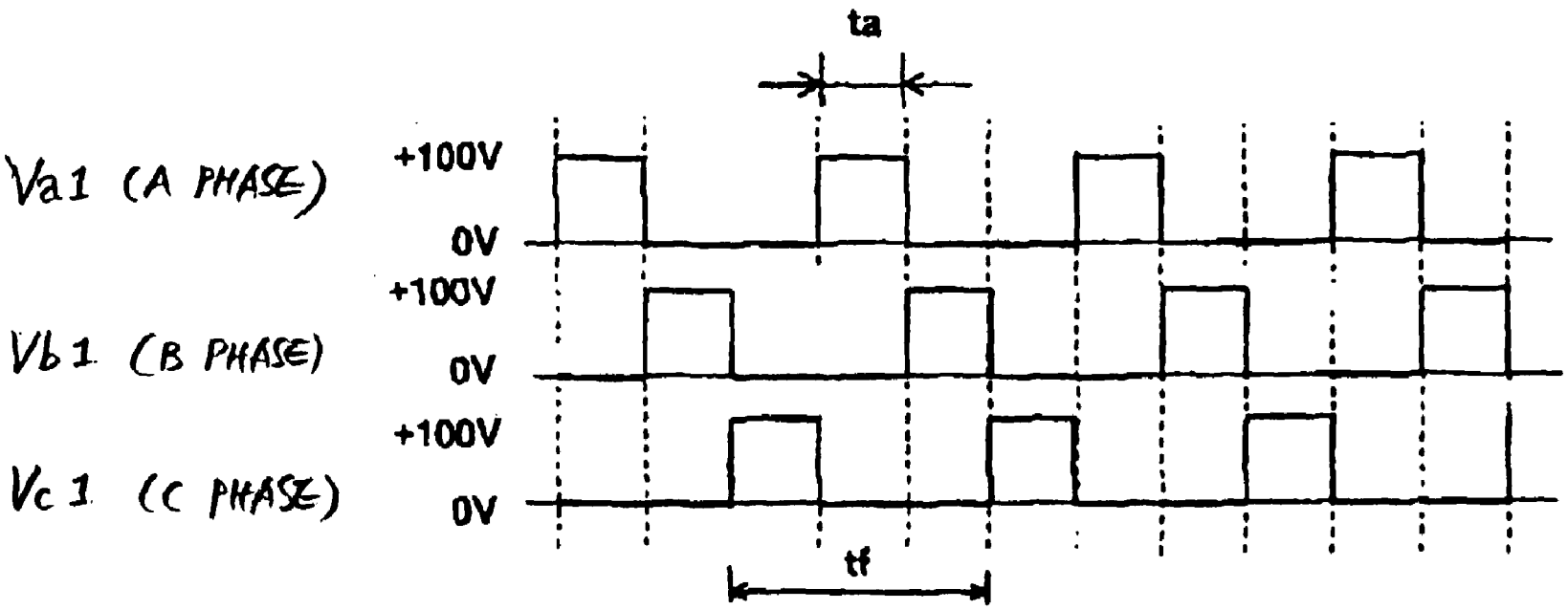
FIG. 11 is a diagram showing an example of a waveform of a drive signal of a carrying voltage pattern and a collecting and carrying voltage pattern.

The waveform amplifiers 22*a*, 22*b* and 22*c* output the drive signals Va1, Vb1 and Vc1 to the respective electrodes 102 of the carrying area 11 and the collecting area 13. For example, as shown in FIG. 11, the drive signals Va1, Vb1 have three phases A, B and C which an application time ta of +100 V is set to about 33% equivalent to ⅓ of a repetition period tf. The drive waveform of three phases A, B and C will be hereinafter also referred to as a carrying voltage pattern or a collecting and carrying voltage pattern.

Figure 12:
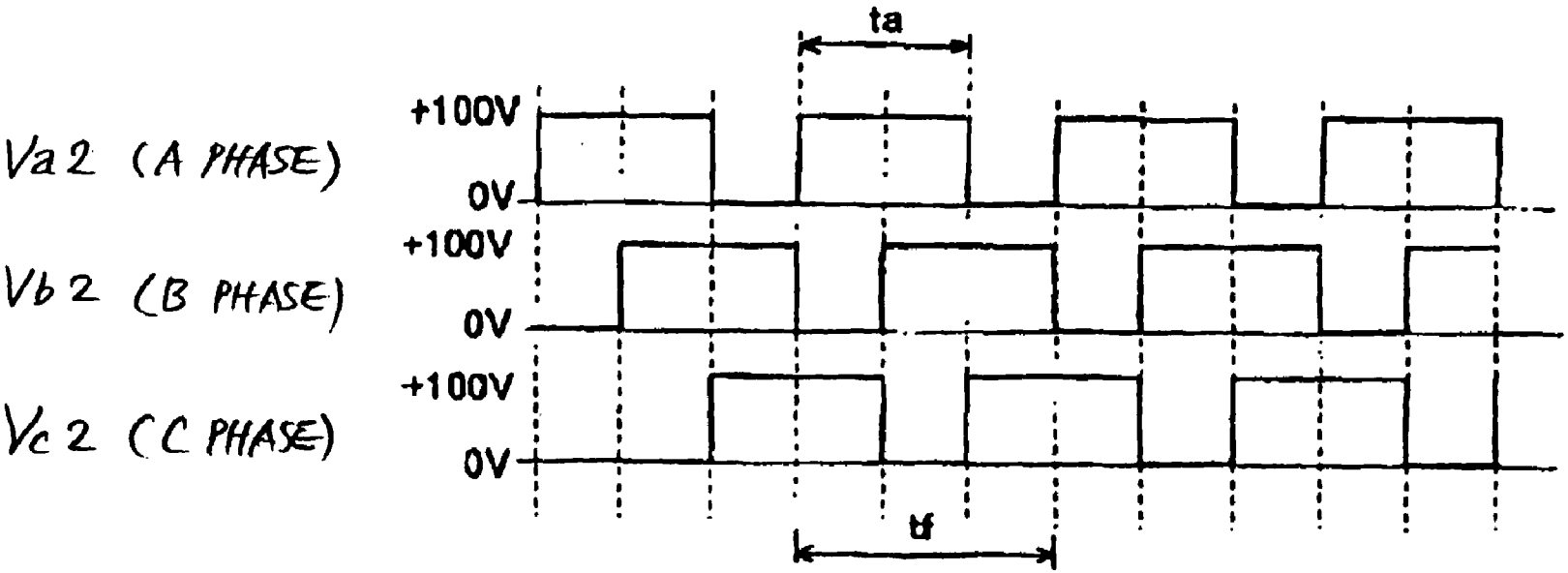
FIG. 12 is a diagram showing an example of a waveform of a drive signal of a hopping voltage pattern.
Figure 13:
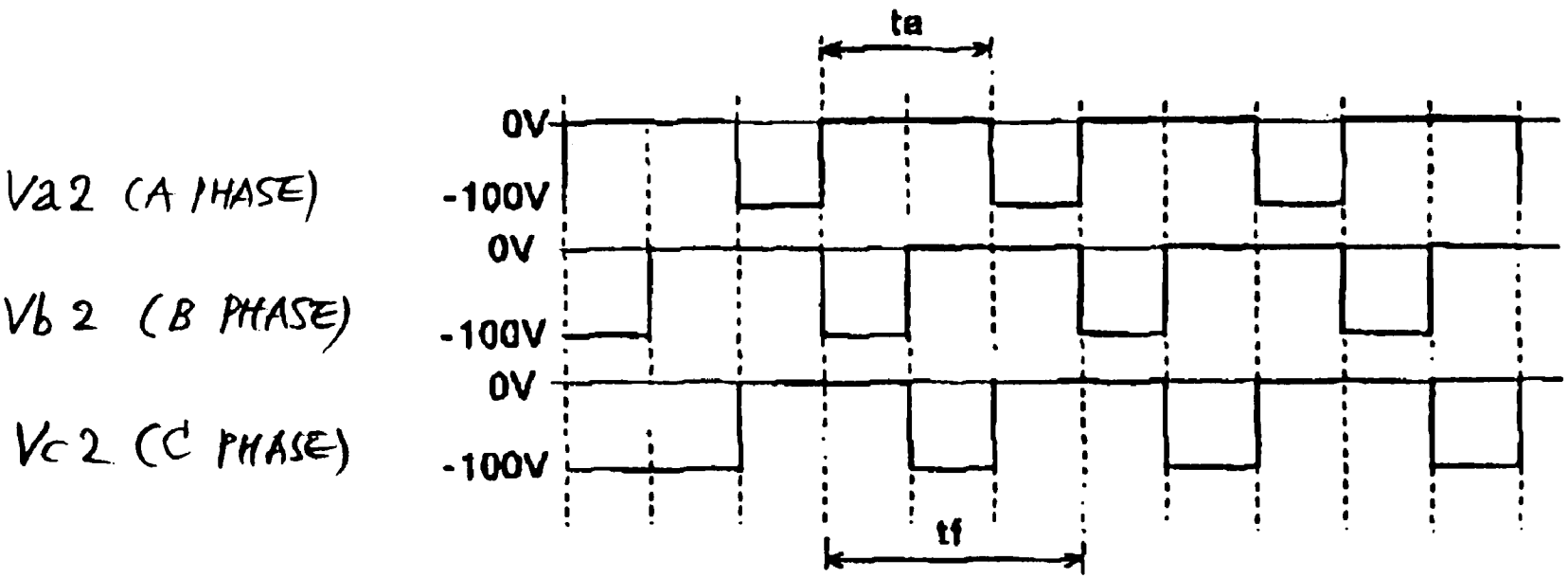
FIG. 13 is a diagram showing another example of the waveform of the drive signal of the hopping voltage pattern.

On the other hand, the waveform amplifiers 23*a*, 23*b*, and 23*c* output drive signals Va2, Vb2 and Vc2 to the respective electrodes 102 of the developing area 12. For example, as shown in FIGS. 12 and 13, the drive signals Va2, Vb2 and Vc2 have three phases A, B and C in which an application time ta of +100 V or 0 V is set to about 67% equivalent to ⅔ of a repetition period tf. The drive signals of three phases A, B and C will be hereinafter also referred to as a hopping voltage pattern.

The development according to ETH phenomenon, that is, the ETH development is performed according to electrostatic movement of toner. However, the ETH development does not utilize smoking and clouding of toner which naturally occur due to the electrostatic movement as in a conventional developing device using the electrostatic movement. The ETH development actively causes the toner to hop toward the photosensitive member 10. This hopping does not occur simply by using a conventional electrostatic transport substrate but occurs by appropriately setting a relation among an electrode width, an electrode interval, and a drive waveform.

Figure 14:
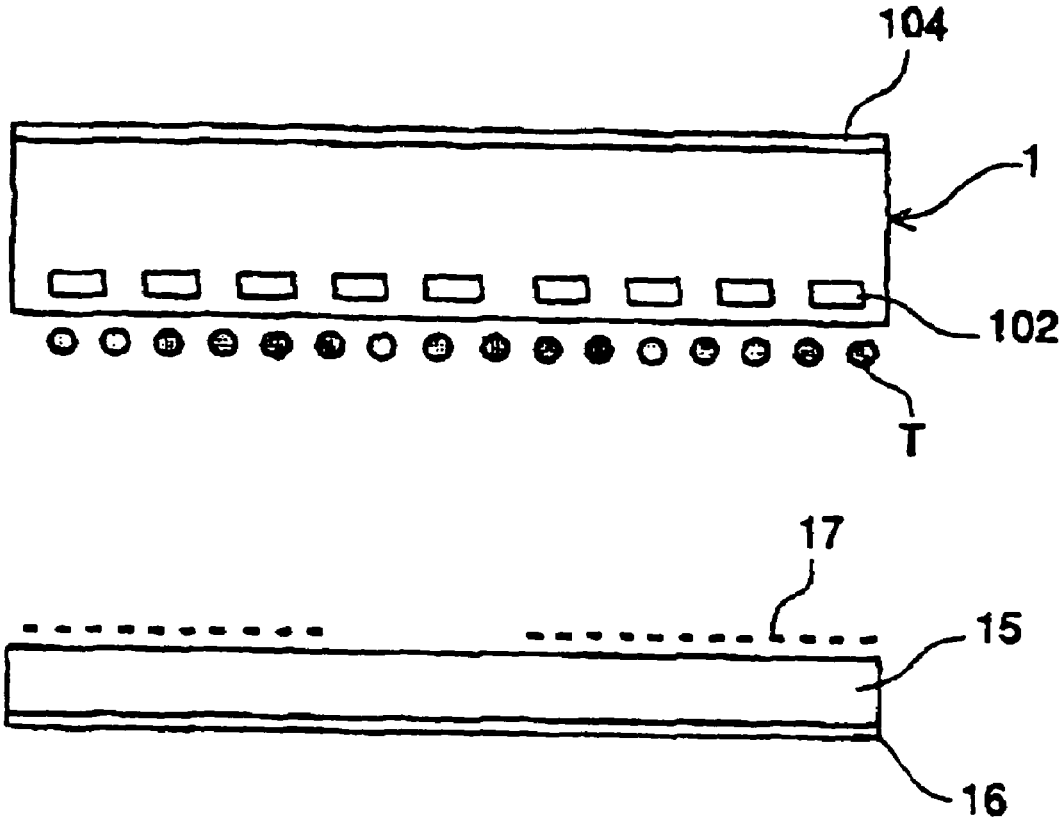
FIG. 14 is a diagram showing an objective area in a simulation for an explanation of a principle of hopping.

The inventors of the present invention have performed a simulation of the ETH development with a computer according to a two-dimensional differential method in which the result of the experiment in the toner electrostatic carrying by the ETH phenomenon was reflected. FIG. 14 shows an environment in this simulation. In this simulation, a direction of the gravity is assumed to be an upward direction for convenience of explanation. In the electrostatic transport substrate 1, a conductive substrate 104 is provided on an opposite side of an electrode surface and is normally grounded. An OPC layer 15 facing the electrode surface of the electrostatic transport substrate 1 is provided via a predetermined space, and a conductive substrate 16 is provided on an opposed side of a surface of the OPC layer 15 facing the electrode surface of the electrostatic transport substrate 1 and is normally grounded. In addition, an electrostatic latent image 17 is carried on an opposed surface of the OPC layer 15. Moreover, to realize a reversal developing which allows toner T of a negative charging property to adhere to a non-charged portion, a charge is not applied to the image portion of the electrostatic latent image 17 but to the non-image portion.

It is assumed that an interval between the electrodes 102 of the electrostatic transport substrate 1 and the OPC layer 15 is 200 μm, the toner T has an average particle diameter of 8 μm, an average charging amount Q/m is −20 μC/g, and a charge density on the OPC layer 15 is $-3.0\times10^{-4}$ c/m$^2$. When the entire surface of the OPC layer 15 is charged with this charge density, a surface potential of the OPC layer 15 is −169 V. In the toner T, 140 particles were arranged uniformly with a simulation width of 700 μm in two layers.

Figure 15:
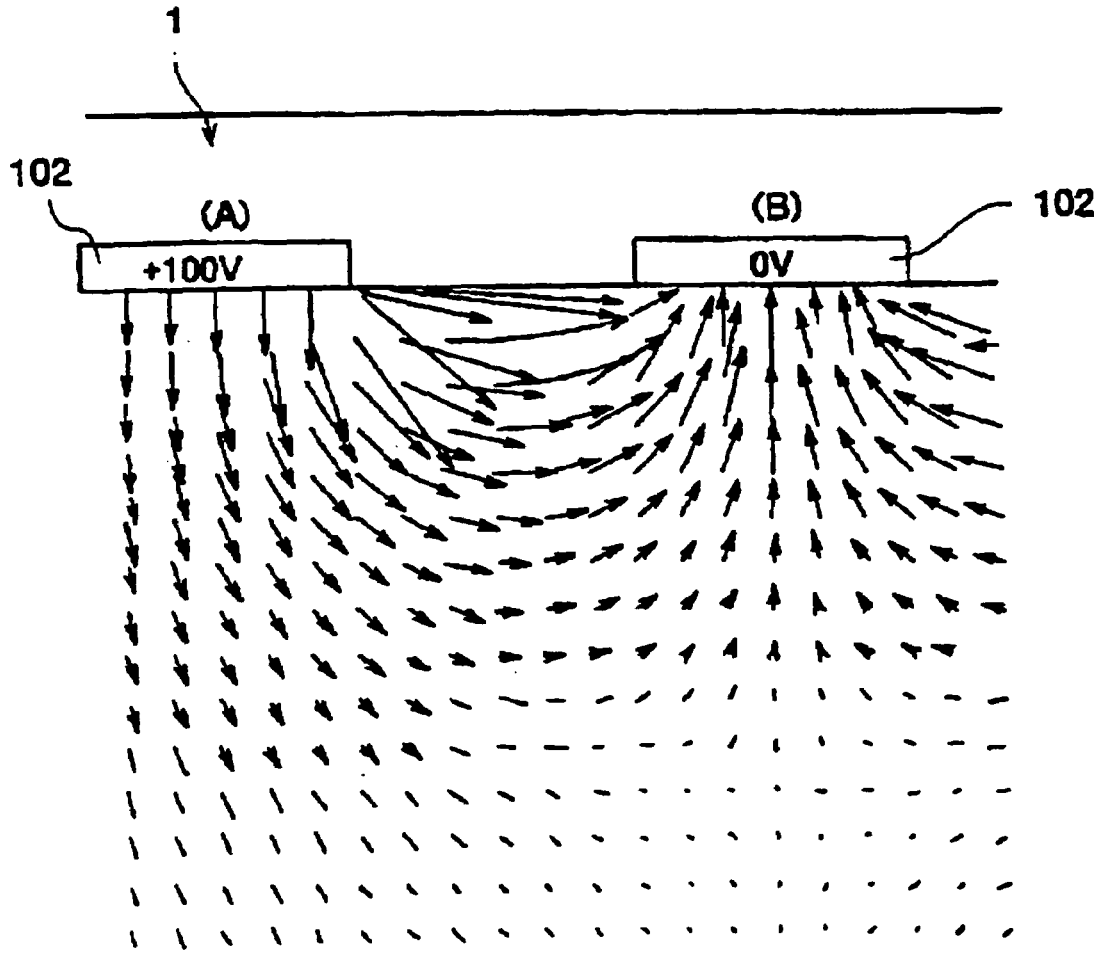
FIG. 15 is a diagram for explaining an electric field vector in the vicinity of electrodes.

Among the above-mentioned conditions, in the case where the charge density of the OPC layer 15 is set to "zero", an electric field vector in the vicinity of the electrode B at the time when +100 V, 0 V, and +100 V are applied to the three electrodes A, B, and C adjacent to each other on the electrostatic transport substrate 1 is shown in FIG. 15. Since electrode C and the electrode A are symmetrical with respect to the electrode B, an electric field in the vicinity of the electrode C is not shown in FIG. 15. Toner is not shown either. The space facing the OPC layer 15 is formed at a lower side of both the electrodes 102, although the OPC layer 15is not illustrated. In addition, a potential in the vicinity of the electrode A on the left side is close to +100

V, a potential in the vicinity of the electrode B on the right side is close to 0 V, and a potential of a space apart from both the electrodes A and B is around +50 V. Moreover, each of arrows indicates an electric field vector in the position of the arrow, the direction of the arrow indicates the direction of an electric field, and the length of the arrow indicates the intensity of the electric field.

Figure 5:
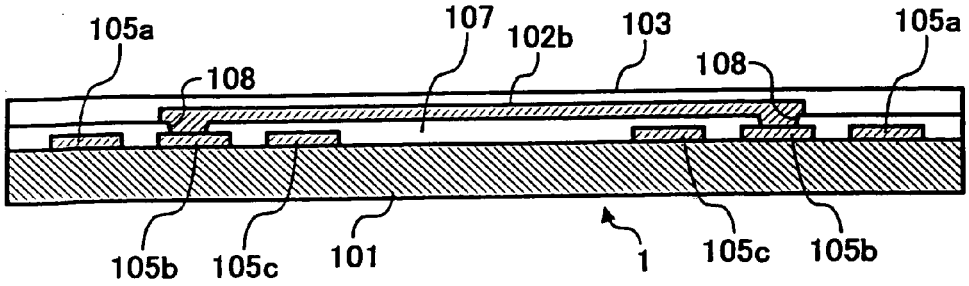
FIG. 5 is a sectional view along a line C—C of FIG. 2.
Figure 6:
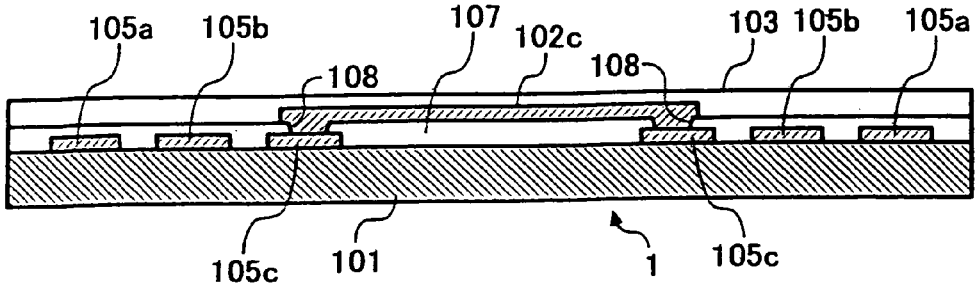
FIG. 6 is a sectional view along a line D—D of FIG. 2.

As shown in FIG. 5, since the electric field vector faces vertically from a center of the electrode B with 0 V to a space below the electrode B, a downward electrostatic force acts straightly downward on toner of a negative charging property in the center of the electrode B and the toner is accelerated downward (actually, upward). After the toner separates from the electrostatic transport substrate 1, the toner falls (actually, rises) straightly along the electric field vector.

Figure 16:
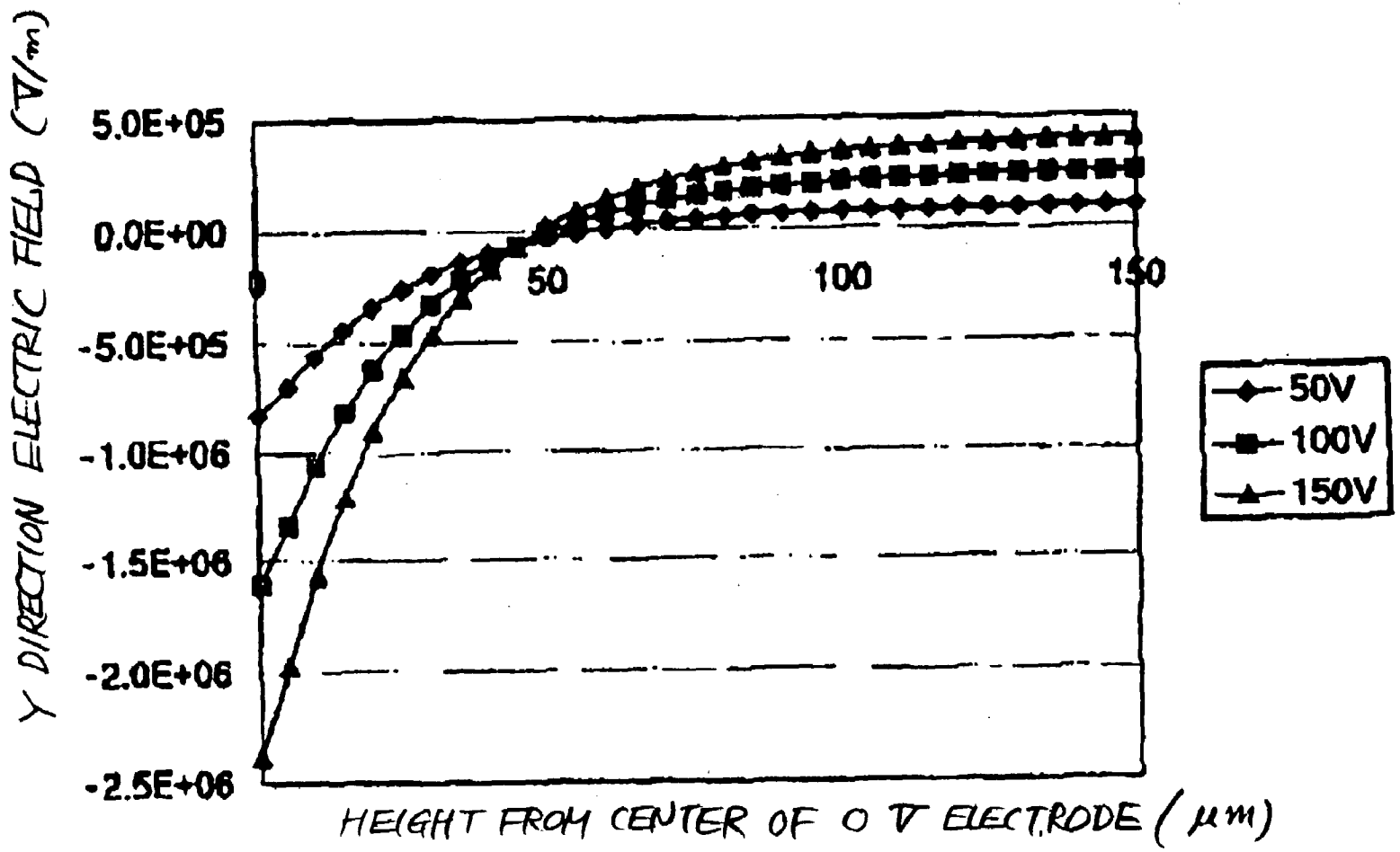
FIG. 16 is a diagram showing an example of a relation among applied voltages, a hopping direction electric field and a height from a center of 0 V electrode.

FIG. 16 shows an example of a vertical (Y) direction electric field in a space immediately below (immediately above) the center of the electrode B at the time when voltages applied to the electrodes A and C are set to 50 V, 100 V, and 150 V. As shown in FIG. 16, when the toner falls (rises) about 50 μm from the electrode B, the size of the electric field vector becomes almost zero. Therefore, the toner accelerated to this position is decelerated by a viscous resistance of the air near this position. Then, since the direction of the electric field is reversed below the elelctrode B, it is expected that the toner receives an electrostatic force of a reverse direction and loses a downward (upward) velocity.

Figure 17:
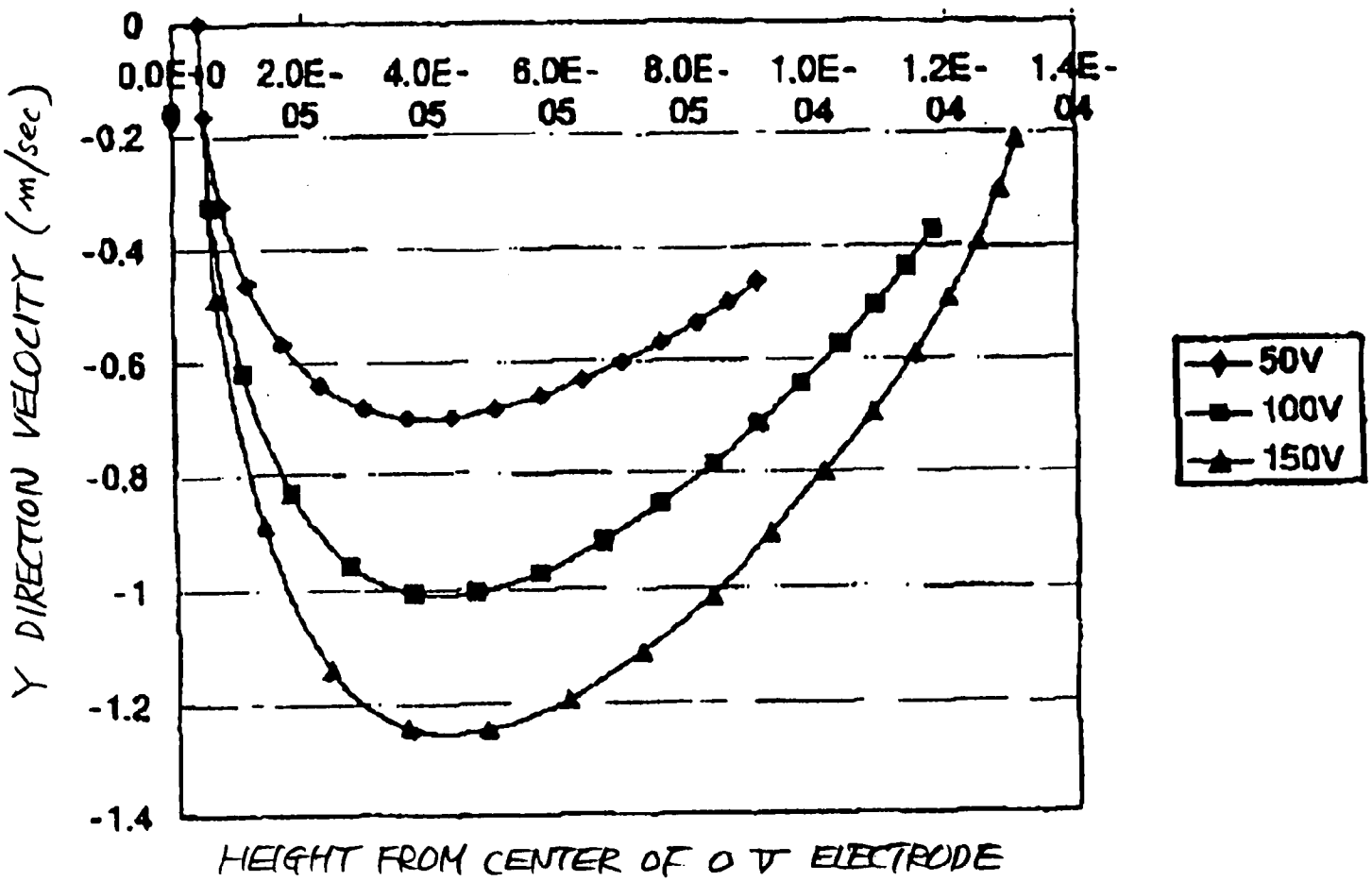
FIG. 17 is a diagram showing an example of a relation between a Y direction velocity and a hopping height with respect to applied voltages.

FIG. 17 shows, for each 10 μsec up to 160 μsec 10, results of simulation of the Y direction position and the Y direction velocity of toner with a particle diameter of 8 μm and a charging amount Q/m=−20 μC/g at the time when the toner is placed in the center of the electrode B, and voltages applied to the electrode A and C are set to 50 V, 100 V, and 150 V. This is an electrode structure with an electrode width set to 30 μm and an electrode interval set to 30 μm. As shown in FIG. 17, in the case where +100 V is applied to the electrodes A and C on both sides of the electrode B, the toner placed in the center of the electrode B reaches 40 to 50 μm above the electrode B after 50 to 60 μsec so that a rising velocity reaches 1 m/sec. Thereafter, the toner continues to rise while being gradually decelerated.

From the above-mentioned results of the simulation, it is noted that conditions for hopping toner straightly above an electrode are as described below. That is, in the case of toner of a negative charging property, potentials of electrodes on both sides of an electrode with a potential of 0 V are equal and are higher than 0 V, and the toner exists on the electrode of 0 V. In the case of toner of a positive charging property, potentials of electrodes on both sides of an electrode with a potential of 0 V are equal and lower than 0 V (e.g., −100 V), and the toner exists on the electrode of 0 V.

As shown in FIGS. 12 and 13, a drive waveform pattern that satisfies the above conditions is a hopping voltage pattern with the application time ta of +100 V or 0 V set to about 67% equivalent to ⅔ of the repetition period tf. Thus, in the copying machine of the present invention, the drive signals Va2, Vb2 and Vc2 having this hopping voltage pattern are applied to the respective electrodes 102 of the electrostatic transport substrate 1 corresponding to the developing area 12.

On the other hand, a pattern shown in FIG. 11 is most suitable as a drive waveform pattern for performing carrying of toner. That is, in the case where the drive signals Va (A phase), Vb (B phase), and Vc (C phase) are applied, the pattern is a carrying voltage pattern with the application time ta of +100 V set to about 33% equivalent to ⅓ of the repetition period tf. In accordance with the present invention, the drive signals Va1, Vb1, and Vc1 having this carrying voltage pattern are applied to the respective electrodes 102 of the electrostatic transport substrate 1 corresponding to the carrying area 11.

In such a carrying voltage pattern, when an application voltage of the B phase electrode falls to 0 V, an application voltage of the A phase electrode is 0 V, an application voltage of the C phase electrode is a positive voltage, and a traveling direction of toner is from A to C. Thus, the toner on the B phase electrode is repelled between the B phase electrode and the A phase electrode and receives an electric field in an attracting direction between the B phase electrode and the C phase electrode. As a result, carrying efficiency is increased, and particularly high-speed carrying can be performed. However, even in the case where a drive signals of a hopping voltage pattern is applied, toner particles except particles of the toner located in the center of the 0 V electrode also receive a force in a lateral direction. Therefore, not all the toner particles are always hopped high at a time. Some toner particles move in the horizontal direction. Conversely, even in the case where a drive signal of a carrying voltage pattern is applied, depending upon positions of toner particles, some toner particles rise, a distance of which is larger than a distance along which the toner particles hopped obliquely at a large angle move horizontally.

Therefore, a drive waveform pattern to be applied to the respective electrodes 102 of the carrying area 11 is not limited to the carrying voltage pattern shown in FIG. 11. In addition, a drive waveform pattern to be applied to the respective electrodes 102 of the developing area 12 is not limited to the hopping voltage pattern shown in FIG. 12 or 13 either.

In general, in the case where a pulse-like voltage (drive waveform) of n phases (n is an integer equal to or larger than 3) is applied to respective electrodes to generate a progressive wave electric field, efficiency of hopping and carrying can be improved by setting a voltage application duty with a voltage application time per one phase shorter than {repetition period×(n−1)/n}. For example, in the case where a drive signal of three phases is used, the voltage application time ta of each phase has only to be set to less than about 67% equivalent to ⅔ of the repetition period tf. In addition, for example, in the case where a drive signal of four phases is used, a voltage application time for each phase has only to be set to less than 75% equivalent to ¾ of the repetition period.

On the other hand, it is preferable to set the voltage application duty to [repetition period/n] or more. For example, in the case where a drive waveform of three phases is used, it is preferable to set the voltage application time ta of each phase to about 33%, which is equivalent to ⅓ of the repetition period tf, or more. That is, between a voltage applied to an electrode and voltages applied to electrodes adjacent to the electrode on an upstream side and a downstream side in a traveling direction, a time is set, in which the electrode adjacent to the electrode on the upstream side repulses while the electrode adjacent to the electrode on the downstream side attracts, whereby efficiency can be improved. In particular, in the case where a drive frequency is high, the voltage application duty is set in the range of {repetition period/n} or more and less than {repetition period×(n−1)/n} so that an initial velocity for toner on an electrode can be easily obtained.

Next, a description will be made about an example of a behavior of the toner T at the time when a charge pattern for reversal development is placed on the OPC layer 15 and the drive signal Va2, Vb2 and Vc2 of the hopping voltage pattern shown in FIG. 13 are applied to the respective electrodes 102. In the latent image 17 on the OPC layer 15, a portion where no charge for reversal development exists is an image portion 17*a*, and a portion where a charge exists is a non-image portion 17*b*. In reversal development, a portion where no charge for reversal development exists (a portion where no negative charge exists) corresponds to the image portion. Therefore, a negative charge also exists on the outside of the non-image portion 17*b* in FIG. 18, although it is simply not illustrated (this applies to the following figures). A potential of the surface of the OPC layer 15 is about 150 V, and a potential of a surface on the part of the image portion 17*a* in the latent image 17 is about 0 V. Further, a voltage of the hopping voltage pattern applied to the electrode 102 is also set to "−100 V" and "0 V" as shown in FIG. 13.

Figure 18:
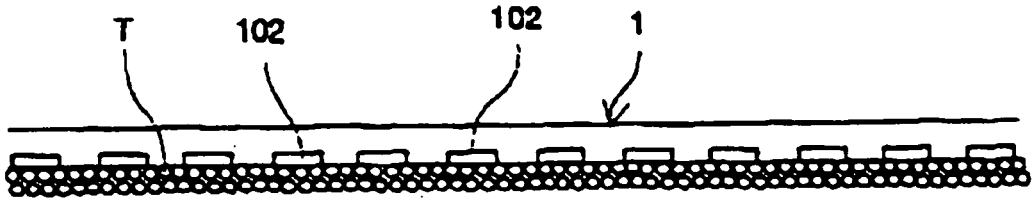
FIG. 18 is a diagram showing toner position immediately before starting developing by applying a drive waveform of a hopping voltage pattern.
Figure 18:
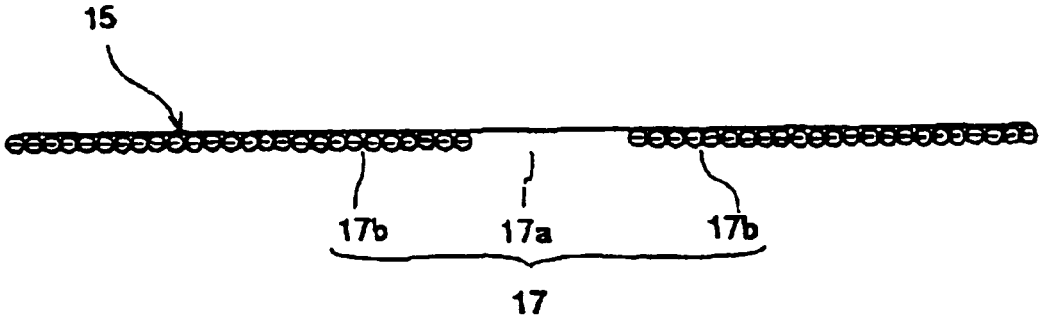
Figure 19:
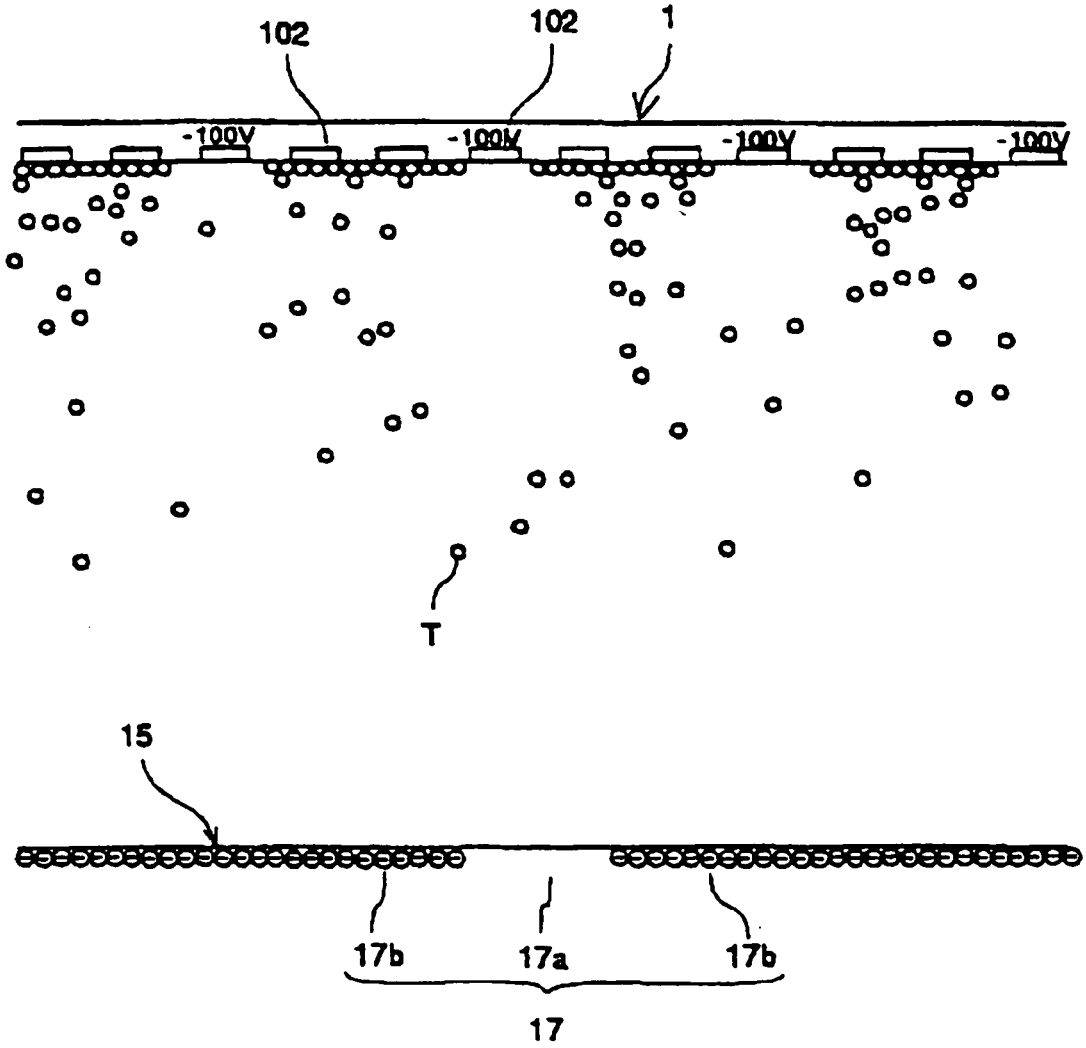
FIG. 19 is a diagram showing a toner position when 100 μsec has elapsed after starting developing by applying the drive waveform of the hopping voltage pattern.

As shown in FIG. 18, at 0 μsec after setting developing, the toner is located on the electrostatic transport substrate 1. FIG. 19 shows a distribution of the toner at a point when 100 μsec has elapsed from the start of application of the voltage pattern. That is, this figure shows that the toner on the electrode (B phase electrode) 102 of −100 V has been hopped upward (downward in the figure) or obliquely to the left and the right.

Figure 20:
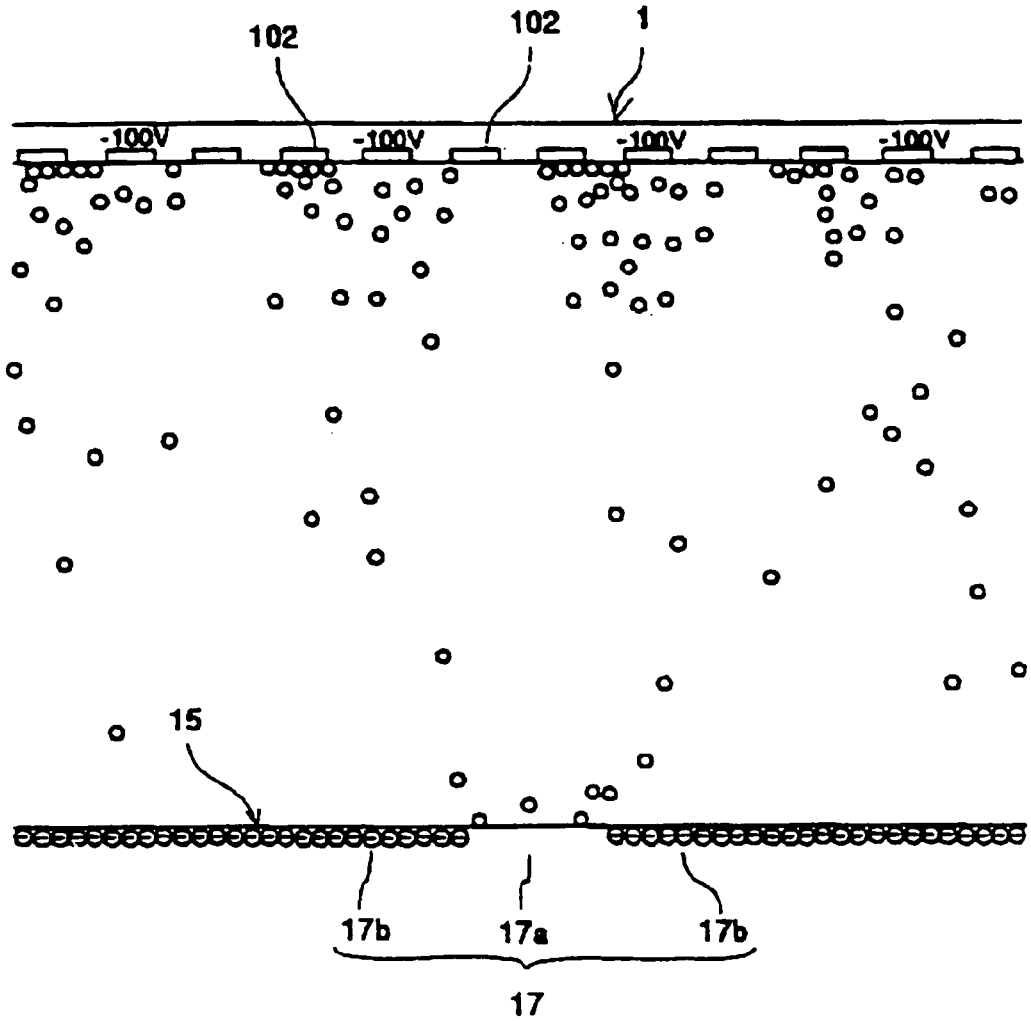
FIG. 20 is a diagram showing a toner position when 200 μsec has elapsed after starting developing by applying the drive waveform of the hopping voltage pattern.

FIG. 20 shows a distribution of the toner after 200 μsec has elapsed from the start of the development. This figure shows that the toner has adhered to the image portion 17*a*, where no charge exists and a potential is 0 V, in the latent image 17 on the OPC layer 15, and reversal development has started. Further, the toner has not reached the OPC layer 15 in the non-image portion 17*b* where a charge exists and a potential is about −150 V. That is, this figure shows that a position of the electrode where a potential is −100 V moves to an adjacent position, and the toner is being hopped anew from the position.

Figure 21:
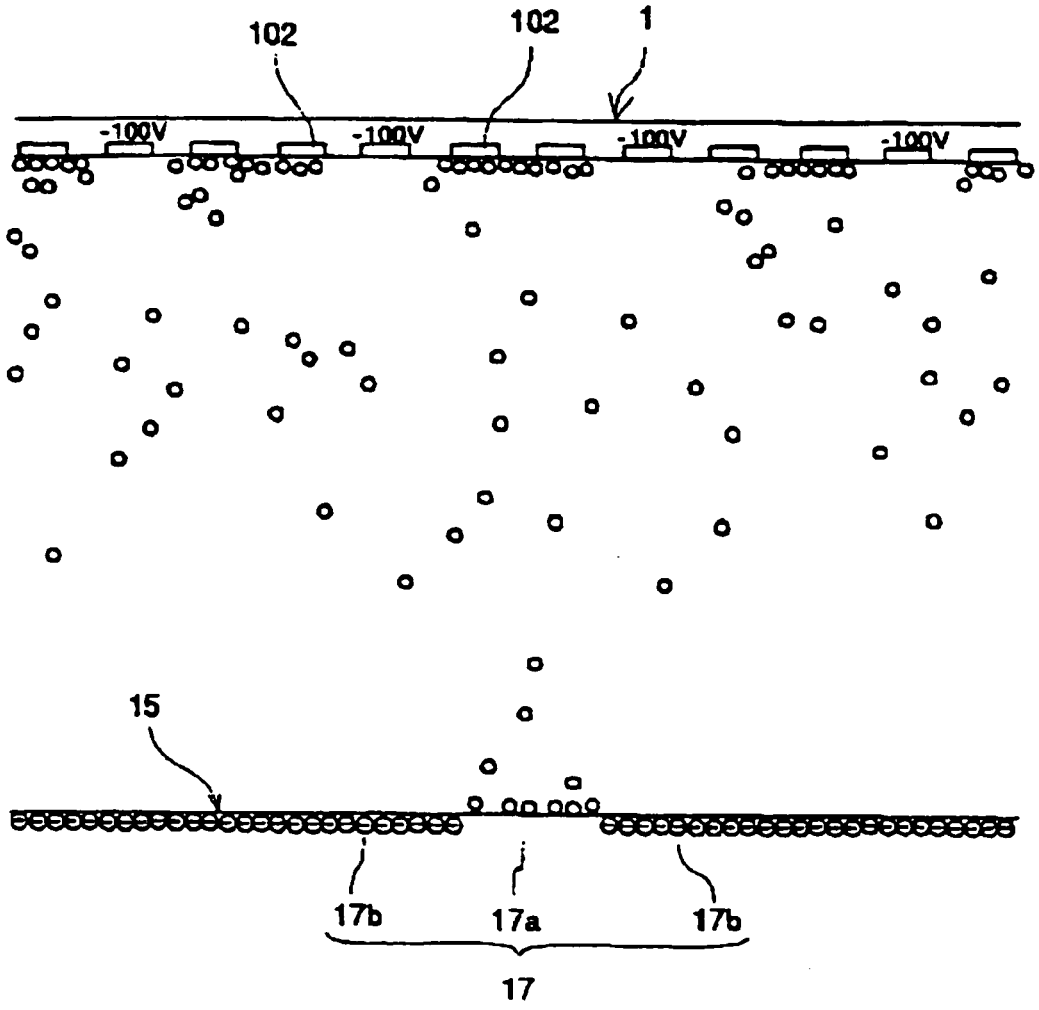
FIG. 21 is a diagram showing a toner position when 300 μsec has elapsed after starting developing by applying the drive waveform of the hopping voltage pattern.

FIG. 21 shows a distribution of the toner after 300 μsec has elapsed from the start of the development. This figure shows that the number of toner particles adhering to the image portion 17*a*, where no charge exists and a potential is 0 V, in the latent image 17 on the OPC layer 15, has increased and the development has advanced. On the other hand, this figure shows that, in the non-image portion 17*b*, the toner, which was hopped first, is returning to the electrostatic transport substrate 1 by a reverse electric field formed between the OPC layer 15 and the electrostatic transport substrate 1.

Figure 22:
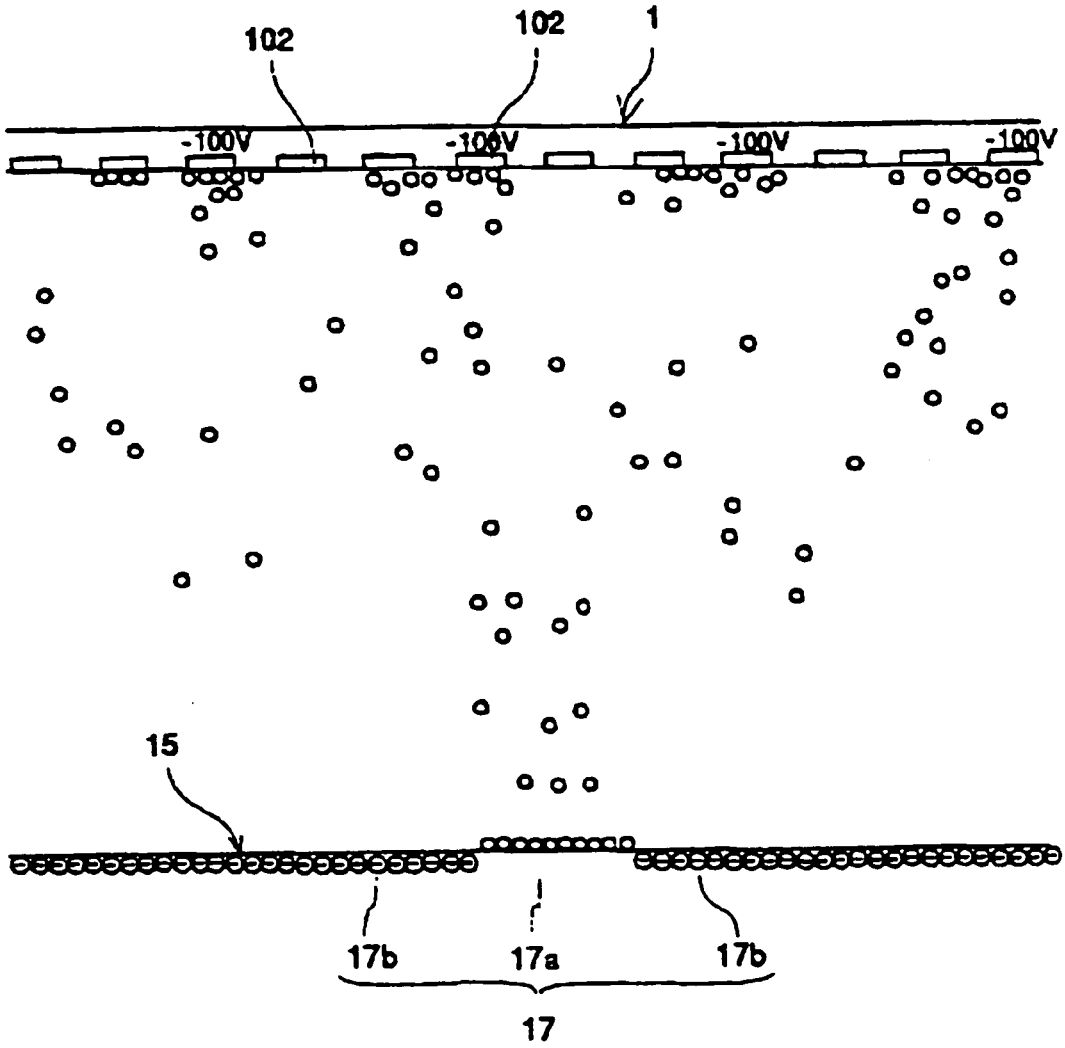
FIG. 22 is a diagram showing a toner position when 500 μsec has elapsed after starting developing by applying the drive waveform of the hopping voltage pattern.

FIG. 22 shows a distribution of the toner after 500 μsec has elapsed from the start of the development. This figure shows that the development has further advanced but there is no toner adhering to the base portion 17*b*.

Figure 23:
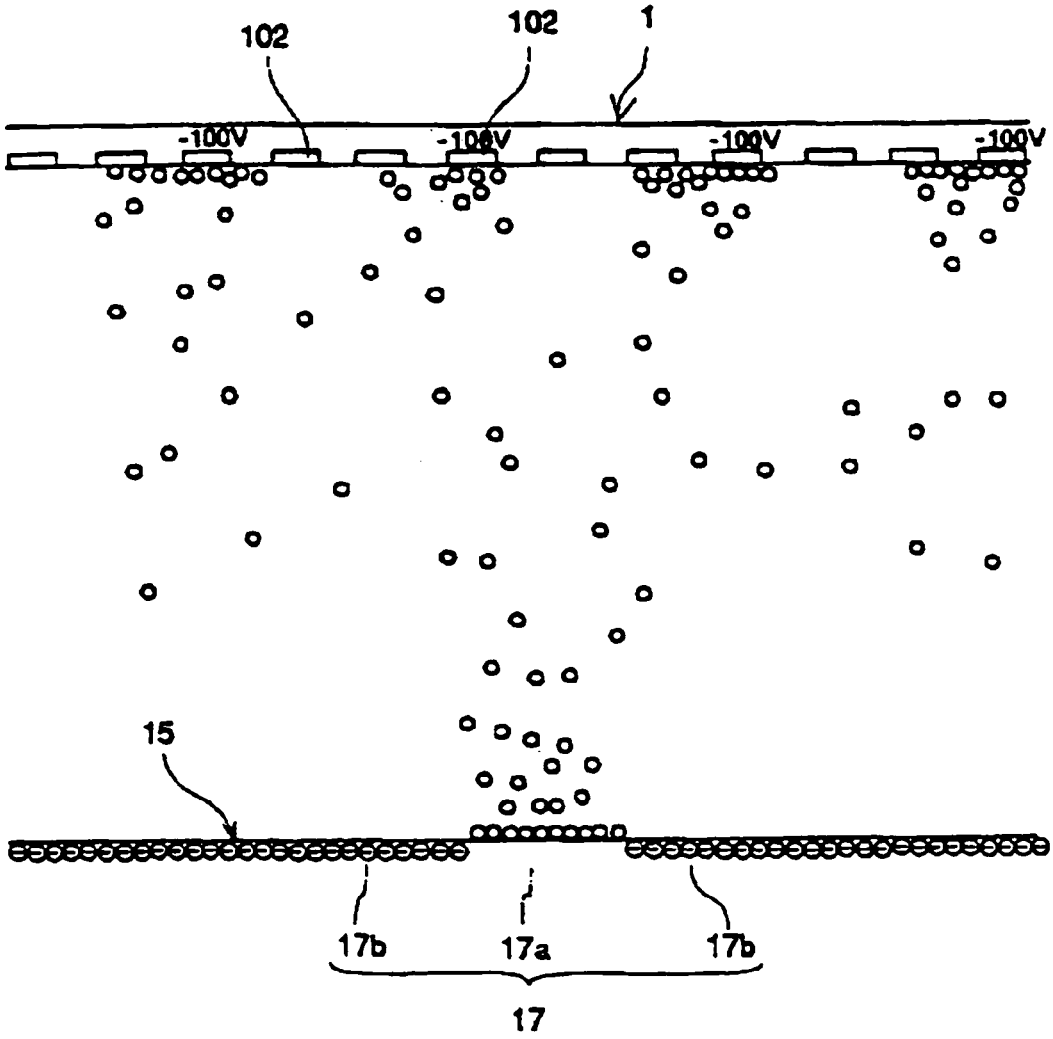
FIG. 23 is a diagram showing a toner position when 1,000 μsec has elapsed after starting developing by applying the drive waveform of the hopping voltage pattern.

FIG. 23 shows a distribution of the toner after 1,000 μsec has elapsed from the start of the development. This figure shows that the development has further advanced but a difference of the development is small.

Figure 24:
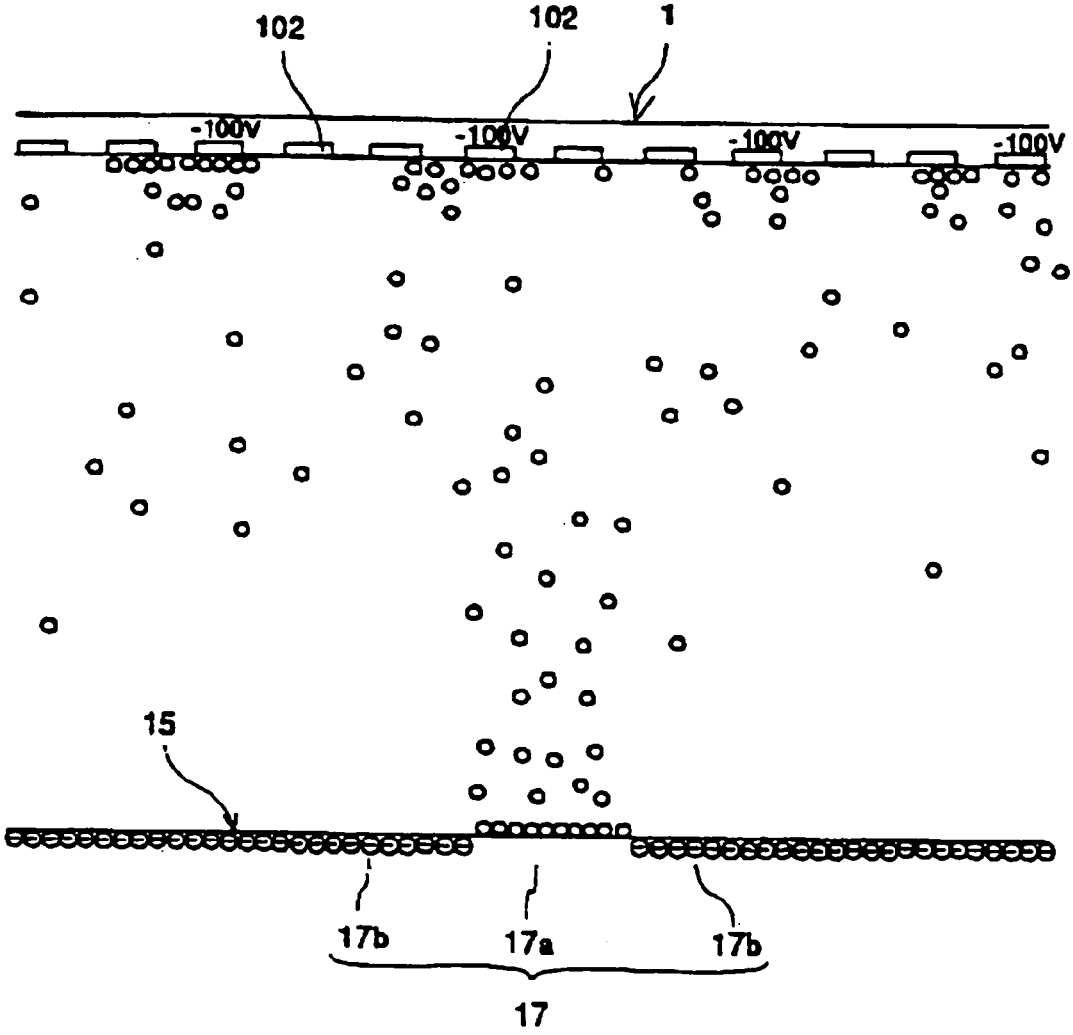
FIG. 24 is a diagram showing a toner position when 1,500 μsec has elapsed after starting developing by applying the drive waveform of the hopping voltage pattern.

FIG. 24 shows a distribution of the toner after 1,500 μsec has elapsed from the start of the development. This figure shows that the number of toner particles adhering to the image portion 17*a* is the same and the development has not advanced, that is, the development has almost saturated at 1 msec after the start of the development.

Figure 25:
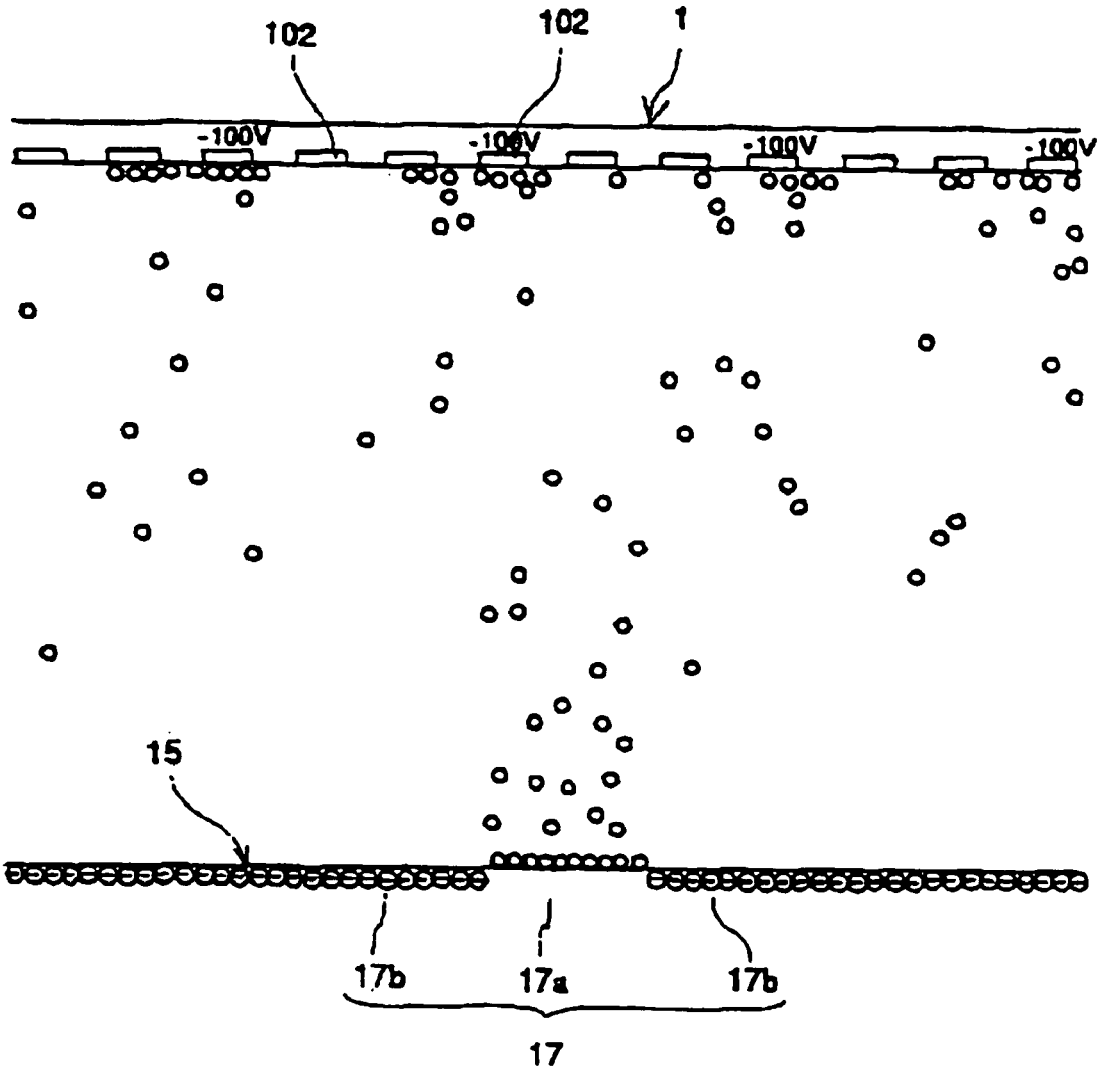
FIG. 25 is a diagram showing a toner position when 2000 μsec has elapsed after starting developing by applying the drive waveform of the hopping voltage pattern.

FIG. 25 shows a distribution of the toner after 20,000 μsec has elapsed from the start of the development. This figure shows that the development has not advanced at all.

As described above, in the ETH development, an electrostatic latent image on a photosensitive member can be subjected to reversal development by hopping the toner. In other words, development can be performed by providing means for forming an electric field in which the toner is directed to a side of a latent image carrying member with respect to an image portion of a latent image and is directed to a side opposite to the latent image carrying member with respect to a non-image portion.

For example, in the case where a drive waveform of a hopping voltage pattern is a pulse-like voltage waveform transitioning in 0 to 100 V as in the drive waveform of the hopping voltage pattern shown in FIG. 13, when a potential of the non-image portion on a latent image carrying member is lower than −100 V, toner is directed to a side of the latent image carrying member with respect to an image portion and is directed to a side opposite to the latent image carrying member with respect to a non-image portion. In this case, when a potential of the non-image portion of the latent image is set to −150 V or −170 V which will be described later, the toner is directed to the side of the latent image carrying member. In addition, in the case where a drive waveform of a hopping voltage pattern is a pulse-like voltage waveform transitioning in 20 V to −80 V, when a potential of the image portion is set to about 0 V and a potential of the non-image portion is set to −110 V, a low level potential of the pulse-like drive waveform is between an image portion potential and a non-image portion potential of the latent image. Thus, similarly, the toner is directed to the side of the image carrying member with respect to the image portion and is directed to a side opposite to the latent image carrying member with respect to the non-image portion. In short, setting the low level potential of the pulse-like drive waveform between the potential of the image portion and the potential of the non-image portion of the latent image can prevent the toner from adhering to the non-image portion so as to perform high-quality development.

As described above, in the ETH development, the toner is being hopped, so that the toner is attracted and adheres to the image portion of the latent image and is repulsed and does not adhere to the non-image portion. Thus, development of the latent image with the toner can be performed. At this point, no attraction force occurs between the toner, which has already been hopped, and the electrostatic transport substrate 1. Therefore, the toner can be transported to the side of the latent image carrying member easily, and development for a high image quality can be performed with a low voltage.

In the conventional so-called jumping development system, in order to peel charged toner from a developing roller and transport the toner to a photosensitive member, an applied voltage equal to or greater than an adhesive force of the toner to the developing roller is required, and a bias voltage of DC 600 to 900 V has to be applied. On the other hand, in the copying machine of the present invention, although an adhesive force of toner is usually 50 to 200 nN, an adhesive force with respect to the electrostatic transport substrate 1 is substantially zero because the toner is hopping on the electrostatic transport substrate 1. Thus, a force for peeling the toner from the electrostatic transport substrate 1 becomes unnecessary, and it becomes possible to transport the toner to the side of the latent image carrying member sufficiently at a low voltage. Moreover, an electric field to be generated has an extremely large value even if the absolute value for a voltage applied between the electrodes 102 is as low as |150 to 100|| V or less, and it becomes possible to easily peel, fly, and hop the toner adhering to the surface of the electrodes 102. In addition, ozone and NOx, which are generated at the time when a photosensitive member such as an OPC is charged, is very little or can be totally eliminated. This is extremely advantageous for environmental problems and durability of the photosensitive member.

Therefore, a high-voltage bias of 500 V to several KV, which is applied between a developing roller and a photosensitive member in order to peel the toner adhering to a developing roller surface or a carrier surface of the conventional system, is not required. Accordingly, it becomes possible to set a charging potential of the photosensitive member to an extremely low value and form and develop a latent image.

For example, in the case where an OPC photosensitive member is used, and the thickness of a charge transport layer (CTL) on a surface thereof is 15 μm, a dielectric constant thereof is 3, and a charge density of charged toner is $-3\times10^{-4}$ $C/m^2$, a surface potential of the OPC photosensitive member is about −170 V. In this case, when a pulse-like drive voltage of 0 to −100 V with a duty of 50% is applied as a voltage to the electrodes of an electrostatic transport substrate, the applied voltage is −50 V on average, and if the toner is negatively charged, an electric field between the electrodes of the transport substrate and the OPC photosensitive member has the above-mentioned relation. If a gap between the transport substrate and the OPC photosensitive member is 0.2 to 0.3 mm, it is possible to perform development satisfactorily. This depends upon Q/M of the toner, the voltage applied to the electrodes of the transport substrate, and a printing speed, that is, a rotation speed of the photosensitive member. In the case of toner of a negative charging property, development can be performed satisfactorily when a potential for charging the photosensitive member is at least −300 V or less or, when the development efficiency takes priority, −100 V or less. A charging potential in the case of a positive charging property is a positive potential.

Incidentally, in the ETH development, an attraction force between the toner and the electrostatic transport substrate 1 is set to 0 to perform development by hopping the toner on the electrostatic transport substrate 1. However, the inventors of the present invention confirmed the fact that , simply by hopping toner on the transport substrate, even if the hopped toner has a characteristic of traveling to the side of a latent image carrying member, it is not guaranteed that the toner adheres to a latent image on the latent image carrying member reliably, and scattering of the toner occurs.

Thus, as a result of devoting their energy on researches on the. ETH development, the inventors of the present invention found conditions under which hopped toner selectively adheres to an image portion of a latent image on a latent image carrying member reliably and does not adhere to a non-image portion, that is, the contamination of the non-image portion does not occur. That is, a relation between a potential (surface potential) of the latent image on the latent image bearing member and a potential to be applied to the transport substrate (electric field to be generated) is set to a predetermined one. In other words, as described above, generated is an electric field in which the toner is directed to the side of a latent image carrying member with respect to the image portion of the latent image on the latent image bearing member and is directed to a carrying substrate side with respect to the non-image portion. Accordingly, the toner adheres to the image portion of the latent image reliably, and the toner directed to the non-image portion is pushed back to the side of the transport substrate. Thus, the toner hopped from the transport substrate is utilized for development efficiently, and scattering of the toner can be prevented and the development in high-quality by driving with low-voltage can be performed.

In this case, an average value of a potential to be applied to the electrodes of the transport substrate (average value potential) is set to a potential between a potential of the image portion of the latent image on the latent image carrying member and a potential of the non-image portion. Accordingly, as described above, an electric field can be generated, in which the toner is directed to the side of a latent image carrying member with respect to the image portion of the latent image and is directed to a side opposite to the latent image carrying member with respect to the non-image portion.

As a result of further devoting their energy on researches on the ETH development, the inventors of the present invention confirmed that, although contamination of the non-image portion should not occur because toner did not adhere to the non-image portion in the ETH development in accordance with the present invention as described above, the contamination could still occur. The inventors performed image formation in the following manner. The above-mentioned electrostatic transport substrate was manufactured, and toner having the same particle diameter and charging amount was used to form a latent image by a laser optical system on a photosensitive member having an OPC layer with a thickness of 15 μm after charging the photosensitive member to a surface potential of −170 V. Then, the electrostatic transport substrate 1 was fixed in a position 0.200 mm apart from the photosensitive member moving or rotating at a peripheral velocity of 200 mm/sec, and the carrying voltage pattern was applied to carry the toner on the electrostatic transport substrate 1 at a velocity equal to the peripheral velocity of the photosensitive member. In addition, the carrying voltage pattern was switched to the hopping voltage pattern only for electrodes in an area with a width of 0.4 mm (this is assumed to be a "developing area"), where the electrostatic transport substrate 1 is closest to the photosensitive member, to subject the latent image to reversal development. Then, the toner image, which was formed on the OPC photosensitive member, was transferred and fixed to a white paper to form a black toner image thereon with a known method.

As a result, it was found that contamination on the non-image portion of the formed image occurs and that the toner adhered inside a copying machine while printing test was repeated for a large number of sheets. Thus, the inventors of the present invention observed motions of the toner in the developing area with a high-speed camera. Then, it was found that toner, which did not contribute to the development (did not adhere to the photosensitive member) and did not return to the transport substrate, was drawn into a current of the air which was generated around the photosensitive member following the movement or rotation of the photosensitive member.

In addition, it was found that the scattered toner increased in the image portion compared with the non-image portion. Further, it was found that, as a charging potential of the OPC layer was increased, scattering of the toner was reduced. Moreover, it was found that, although the scattered toner was increased when the charging amount of the toner is decreased in the conventional development system, in-the ETH development system, conversely, the scattered toner was reduced when the charging amount of toner was low.

From these findings, it was confirmed that, as shown in FIGS. 23 to 25, toner floating immediately above (below) the image portion, in which a current of the air following the rotation of the photosensitive member was the strongest, was drawn into the current of the air of the rotation of the photosensitive member and scattered.

It is conceived that the following toner occurred a built up on the image portion because no force acted on the toner in the air. This means that, since an electric field attracting toner of a negative charging property to the image portion was originally formed in the vicinity of the image portion, this electric field disappeared or weakened so that the following toner was not attracted to the image portion. As described above, the charge density of the OPC layer is $-3.0\times10^{-4}$ c/mm$^2$. However, when 1.5 mg of the toner charged to −20 μc/g gathers in 1 cm$^2$, a charging density of the toner changes to $-3.0\times10^{-4}$ C/mm$^2$.

Actually, even in the saturation development, toner of 1.5 mg does not gather in 1 cm$^2$. However, if the toner of about half that quantity exists in 1 cm$^2$, it is possible to assume that a potential difference of the non-image portion and the image portion is reduced to half and the electric field is also reduced to half, and the build-up of the toner starts. This is the case in which a charge distribution is assumed to be uniform. When a coulomb repulsion force between toner particles is taken into account, it can be also assumed that one following toner particle is repulsed by plural preceding adhered toner particles and cannot move ahead to the latent image carrying member.

Thus, it is advisable to provide means for generating an electric field which pulls back the toner to the side of the electrostatic transport substrate 1 in an area following the developing area. For example, as described above, the collecting area 13 is provided in the electrostatic transport substrate 1, and the drive signals Va1, Vb1 and Vc1 of the collecting and carrying voltage pattern are applied to the electrodes 102 in this collection area 13 from the drive circuit 2. In other words, the drive waveforms of the carrying voltage pattern to be applied to the electrodes 102 of the carrying area 11 are directly used as drive waveform of the collecting and carrying voltage pattern to be applied to the electrodes 102 of the collection area 13. In this way, the electric field of a direction, in which the toner is directed toward a side opposite to the latent image carrying member, is formed in the area following the developing area so that the floating toner can be collected in the electrostatic transport substrate 1. As a result, it becomes possible to reuse the toner.

This will be described in more detail. As described above with reference to FIGS. 18 to 25, the charge pattern for reversal development was placed on the OPC layer 15, and the drive signals Va2, Vb2, and Vc2 of the hopping voltage pattern shown in FIG. 13 were applied to the respective electrodes 102 to perform development. Then, the drive signals Va1, Vb1, and Vc1 of the collecting and carrying voltage pattern shown in FIG. 11 were applied to the respective electrodes 102. An example of a behavior of the toner T in this case will be described with reference to FIGS. 26 to 30 in order.

Figure 26:
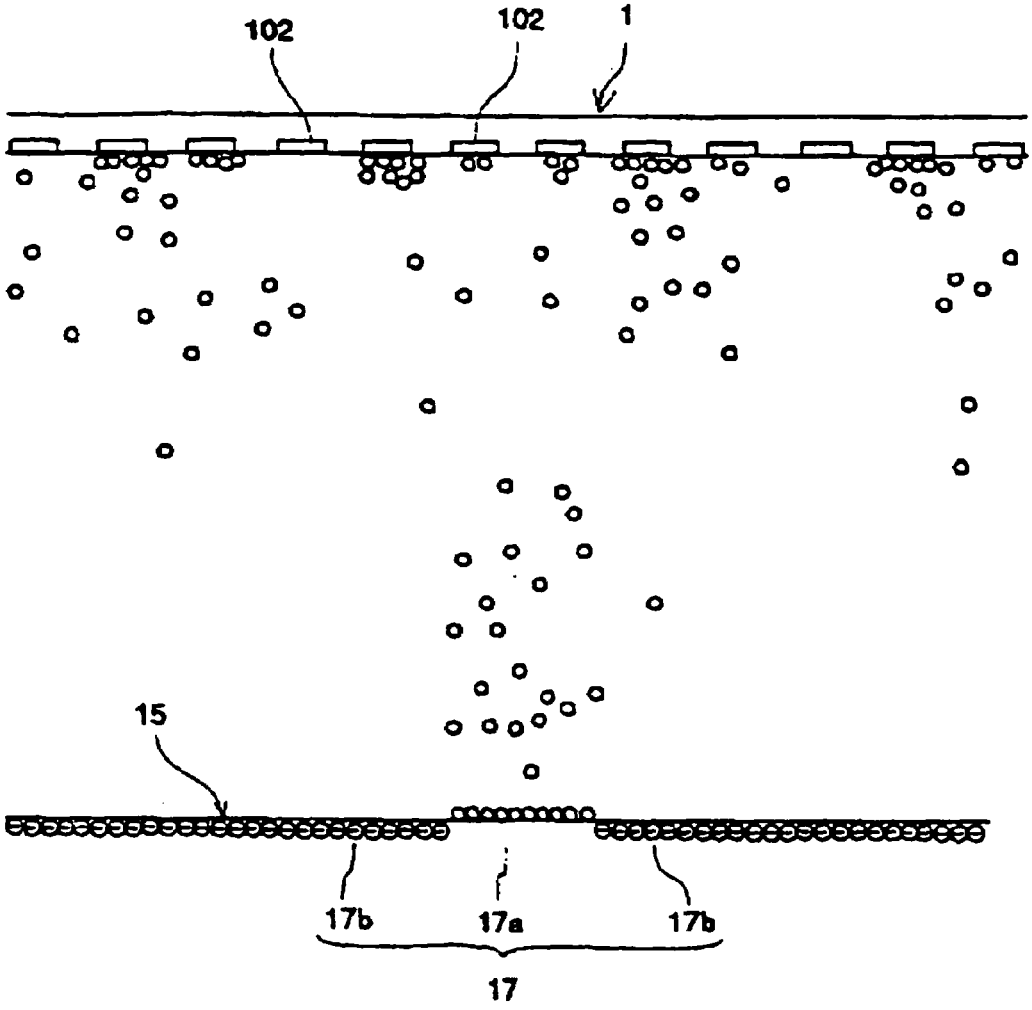
FIG. 26 is a diagram showing a toner position when 100 μsec has elapsed after applying the drive waveform of the collecting and carrying voltage pattern at the end of the development.

First, FIG. 26 shows a distribution of toner after 100 μsec has elapsed after a voltage to be applied to the respective electrodes 102 is switched to the drive signals Va1, Vb1, and Vc1 of the collecting and carrying voltage pattern. As is shown in this figure, toner floating over (actually, below) the image portion 17*a* is started to be attracted to the side of the electrostatic transport substrate 1. In addition, not only the toner over the image portion 17*a* but also toner, which are originally in the air on the electrostatic transport substrate 1 corresponding to the non-image portion 17*b*, is started to be attracted to the side of the electrostatic transport substrate 1.

Figure 27:
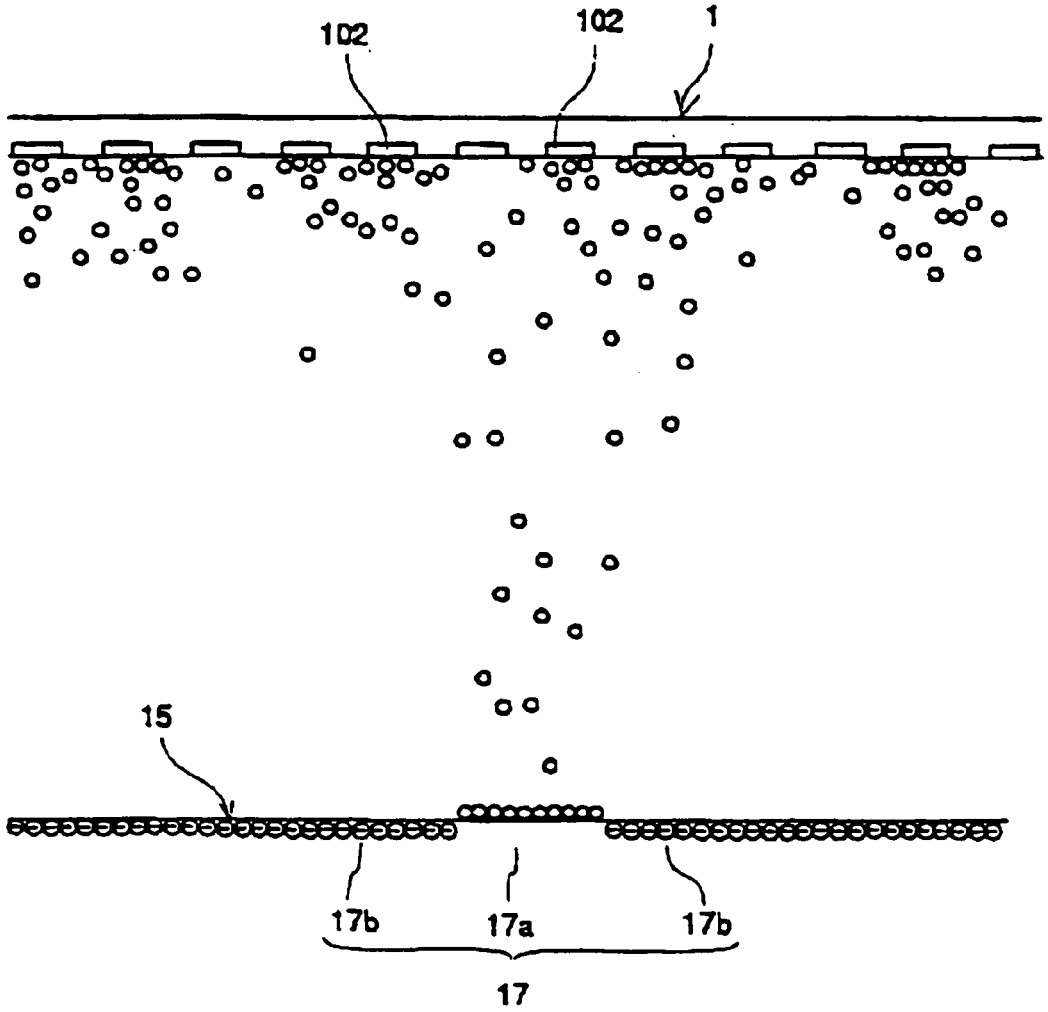
FIG. 27 is a diagram showing a toner position when 200 μsec has elapsed after applying the drive waveform of the collecting and carrying voltage pattern at the end of the development.

FIG. 27 shows a distribution of the toner after 200 μsec has elapsed from the switching. As shown in this figure, the toner is further attracted to the side of the electrostatic transport substrate 1 in both the image portion 17*a* and the non-image portion 17*b*.

Figure 28:
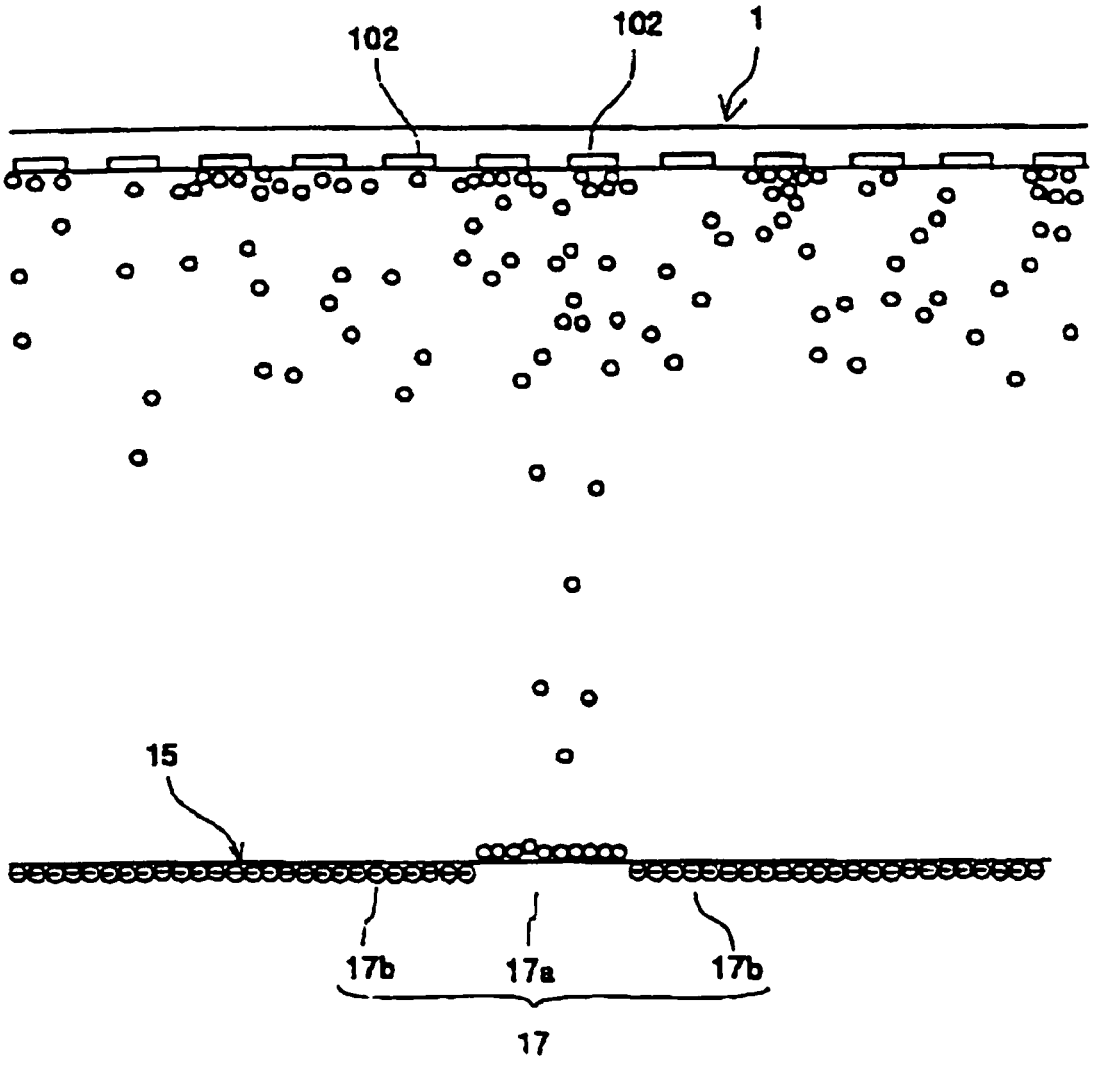
FIG. 28 is a diagram showing a toner position when 400 μsec has elapsed after applying the drive waveform of the collecting and carrying voltage pattern at the end of the development.

FIG. 28 shows a distribution of the toner after 400 μsec has elapsed from the switching. It is seen that the collection of the toner, which was floating in a part corresponding to the image portion 17*a*, to the side of the electrostatic transport substrate 1 is further advanced. However, in a part corresponding to the non-image portion 17*b*, since there is toner hopped anew, a slightly larger amount of toner is collected.

Figure 29:
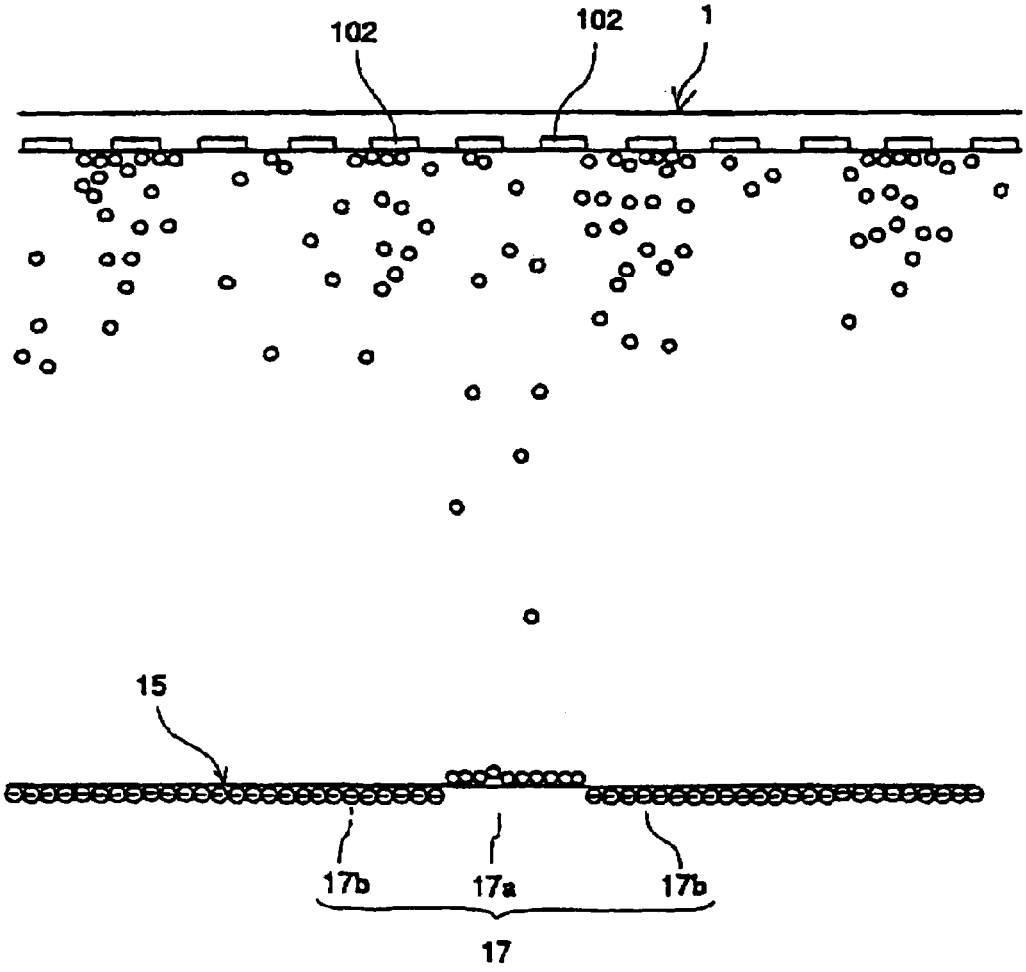
FIG. 29 is a diagram showing a toner position when 700 μsec has elapsed after applying the drive waveform of the collecting and carrying voltage pattern at the end of the development.

FIG. 29 shows a distribution of the toner after 700 μsec has elapsed from the switching. It is seen that toner located at the rear end in the floating toner corresponding to the image portion 17*a* has also advanced to the middle between the image portion 17*a* and the electrostatic transport substrate 1.

Figure 30:
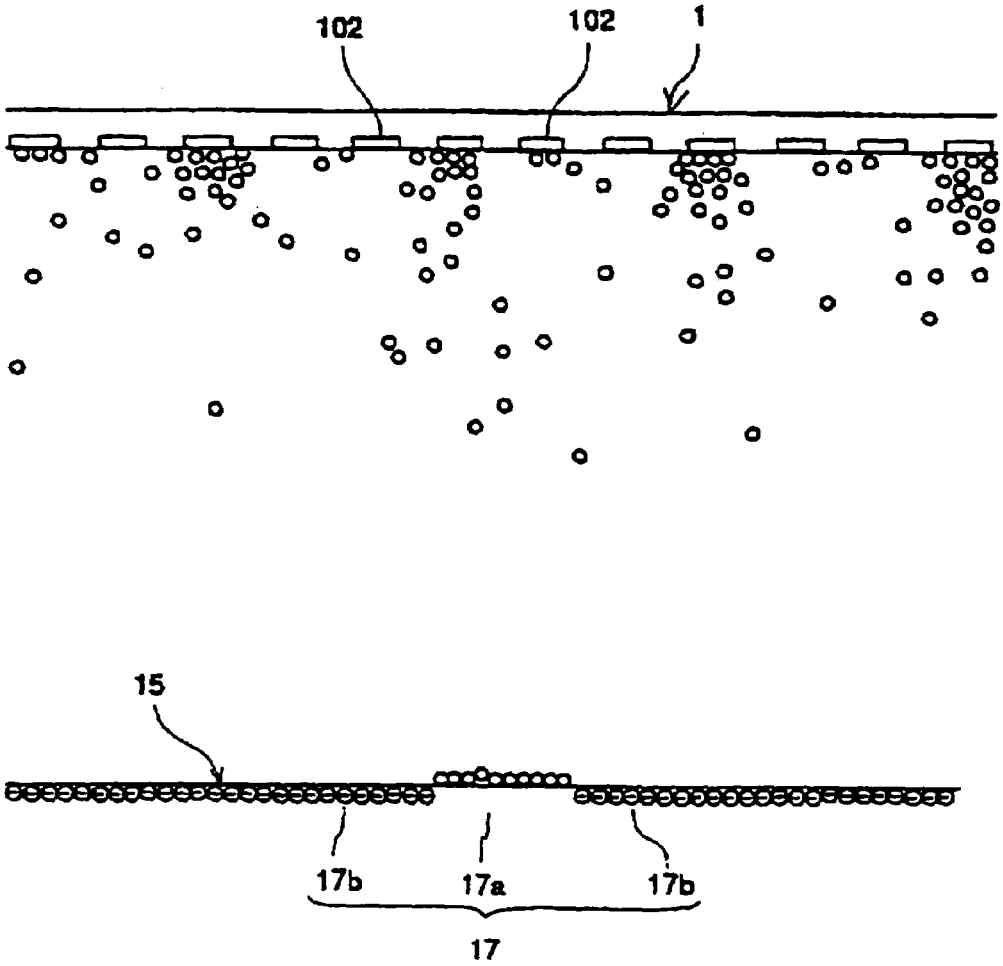
FIG. 30 is a diagram showing a toner position when 1,000 μsec has elapsed after applying the drive waveform of the collecting and carrying voltage pattern at the end of the development.

FIG. 30 shows a distribution of the toner after 1,000 μsec has elapsed from the switching. It is seen that the toner at the rear end is attracted to the side of the electrostatic transport substrate 1, and no floating toner exists on the OPC layer 15.

In this case, the toner adhering to the image portion 17*a* is not pulled back to the side of the electrostatic transport substrate 1. This is because a strong image force acts between the charged toner and the OPC photosensitive layer serving as a dielectric member. In addition, regardless of presence or absence of toner, a Van der Waals force and a liquid bridging force act between the toner and the OPC layer. Moreover, in the case where an image portion is small, an electrostatic force due to an edge electric field also acts. Since these forces are combined to push the toner to side of the OPC layer, the toner is never pulled back to the side of the electrostatic transport substrate 1 like the floating toner. In addition, since the Van der Waals force and the liquid bridging force do not act on the floating toner and the image force is substantially zero, the floating toner is pulled back to the side of the electrostatic transport substrate 1 side.

However, as described later, as a potential applied to electrodes on the side of the transport substrate is increased, even toner adhering on a photosensitive member is pulled back. Thus, it is preferable that an intensity of an electric field, which is formed after the toner passed the developing area, is in a range in which toner adhering to the latent image carrying member is not peeled from the surface of the latent image carrying member. In this case, it may be better to peel toner with a weak adhesive force. Thus, the intensity of the electric field does not always have to be an intensity which does not allow the toner to be peeled.

In the above-mentioned simulation, the toner on second and higher layers of the image portion 17*a* is totally collected to the side of the electrostatic transport substrate 1. This is because an adhesive force between toner particles is set to zero. Actually, since the Van der Waals force and the liquid bridging force also act between the toner particles, the toner on the second layer adheres to the toner on the first layer and remains. In this way, the means for generating an electric field in which toner is directed to a direction of a side opposite to the side of the latent image carrying member is provided in the area following the developing area so that the generation of the scattered toner can be reduced significantly. In this case, an average value potential of a voltage applied to electrodes of the transport substrate is set to between an image portion potential and a non-image portion potential of the latent image in the developing area so that the ETH development can be performed. Further, when toner of a negative charging property is used, the average value potential is set to a potential higher than both the image portion potential and the non-image portion potential of the latent image in the area following the developing area (collecting area). In addition, when toner of a positive charging property is used, the average value potential is set to a potential lower than both the image portion potential and the non-image portion potential of the latent image in the area following the developing area. As a result, the floating toner can be collected to the side of the transport substrate.

An example of the waveform amplifiers 23*a* to 23*c* (these are denoted by reference numeral "23") for generating the drive signals of the hopping voltage pattern shown in FIG. 13 will be described with reference to FIG. 31. As described above, the drive signals of the hopping voltage pattern shown in FIG. 13 are a pulse waveforms, in which each phase is 0 to −100 V, and is a waveform in which time of a relatively positive potential (time of 0 V) is 67% duty. However, the description will be made using a waveform in which time of a relatively positive potential (time of 0 V) is 33% duty.

Figure 31:
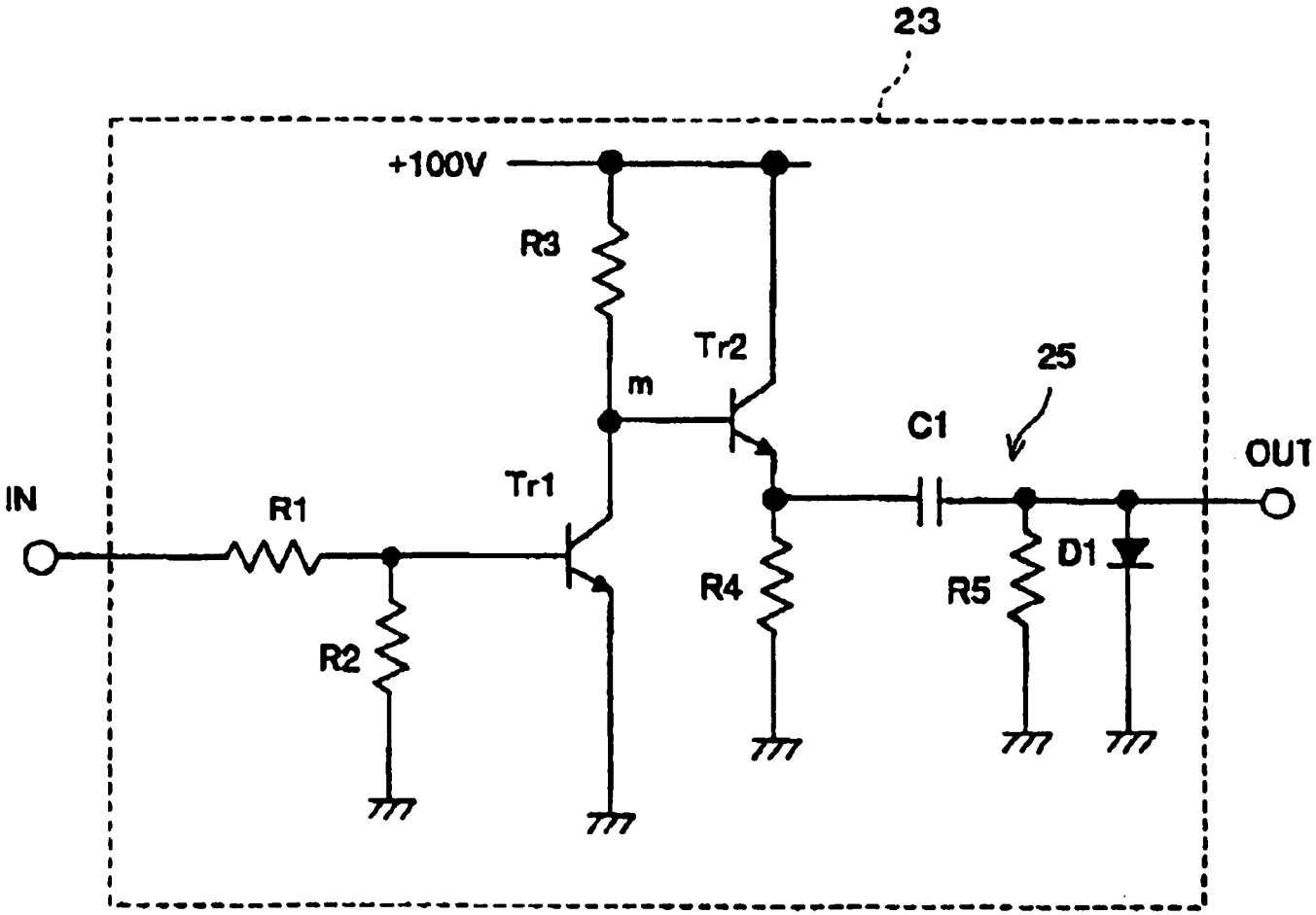
FIG. 31 is a diagram showing an example of a structure of a waveform amplifier for the hopping voltage pattern.
Figure 32:
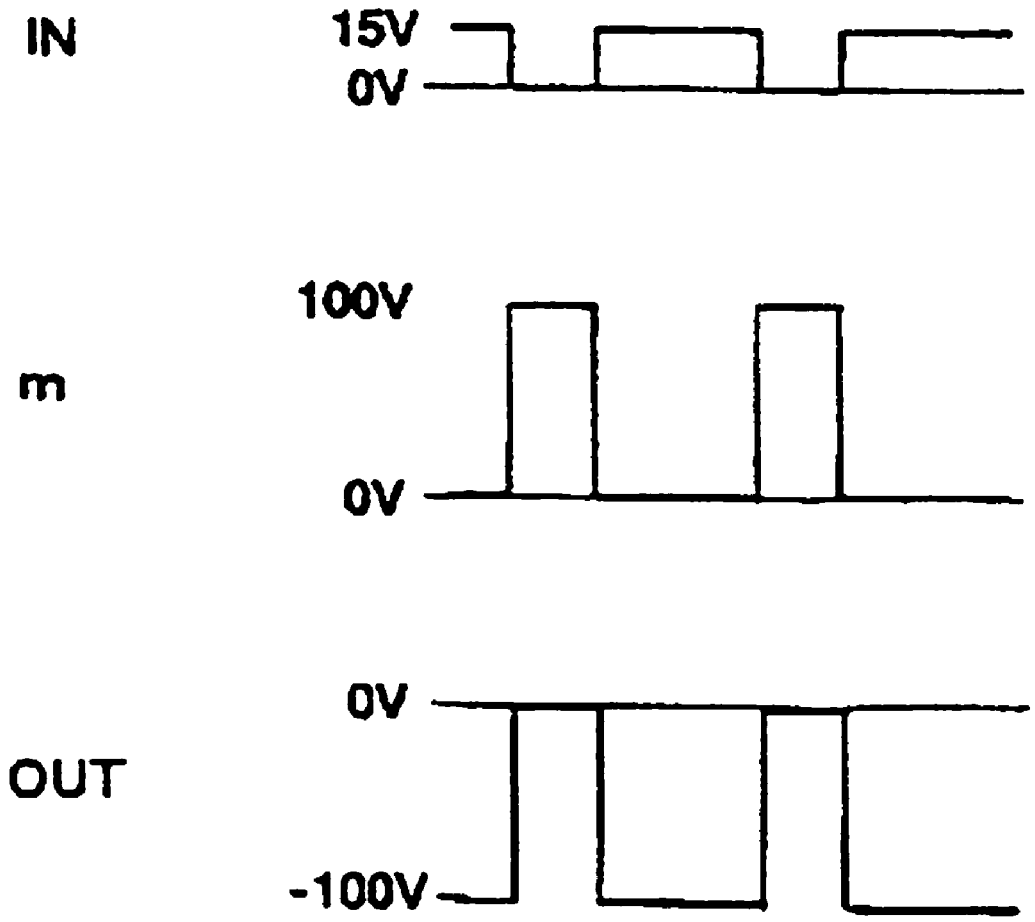
FIG. 32 is a diagram showing a waveform of a signal at respective portions of the waveform amplifier.

As shown in FIG. 31, the waveform amplifier 23 includes resistors R1 and R2 for dividing a voltage of an inputted signal, a transistor Tr1 for switching, a collector resistor R3, a transistor Tr2, a current limit resistor R4, and a clamp circuit 25 including a capacitor C1, a resistor R5, and a diode D1. It is assumed that, for example, an input signal IN with a voltage of 15 V, duty of about 67% and a waveform about 0 to 15V is applied to this waveform amplifier 23 from the pulse generation circuit 21, as shown in FIG. 32. Then, this input voltage signal IN is divided in the resistors R1 and R2 to be inputted to a base of the transistor Tr1. As the transistor Tr1 performs switching operation, a phase of the input signal IN is reversed. Further, a voltage waveform (collector voltage) m as shown in FIG. 32 with the voltage increased to 0 to +100 V is obtained.

The transistor Tr2 receives this collector voltage m and outputs a waveform of the same level at a low impedance. In the clamp circuit 25 connected to an emitter of this transistor Tr2, a time constant is small with respect to a positive waveform and depends upon the capacitor C1 and the resistor R5 with respect to a negative waveform. This time constant is set to a sufficiently large value with respect to a period of a pulse. Accordingly, as shown in FIG. 32, an output waveform OUT of 0 to −100 V with the 0 level clamped is obtained from the clamp circuit 25.

Next, an example of the waveform amplifiers 22*a* to 22*c* (these are denoted by reference numeral "22") for generating the drive signals of the collecting and carrying voltage pattern shown in FIG. 11 will be described with reference to FIG. 33. The drive signals of the collecting and carrying voltage pattern shown in FIG. 11 is pulse waveforms, in which each phase is 0 to +100 V, and is a waveform in which time of a relatively positive potential (time of +100 V) is 33% duty.

Figure 33:
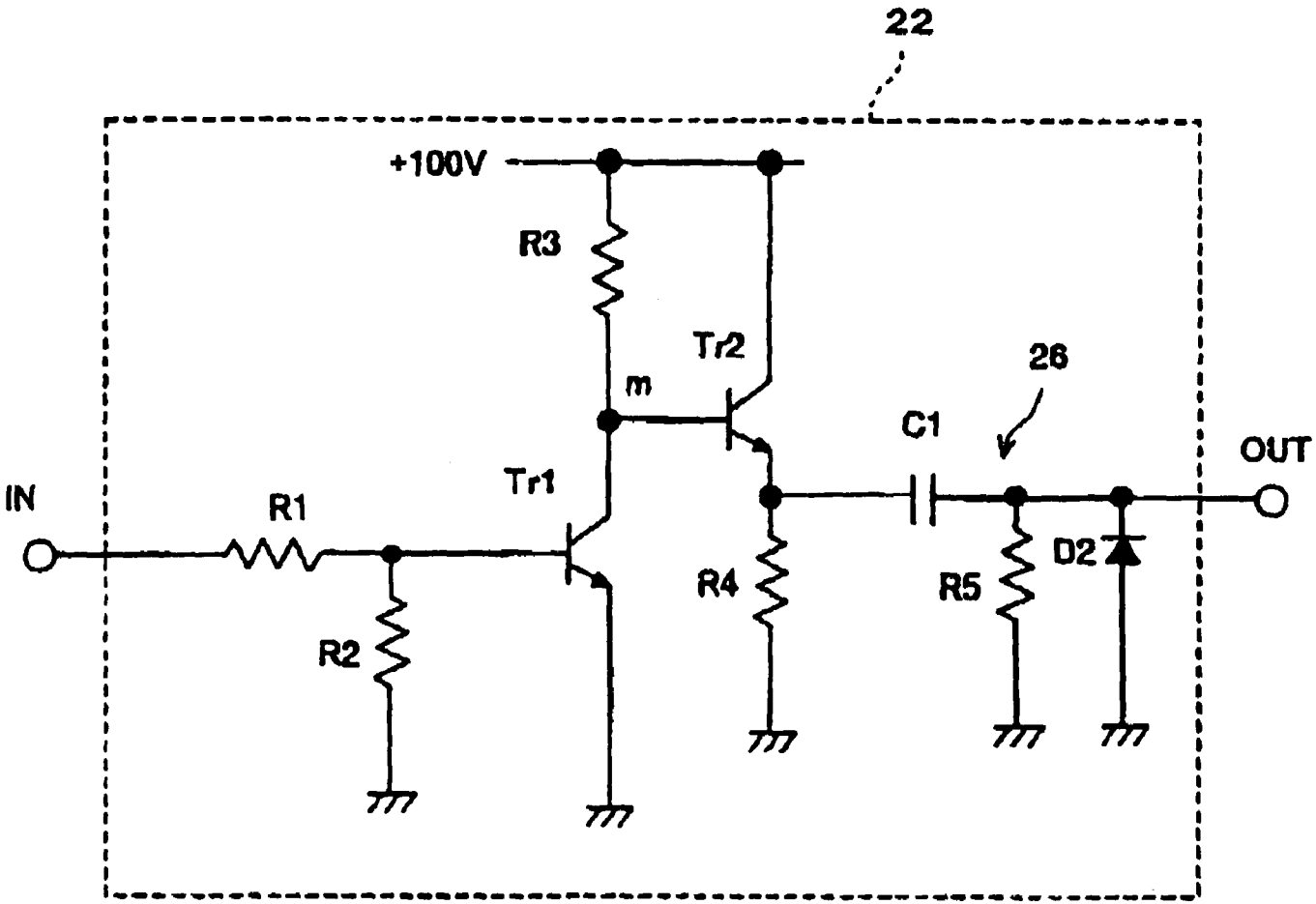
FIG. 33 is a diagram showing an example of a structure of a waveform amplifier for the collecting and carrying voltage pattern and the carrying voltage pattern.

As shown in FIG. 33, the waveform amplifier 22 includes resistors R1 and R2 for dividing a voltage of an input signal, a transistor Tr1 for switching, a collector resistor R3, a transistor Tr2, a current limit resistor R4, and a clamp circuit 26 including a capacitor C1, a resistor R5, and a diode D2. That is, only directions of the diode D1 of the clamp circuit 25 of the waveform amplifier 23 and the diode D2 of the clamp circuit 26 of the waveform amplifier 22 are different.

Figure 34:
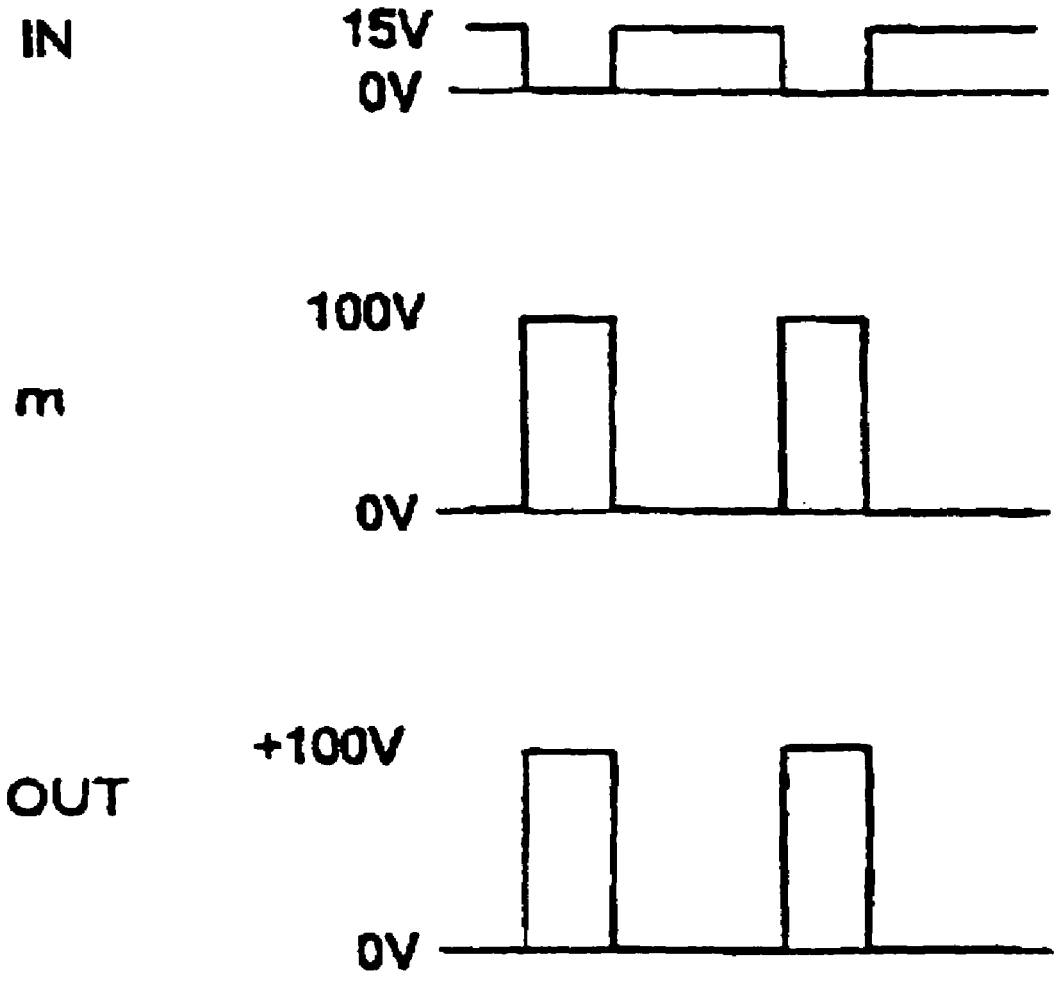
FIG. 34 is a diagram showing a waveform of a signal at respective portions of the waveform amplifier.

It is assumed that, for example, an input signal IN with a voltage of 15 V, duty of about 67% and a waveform of 0 to 15V is applied to this waveform amplifier 22 from the pulse generation circuit 21 as shown in FIG. 34. Then, this input voltage signal IN is divided in the resistors R1 and R2 to be inputted to a base of the transistor Tr1. As the transistor Tr1 performs switching operation, a phase of the input signal IN is reversed. Further, a voltage waveform (collector voltage) m as shown in FIG. 34 with the voltage increased to 0 to +100 V is obtained.

The transistor Tr2 receives this collector voltage m and outputs a waveform of the same level at a low impedance. In the clamp circuit 26 connected to an emitter of this transistor Tr2, a time constant is small with respect to a negative waveform and depends upon the capacitor C1 and the resistor R5 with respect to a positive waveform. This time constant is set to a sufficiently large value with respect to a period of a pulse. Accordingly, as shown in FIG. 34, an output waveform OUT of 0 to +100 V with the 0 level clamped is obtained from the clamp circuit 26.

In this way, drive waveforms to be applied to respective electrodes of the transport substrate are produced by a clamp circuit which includes a capacitor, a resistor, and a diode. Thus, a stable waveform with a fixed peak value and without drift is obtained by a simple circuit structure and by clamping a low level side. Thus, accurate carrying and hopping of toner becomes possible.

Next, a relation between a charge polarity of toner and a voltage (potential) to be applied to the electrodes 102 of the electrostatic transport substrate 1 will be described. In the case where toner of negative charging property is used, a voltage is set to 0 to −V1 in the developing area and is set to 0 to +V2 in the area following the developing area. In other words, a voltage of a drive waveform for hopping is set to 0 to −V. In addition, a voltage of a drive waveform for collection and carrying is set to 0 to +V. Accordingly, as described above, a structure of the drive circuit is simplified, and reliability is improved. Similarly, in the case where toner of a positive charging property is used, a voltage is set to 0 to +V3 in the developing area and is set to 0 to −V4 in the area following the development area. In other words, a voltage of the drive waveform for hopping is set to 0 to +V. In addition, a voltage of the drive waveform for collection and carrying is set to 0 to −V. Accordingly, as described above, a structure of the drive circuit is simplified, and reliability is improved. The voltages V1, V2, V3 and V4 may be voltages of the same absolute value or voltages of different absolute values.

Next, a width (electrode width) L, an electrode interval R of the plural electrodes 102 and a surface protective layer 103 of the electrostatic transport substrate 1 for performing carrying and hopping of toner will be described.

The electrode width L and the electrode interval R in the electrostatic transport substrate 1 affect carrying efficiency and hopping efficiency of the toner significantly. Toner existing between electrodes is moved to an adjacent electrode on a surface of the transport substrate by an electric field substantially in the horizontal direction. On the other hand, toner on an electrode often flies apart from a substrate surface because an initial velocity having at least a component in the vertical direction is given. In particular, since toner existing near an electrode end moves over an adjacent electrode, in the case where the electrode width L is large, the number of toner particles on the electrode increases, the number of toner particles having a large moving distance increases, and carrying efficiency is improved. However, if the electrode width L is too large, since an electric field intensity in the vicinity of an electrode center falls, the toner adheres to the electrode, so that carrying efficiency falls. Thus, as a result of devoting their energy on researches, the inventors of the present invention found that there is a proper electrode width for carrying and hopping fine particles efficiently at a low voltage.

In addition, the electrode interval R determines an electric field intensity between electrodes from a relation between a distance and an applied voltage. Naturally, the narrower the interval R, the stronger the electric field intensity, and an initial velocity of carrying and hopping is obtained more easily. However, concerning toner moving from one electrode to another electrode, a moving distance in one movement is reduced, and moving efficiency is not improved unless a drive frequency is increased. As a result of devoting their energy on researches, the inventors of the present invention found that there is a proper electrode interval for carrying and hopping fine particles efficiently at a low voltage.

Moreover, the inventors of the present invention also found that the thickness of a surface protective layer covering the electrode surface also affects the electric field intensity, and in particular affects an electric line of force of a vertical direction component and determines efficiency of hopping.

Thus, by property setting a relation among the electrode width, the electrode interval, and the thickness of the surface protective layer of the transport substrate, the problem of toner adsorption on the electrode surface can be solved, and efficient movement can be performed at a low voltage.

More specifically, first, the electrode width L is a size for carrying and hopping at least one toner particle when it is set to the same size as toner diameter (powder diameter). When the electrode width L is smaller than this size, an electric field acting on the toner is reduced, a carrying force and a flying force of the substrate decreases and becomes insufficient for practical use. In addition, as the electrode width L becoming larger, in particular, in the vicinity of a center of an upper surface of an electrode, an electric line of force inclines in a traveling direction (horizontal direction), an area, in which an electric field in the vertical direction is weak, is generated, and a force generated by hopping is reduced. If the electrode width L is too large, in an extreme case, an image force and a Van der Waals force according to a charge of the toner and an adsorption force by moisture or the like over come the force generated by hopping. Then, it is likely that deposition of the toner occurs.

Further, regarding the efficiency of carrying and hopping, if the electrode width is wide enough for carrying twenty toner particles thereon, adsorption hardly occurs, and efficient operations of carrying and hopping are possible with a drive waveform of a low voltage of about 100 V. If the electrode width L is larger than that, there is formed an area in which attraction occurs partially. For example, if an average particle diameter of the toner is assumed to be 5 μm, the electrode width L corresponds to a range from 5 μm to 100 μm. A more preferable range is two times or more to ten times or less of an average particle diameter of fine particles in order to drive an applied voltage with a drive waveform efficiently at a low voltage of 100 V or less. By setting the electrode width L in this range, a decrease in the electric field intensity in the vicinity of the center of the electrode surface is controlled to ⅓ or less, and a decrease in efficiency of hopping is controlled to 10% or less so as to prevent a significant decrease in the efficiency.

For example, if the average particle diameter of the toner is set to 5 μm, this is equivalent to the range of 10 μm to 50 μm. More preferably, this is in the range of two times or more to six times or less of the average particle diameter of the toner. For example, if the average particle diameter of the toner is set to 5 μm, this is a range equivalent to 10 μm to 30 μm. It is found that, by setting the electrode width L in this range, carrying and hopping efficiency is extremely improved.

Figure 35:
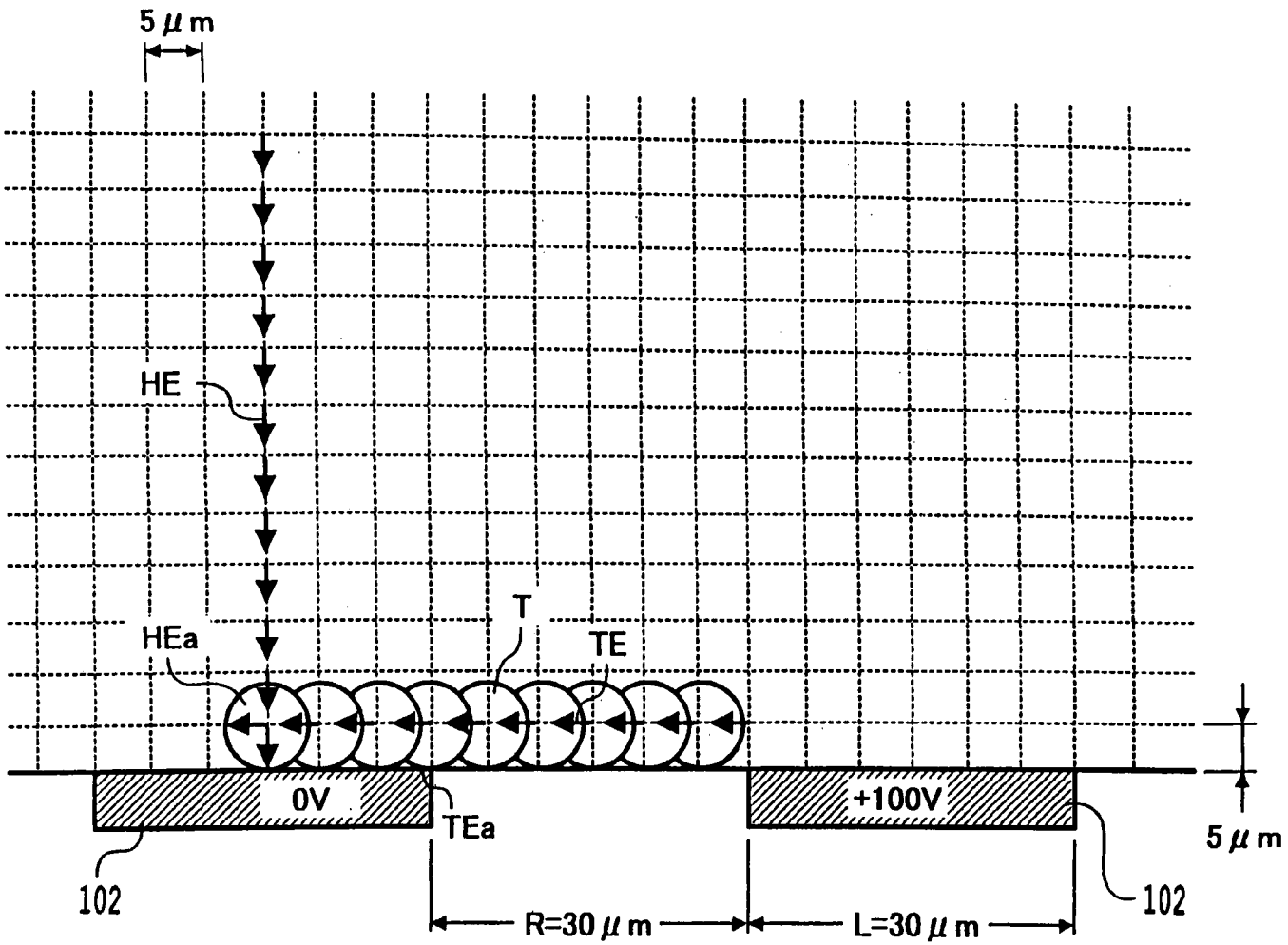
FIG. 35 is a diagram for explaining electrode width and interval on an electrostatic transport substrate.
Figure 36:
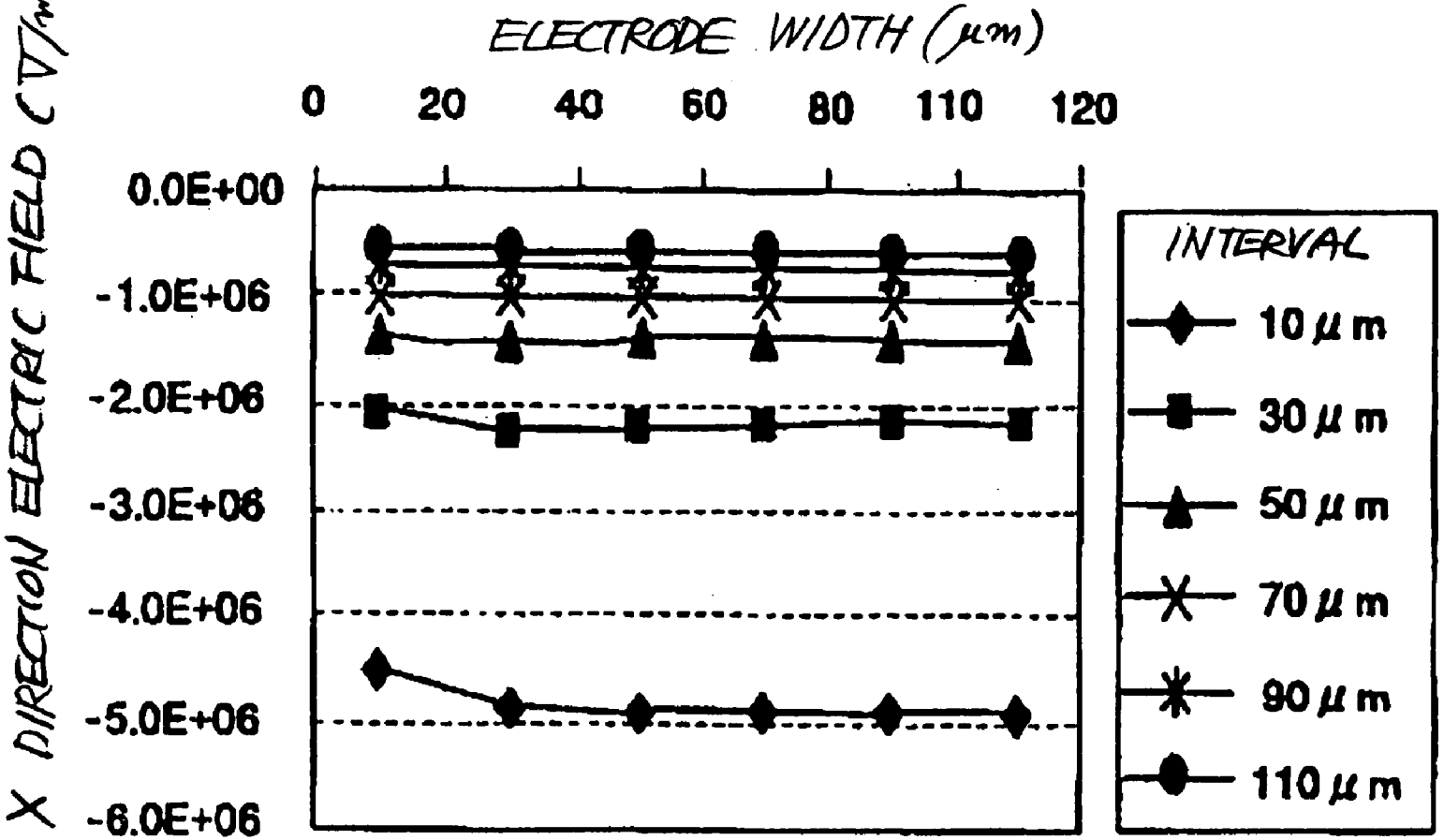
FIG. 36 is a diagram showing an example of a relation between an electrode width and an electric field in the X direction.
Figure 37:
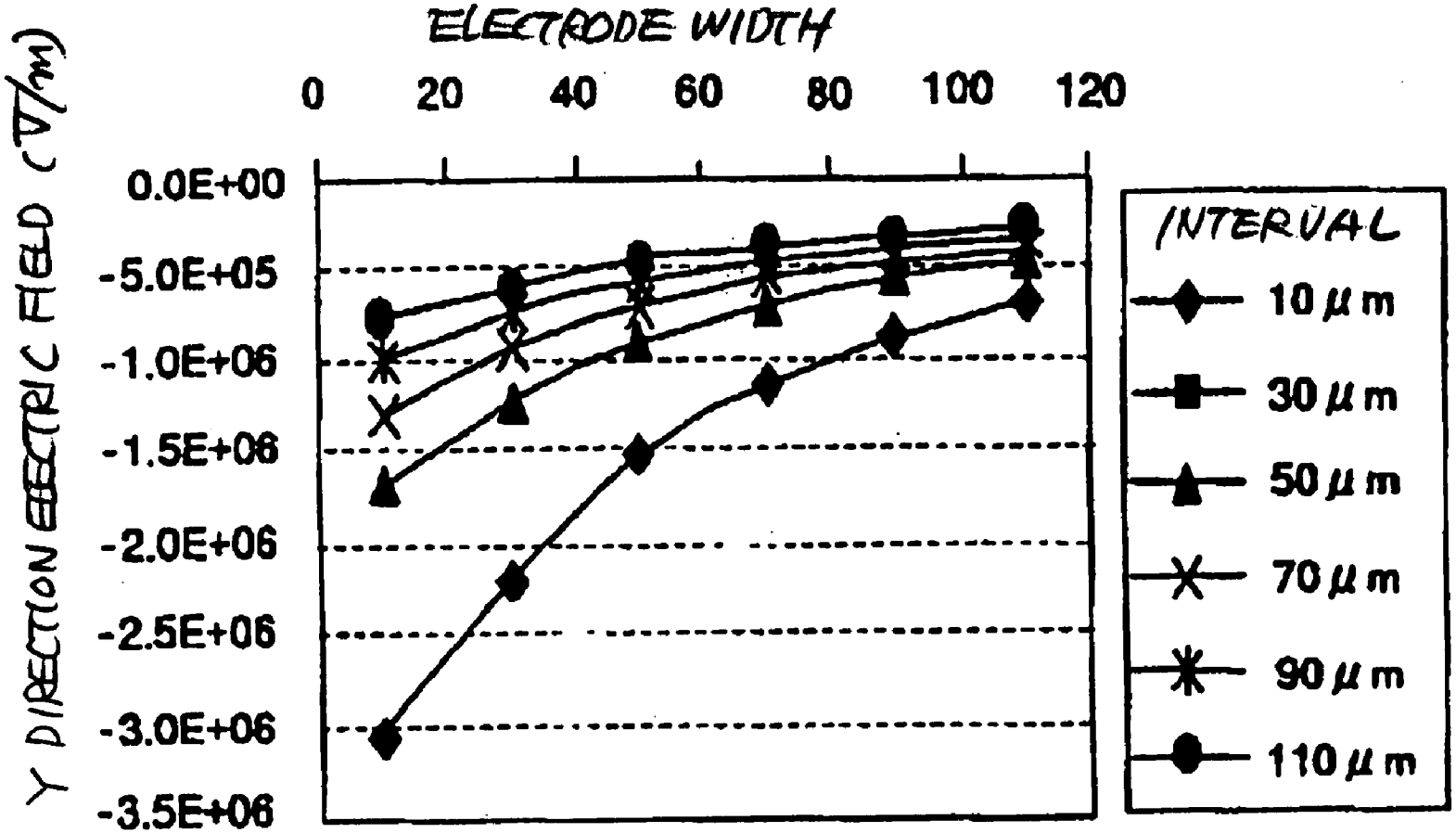
FIG. 37 is a diagram showing an example of a relation between the electrode width and an electric field in the Y direction.

FIGS. 36 and 37 shows a result of setting the width (electrode width) L, the electrode interval R, the thickness of the electrodes 102, the thickness of the surface protecting layer 103 of the electrodes 102 on the electrostatic transport substrate 1 to 30 μm, 30 μm, 5 μm, and 0.1 μm, respectively, as shown in FIG. 35, applying +100 V and 0 V to the adjacent two electrodes 102 and 102, respectively, and measuring intensities of the carrying electric field TE and the hopping electric field HE with respect to the electrode width L and the electrode interval R. Each evaluation data is a result of a simulation and an actual measurement, and actual measurement and evaluation on behaviors of particles by a high-speed video. The two electrodes 102 are shown in FIG. 35 for ease of understanding details. However, an actual simulation and an experiment are evaluated for an area having a sufficient number of electrodes as described above. In addition, a particle diameter of the toner T is 8 μm, and a charging amount thereof is −20 μC/g.

It is assumed that the intensities of the electric fields shown in FIGS. 36 and 37 are values of representative points of the electrode surface, and a representative point TEa of the carrying electric field TE is a point 5 μm above an electrode end shown in FIG. 35. In addition, a representative point HEa of the hopping electric field HE is a point 5 μm above the central part of the electrode shown in FIG. 35. Further, these representative points correspond to representative points, where electric fields acting on the toner in the X direction and the Y direction are the strongest, respectively.

From FIGS. 36 and 37, it is understood that an electric field, which can give a force acting on carrying and hopping of toner, is (5E+5) V/m or more. In addition, it is seen that a preferable electric field without a problem of attraction is (1E+6) V/m or more. Moreover, it is understood that a more preferable electric field, which can give a sufficient force, is (2E+6) V/m or more.

Since an electric field intensity decreases as the electrode interval R increases, as a value corresponding to the range of the electric field intensity, as described above, the electrode interval R is one time or more to twenty times or less of the average particle diameter of the toner. More preferably, the electrode interval R is two times or more to ten times or less of the average particle diameter. Even more preferably, the electrode interval R is two times or more and six times or less of the average particle diameter.

In addition, it is seen from FIG. 37 that the efficiency of hopping decreases as the electrode interval R increases but practical hopping efficiency is obtained when the electrode interval R is twenty times or less of the average particle diameter of the toner. When the electrode interval R exceeds twenty times of the average particle diameter of the toner, an attraction force of a lot of toner particles cannot be neglected, and there are toner particles in which hopping does not occur at all. Accordingly, it is also necessary to set the electrode interval R to twenty times or less of the average particle diameter of the toner.

As described above, the electric field intensity in the Y direction depends upon the electrode width L and the electrode interval R, and the electric field intensity is higher as the electrode width L and the electrode interval R are smaller. In addition, the electric field intensity in the X direction in a position closer to the electrode end also depends upon the electrode interval R, and the electric field intensity is higher as the electrode interval R is smaller. Further, the width of the electrode in a toner traveling direction is set to one time or more and twenty times or less of the average particle diameter of the toner, and the interval of the electrode in the toner traveling direction is set to one time or more and twenty times or less of the average particle diameter of fine particles. Thus, it is possible to cause an electrostatic force sufficient for carrying and hopping a charged toner, which is on an electrode or between electrodes, to act on the toner overcoming an image force, a Van der Waals force, and other attraction forces thereof. Then, build-up of the toner is prevented, and the toner can be efficiently carried and hopped in a stable manner at a low voltage.

According to the researches made by the inventors of the present invention, carrying and hopping by the above-mentioned electrode structure could be performed efficiently, in particular, when a charging amount of toner is −3 to −40 μC/g, more preferably, −10 to −30 μC/g in the case in which an average particle diameter of the toner is 2 to 10 μm and Q/m is a negative charge, and a charging amount of the toner is +3 to +40 μC/g, more preferably, +10 to +30 μC/g in the case of a positive charge.

Next, the surface protective layer 103 will be described.

Figure 38:
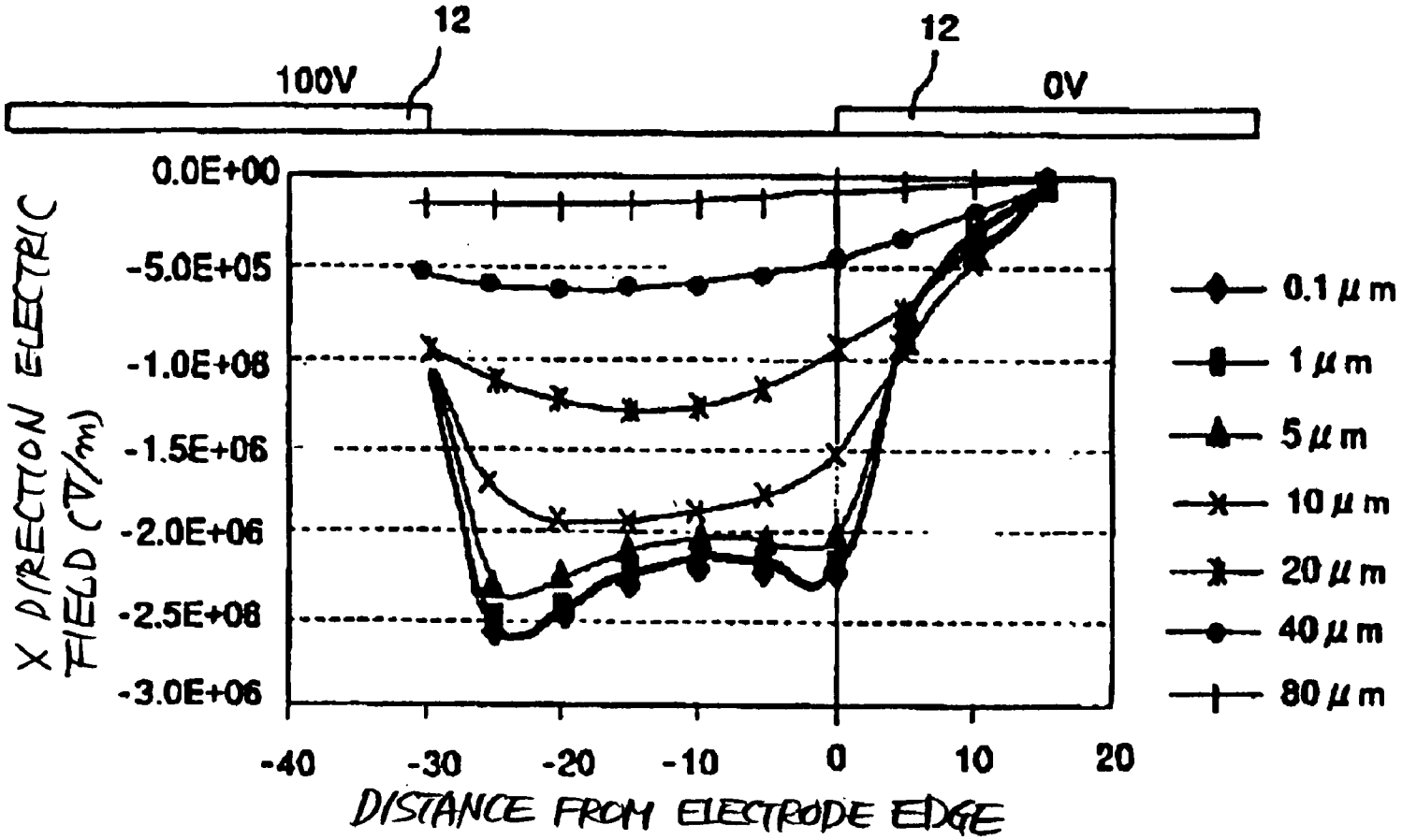
FIG. 38 is a diagram showing an example of a relation between a film thickness of a surface protective layer and an electric field intensity.

By providing the surface protective layer, there is no contamination of electrodes, no adhesion of particulates, or the like, an electrode surface can be maintained with conditions preferable for carrying, creepage leakage in a high humidity environment can be avoided, there is no variation of Q/m, and a charging amount of powders can be maintained stably. FIG. 38 shows a result of finding an electric field intensity in the X direction as a calucuated value, at the time when the thickness of the surface protective layer is changed in the range of 0.1 to 80 μm in the structure of FIG. 35. A dielectric constant ∈ of this surface protective layer 103 is a value higher than that of the air, and usually, ∈ is equal to or higher than 2. As is apparent from this figure, if thickness of this surface protective layer (thickness from the electrode surface) is too large, an electric field intensity acting on the toner on the surface decreases. Thus, when carrying efficiency, an anti-temperature and humidity environment, and the like are taken into account, practically available thickness of the surface protective layer regardless of decrease in efficiency for a carrying operation is 10 μm or less with which efficiency decreases 30%, more preferably, 5 μm or less with which a decrease in efficiency can be controlled to several %.

Figure 39:
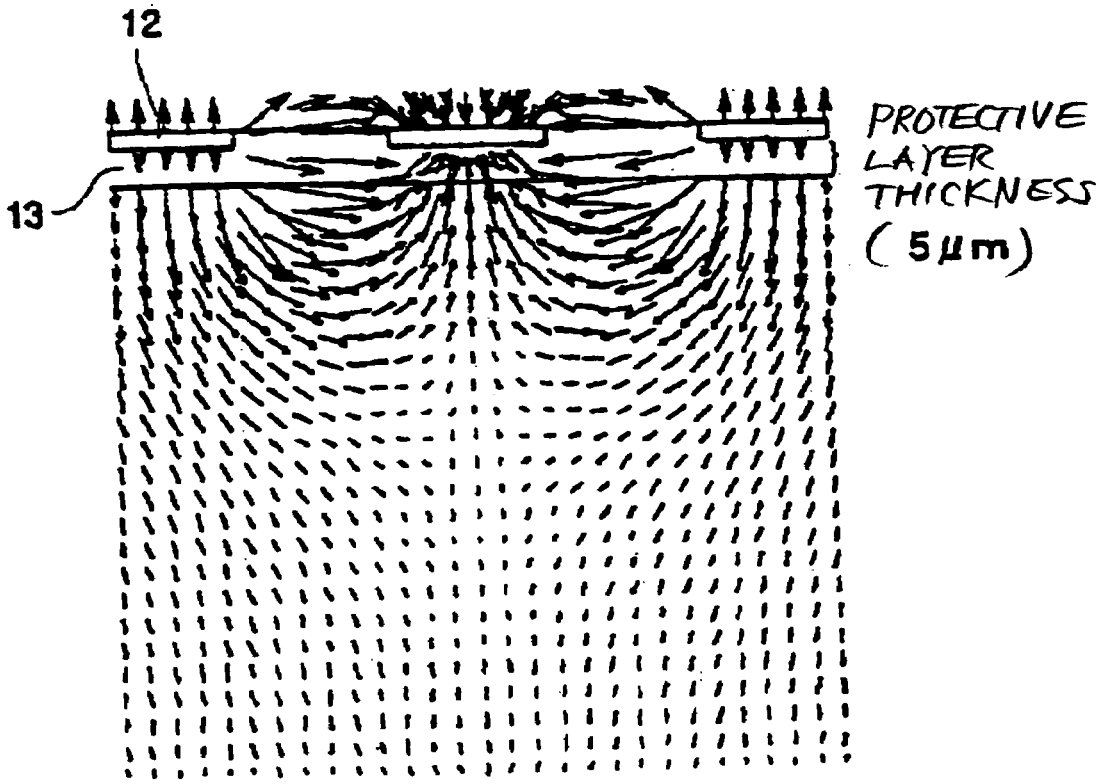
FIGS. 39 and 40 are diagrams showing a relation between the film thickness of the surface protective layer and the electric field intensity.
Figure 40:
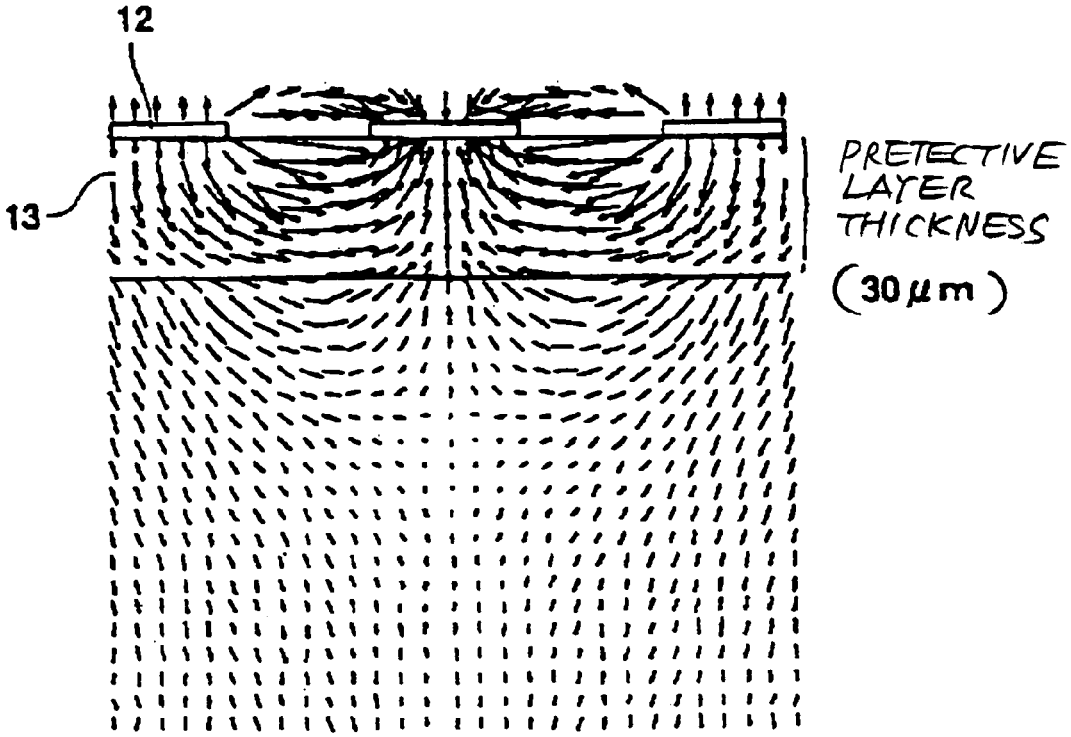

FIGS. 39 and 40 show examples of an electric field intensity acting on hopping on the electrode surface. FIG. 39 shows an example in which thickness of the surface protective layer is set to 5 μm, and FIG. 40 is an example in which thickness of the surface protective layer is set to 30 μm. In both the examples, an electrode width is set to 30 μm, an electrode interval is set to 30 μm, and applied voltages are set to 0 V and 100 V. As is apparent from these figures, when the thickness of the surface protective layer increases, an electric field directed from the surface protective layer having a dielectric constant higher than the air to a direction of an adjacent electrode increases. Thus, a vertical direction component of the surface decreases, and an electric field intensity acting on the toner on the surface decreases by the thickness of the surface protective layer. In other words, an electric line of force of a vertical direction component acting on hopping largely depends upon the thickness of the surface protective layer. An electric field, which can give a force efficiently acting on hopping at a low voltage of about 100 V, is (1E+6) V/m or more as a preferable electric field without involving the problem of attraction, and is in the range of (2E+6) V/m or more as a more preferable electric field which can give a sufficient force. Thickness of the surface protective layer for this purpose is 10 μm or less, more preferably 5 μm or less. It is preferable to use a material with a specific resistance of 10*E6 Ωcm or more and a dielectric constant ∈ of 2 or more as a material for the surface protective layer.

In this way, the surface protective layer covering the electrode surface is provided, and thickness of the surface protective layer is set to 10 μm or less so that it is possible to cause, in particular, an electric field of the vertical direction component to act on powders and increase efficiency of hopping. In addition, concerning a relation with a charging potential of a latent image carrying member, in the case of toner of a negative charging property, the charging potential of the surface of the latent image carrying member is set to −300 V or less, and in the case of toner of a positive charging property, the charging potential of the surface of the latent image carrying member is set to +300 V or less. In other words, the charging potential of the surface of the latent image carrying member is set to |300| V or less.

Accordingly, as described above, when a pitch of electrodes is reduced, an electric field to be generated has an extremely large value even if a voltage to be applied between the electrodes 102 is a low voltage of 150 to 100 V or less. Therefor, it becomes possible to easily peel, fly, and hop the toner adhering to the surface of the electrodes 102. In addition, ozone and NOx, which are generated at the time when a photosensitive member such as an OPC is charged, is very little or can be totally eliminated. This is extremely advantageous for environmental problems and durability of the photosensitive member.

Next, a relation between a charging polarity of toner to be moved and a material for an outermost layer of the surface protective layer will be described. In this case, when the surface protective layer is formed of a single layer, the outermost layer corresponds to the surface protective layer, and when the surface protective layer is formed of plural layers, the outermost layer corresponds to a layer forming a surface with which powders come into contact.

As a resin material occupying 80% or more of the toner, taking into account a melting temperature, clarity about a color, and the like, in general, styrene-acrylic copolymer, polyester resin, epoxy resin, polyol resin, or the like is used. The charging property of the toner is affected by these materials, and a charging control agent is added for the purpose of actively controlling a charging amount. As a charging control agent for a black toner (BK), in the case of positive charging, for example, a nigrosine dye or quaternary ammonium salts is used, and in the case of negative charging, for example, azo metal-containing complex or salicylic metal complex is used. In addition, as a charging control agent for a color toner, in the case of positive charging, for example, quaternary ammonium salts or imidazole complex is used, and in the case of negative charging, for example, salicylic metal complex or salts or organic boron salts is used.

On the other hand, since these toners repeat contact with and peeling from the surface protective layer according to an operation of carrying or hopping on the electrostatic transport substrate by a phase shift electric field (progressive wave electric field), the toners are affected by frictional charging. An amount and polarity of the charging depend upon charging series among materials. In this case, efficiency for carrying, hopping, and photosensitive member development can be improved by maintaining the charging amount of the toner at a saturated charging amount determined mainly by the charging control agent or at a charging amount slight lower than the saturated charging amount. Thus, in the case in which the charging polarity of the toner is negative, it is preferable to use a material in the neighborhood of a material used as the charging control agent of the toner on frictional charging series (in the case in which carrying and hopping areas are small) as a material of a layer forming at least an uppermost layer of the surface protective layer. Alternatively, the material may be a material on a positive end side. For example, in the case in which the charging control agent is salicylic metal complex, polyamide in the neighborhood of the salicylic metal complex is preferable. For example, polyamide (nylon: product name) 66, nylon (product name) 11, or the like is used.

In addition, in the case in which the charging polarity of the toner is positive, as a material of a layer forming at least an uppermost surface of the surface protective layer, a material in the neighborhood of a material used as the charging control agent for the toner on frictional charging series (in the case in which carrying and hopping areas are small) is preferable. Alternatively, it is preferable to use a material on a negative end side. For example, in the case in which the charging control agent is quaternary ammonium salts, it is advisable to use a material in the neighborhood of quaternary ammonium salts or a Teflon (registered trademark) material such as a fluorine material.

Next, the thickness of the electrodes 102 will be described.

In the case where the surface protective layer with a thickness of several μm covering the electrode surface is formed as described above, unevenness occurs on the carrying substrate surface corresponding to an area where electrodes exist below the surface protective layer and an area where electrodes do not exist below the surface protective layer. In this case, by forming the electrodes into thin films each having a thickness of 3 μm or less, fine particles of about 5 μm such as toner can be carried smoothly without the problem of the unevenness on the protective film surface. Therefore, if the electrodes are formed with a thickness of 3 μm or less, the transport substrate having a thin surface protective layer can be put to practical use without requiring planarization treatment or the like of the transport substrate surface, an electric field intensity never falls owing to carrying and hopping, and more efficient carrying and hopping can be performed.

Figure 41:
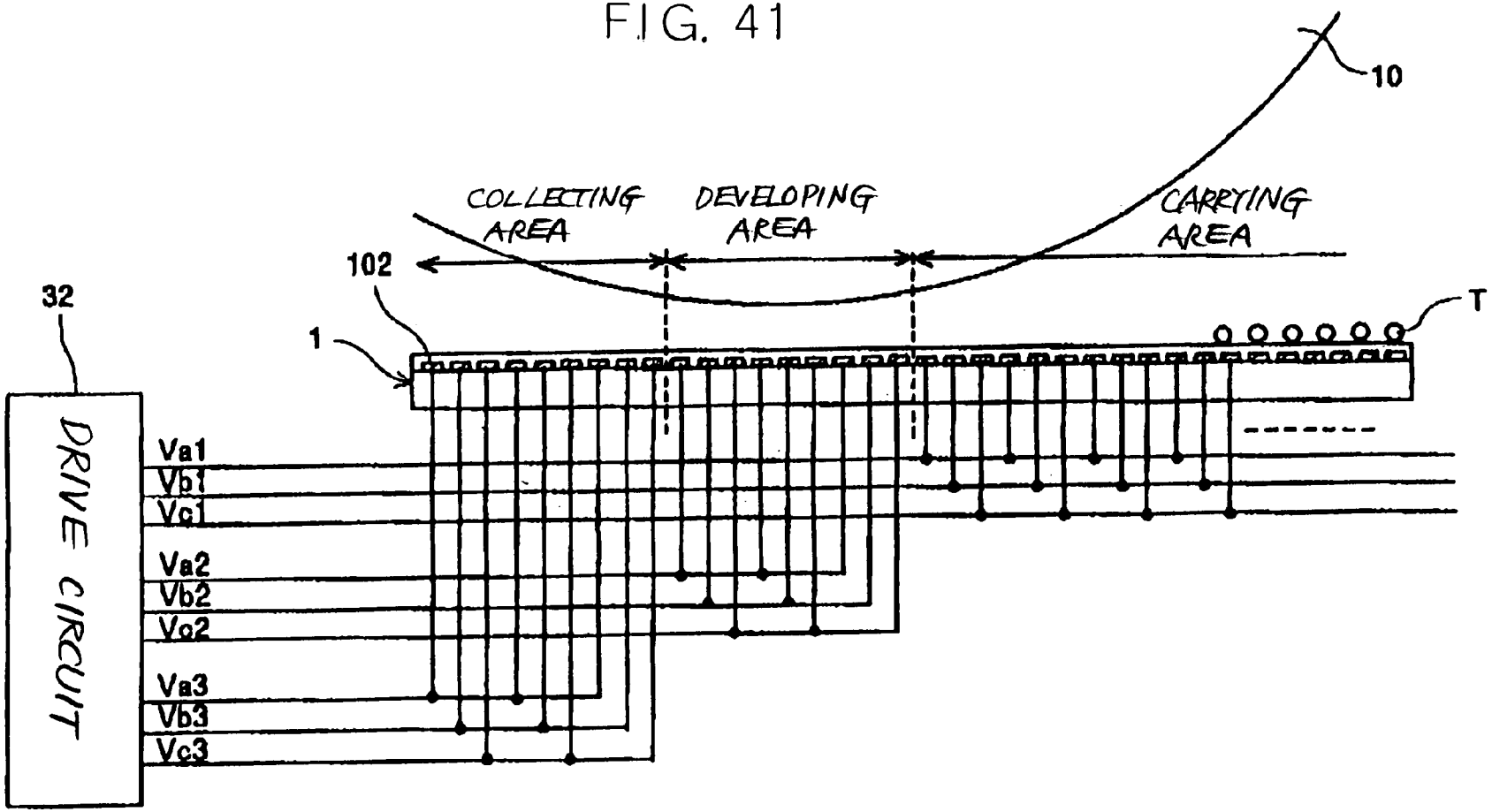
FIG. 41 is a schematic diagram showing a structure of a modification of the developing device.
Figure 42:
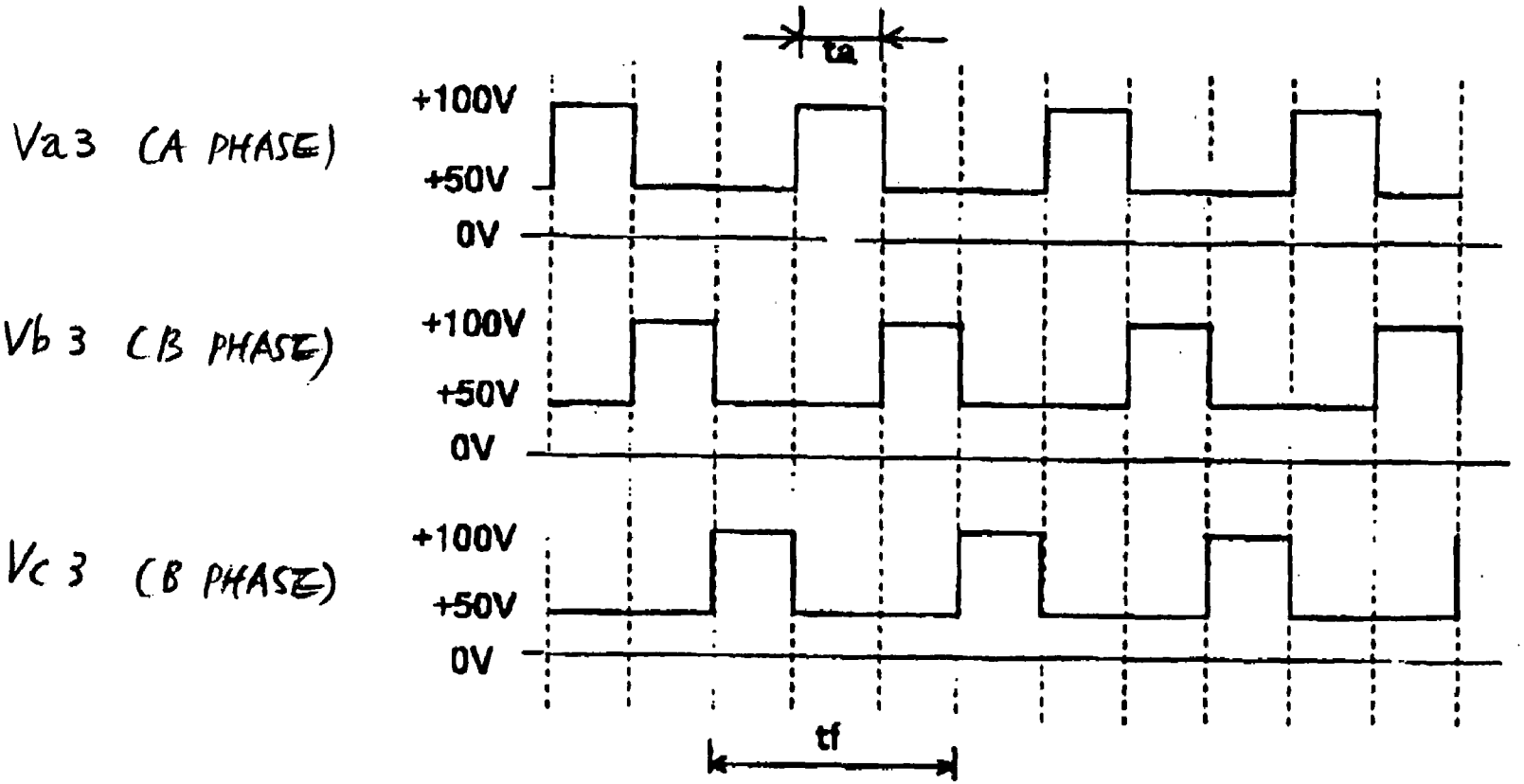
FIG. 42 is a diagram showing an example of a waveform of the drive signal of the collecting and carrying voltage pattern of the modified developing device.
Figure 43:
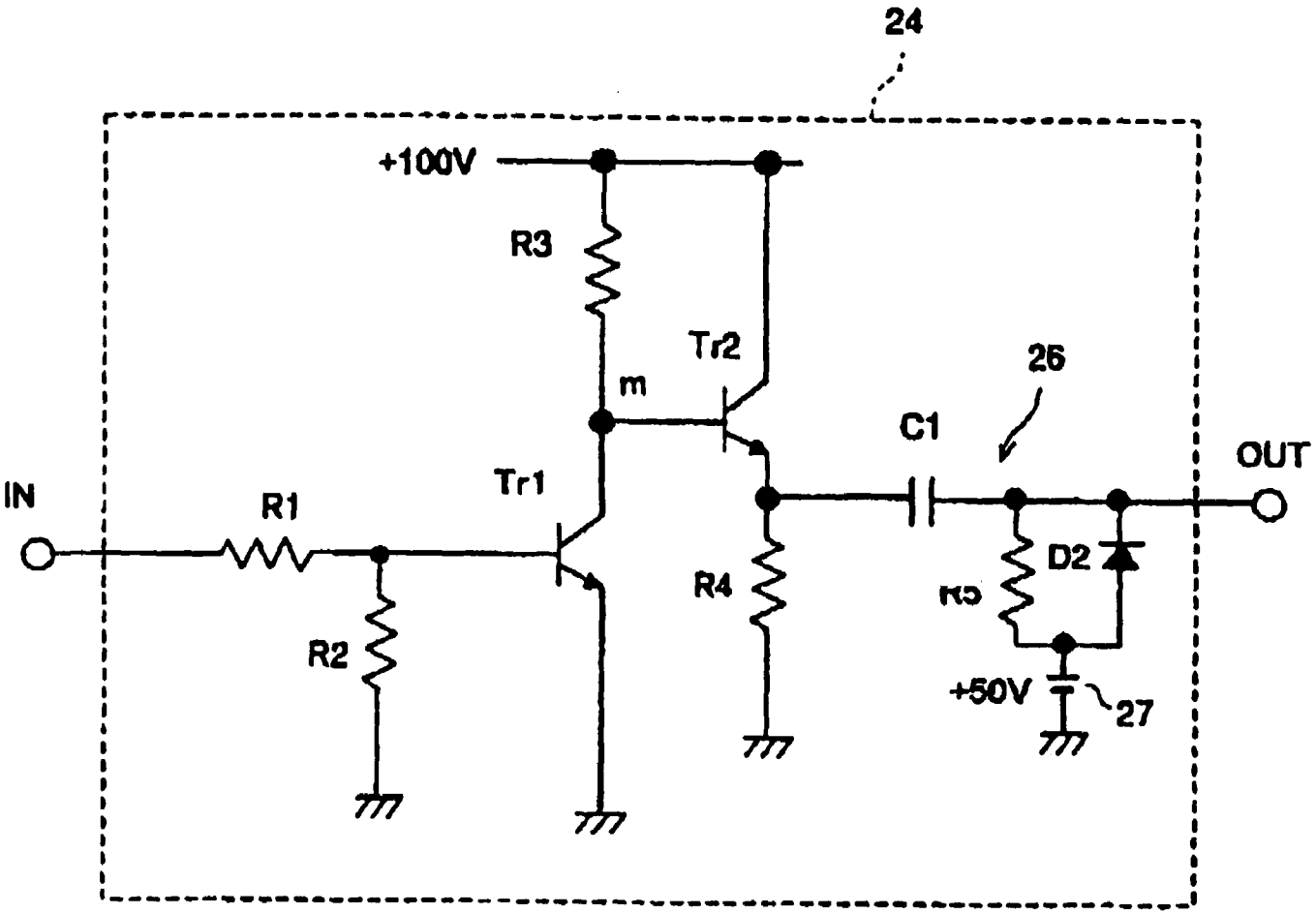
FIG. 43 is a diagram showing an example of a structure of a waveform amplifier for generating a waveform of a drive signal of the collecting and carrying voltage pattern.

In accordance with a modification of the present invention, as shown in FIG. 41, instead of the drive circuit 2, a drive circuit 32 may be provided for applying drive signals Va1, Vb1, and Vc1, drive signals Va2, Vb2, and Vc2, and drive waveforms Va3, Vb3, and Vc3 to the respective electrodes 102 of the carrying area 11, the developing area 12, and the collecting area 13 of the electrostatic transport substrate 1, respectively. As shown in FIG. 42, the collecting and carrying drive waveforms of the drive signals Va3, Vb3, and Vc3, which are outputted from the drive circuit 32 to the respective electrodes 102 of the collecting area 13, are waveforms obtained by adding a bias voltage of DC +50 V to the carrying drive waveforms of the drive signals Va1, Vb1, and Vc1, and waveforms of A to C phases are pulse waveforms of +50 to +150 V with each phase shifted by 120°. As shown in FIG. 43, a waveform amplifier 24 for a collecting and carrying voltage, which is included in the drive circuit 32 for generating the drive signals, is an amplifier obtained by inserting a power supply circuit 27 of +50 V in series with the resistor R5 and the diode D2 facing the direction opposite to the GND direction of the clamp circuit 26 of the waveform amplifier 22. Further, a DC voltage of +50 V is biased to an output signal of the waveform amplifier 22. As a result, a waveform of the drive signals of +50 to +150 V is obtained.

In this way, the waveforms of the drive signals to be applied to the respective electrodes of the carrying substrate are formed by a clamp circuit constituted by a capacitor, a resistor, a diode, and bias voltage generating means so as to produce a stable waveform having a fixed peak value and without drift with a simple circuit structure and by clamping a low level side. Thus, accurate carrying and hopping of toner become possible. In addition, a predetermined bias waveform, in which the low level side is not 0 V, can be formed simply by inserting a simple power supply circuit, and it becomes possible to adjust a bias electric field between the photosensitive member and the transport substrate, with the result that conditions for obtaining an optimal image can be set easily.

In addition, by superimposing a DC bias to drive signals to be applied to the respective electrodes 102 of the collecting area 13, collection efficiency is further improved, and generation of a scattered toner can be prevented reliably. In short, by providing means for forming an electric field which pulled back the toner to the side of the electrostatic transport substrate 1 in an area following the developing area, scattering of the toner was significantly reduced but was not completely eliminated. The inventors investigated a cause for this and found from videos of a high-speed camera and the simulation that the air was pulled by the rotating OPC photosensitive member 10 to move even on a side close to the electrostatic transport substrate 1.

Figure 44:
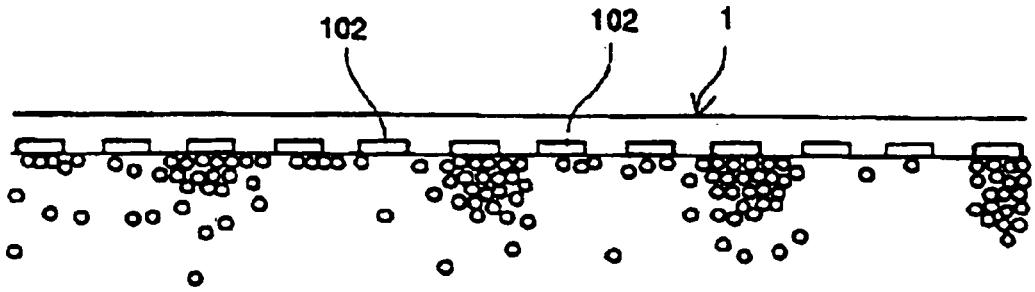
FIG. 44 is a diagram showing a toner position when 1,000 μsec has elapsed after applying a waveform of a drive signal of the collecting and carrying voltage pattern.
Figure 44:
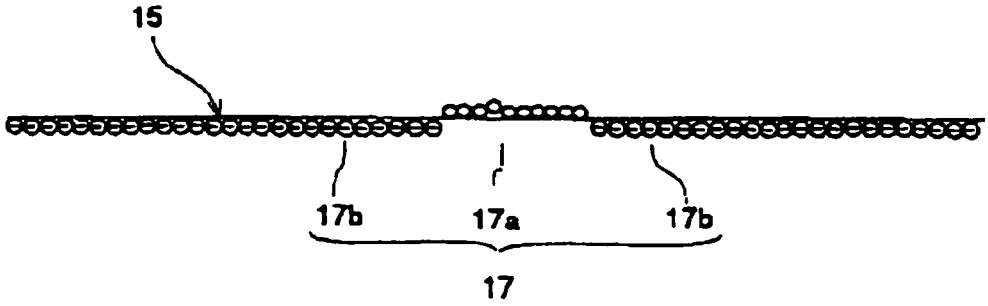

Thus, the DC bias of +50 V was superimposed on the drive signals to be applied to the respective electrodes 102 of the collection area 13 to increase the electric field intensity so that generation of the scattered toner was reduced to substantially zero. An average voltage of the drive signals in this case is 83.3 V. FIG. 44 shows an example of a behavior of the toner T in this case. FIG. 44 shows a distribution of the toner when 1,000 μsec has elapsed after switching voltages to be applied to the respective electrodes 102 into the drive signals Va3, Vb3, and Vc3 of the collecting and carrying voltage pattern. This elapsed time is the same as that shown in FIG. 27. As is seen when FIG. 44 is compared with FIG. 30, the toner is attracted to the side of the electrostatic transport substrate 1.

Figure 45:
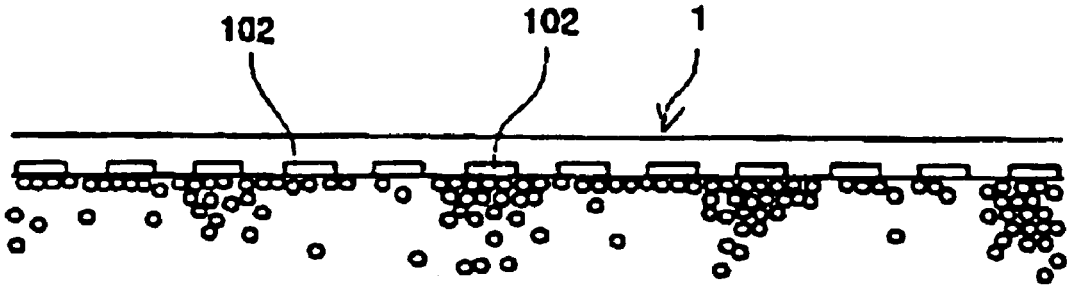
FIG. 45 is a diagram for explaining a toner position when 1000 μsec has elapsed after applying the waveform of the drive signal of the collecting and carrying voltage pattern with a bias voltage set to +100 V.
Figure 45:
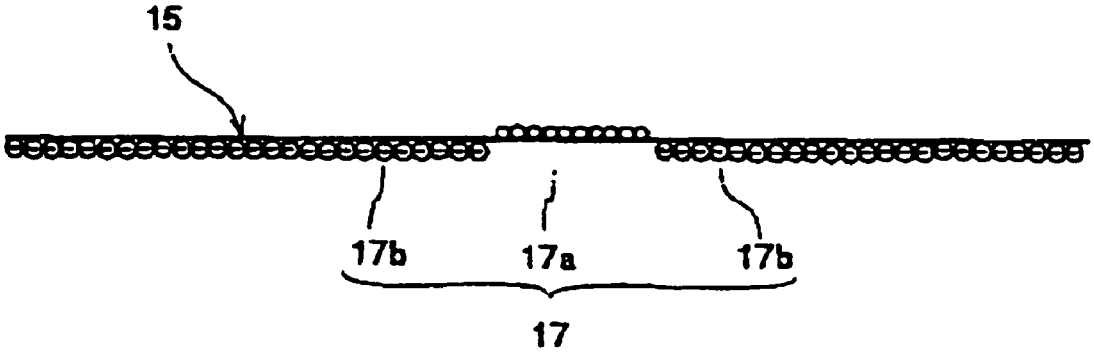

As a result of further repeating researches, the inventors found that a bias voltage also had a proper value. FIG. 45 shows an example of a behavior of the toner T at the time when a DC bias voltage is set to +100 V (the drive waveforms of the drive signals are +100 to +200 V, and an average voltage is +133.3 V). FIG. 45 shows a distribution of the toner when 1,000 μsec has elapsed after switching voltages to be applied to the respective electrodes 102 into the drive signals Va3, Vb3, and Vc3 of the collecting and carrying voltage pattern. As is seen when FIG. 45 is compared with FIG. 44, the toner is further attracted to the side of the electrostatic transport substrate 1, but an electrostatic force attracting the toner to the electrostatic transport substrate 1 is intensified, and a large amount of the toner is not carried. Moreover, FIG. 46 shows an example of a behavior of the toner T at the time when the DC bias voltage is set to +150 V (the waveforms of the drive signals are +150 to +250 V, and an average voltage is +183.3 V).

Figure 46:
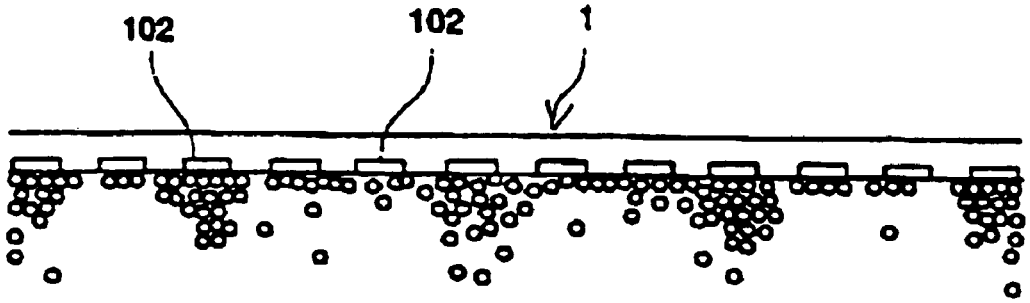
FIG. 46 is a diagram for explaining a toner position when 1000 μsec has elapsed after applying the waveform of the drive signal of the collecting and carrying voltage pattern with a bias voltage set to +150 V
Figure 46:
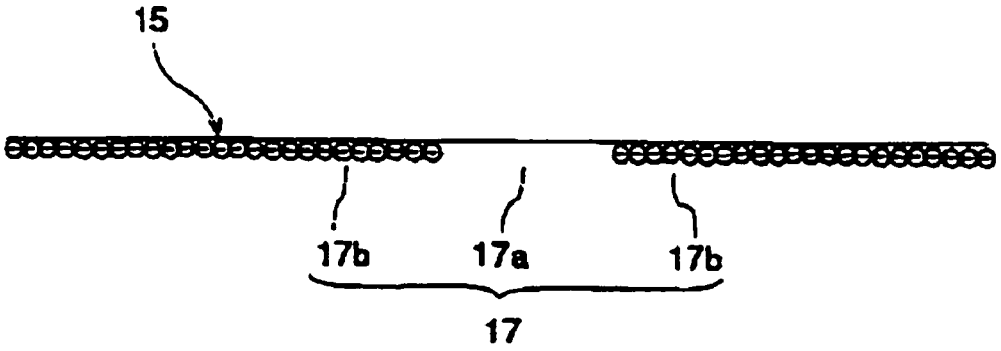

FIG. 46 shows a distribution of the toner when 1,000 μsec has elapsed after switching voltages to be applied to the respective electrodes 102 into the drive drive signals Va3, Vb3, and Vc3 of the collecting and carrying voltage pattern.

As is seen when FIG. 46 is compared with FIG. 45, the electrostatic force attracting the toner to the electrostatic transport substrate 1 is further intensified, the toner adhering on the OPC layer 15 is also pulled back to the electrostatic transport substrate 1, and a developed image disappears. A plus bias of a collecting and carrying voltage has a proper value. If the plus bias is too low, a floating toner can hardly be attracted to the side of the transport substrate, where there is almost no movement of the air, from a current of the air which is generated following rotation of the OPC photosensitive member. On the other hand, if the plus bias is too high, the toner cannot be carried, and eventually, even the toner once used for development is collected with the result that the image disappears.

Figure 47:
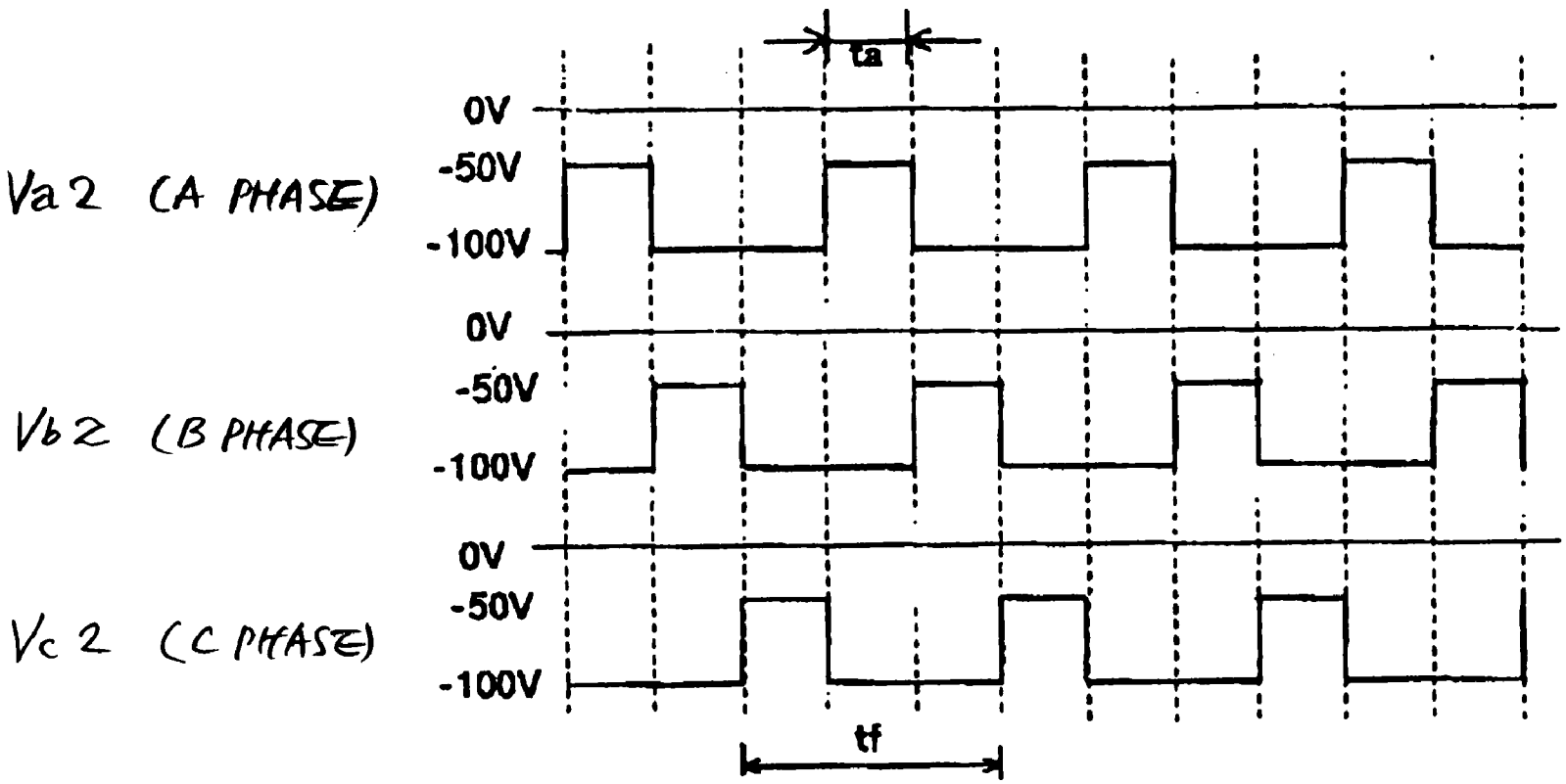
FIG. 47 is a diagram showing another example of waveform of a drive signal of a hopping voltage pattern.

A surface potential of the OPC photosensitive member 10 may be increased, and a −DC bias voltage may be superimposed on the drive signals Va2, Vb2, and Vc2 of the hopping voltage pattern. More specifically, a charge density of the OPC layer 15 is increased to −4.0 e-4 C/m*m, and a potential is increased to −220 V. On the other hand, as shown in FIG. 47, a DC voltage of −50 V is biased to the drive signals Va2, Vb2 and Vc2 to be applied to the respective electrodes 102 of the developing area 12 to have drive waveforms of −50 V to −150 V. As shown in FIG. 47, the drive waveforms are also waveforms in which time of a relatively positive potential is 33% duty.

Figure 48:
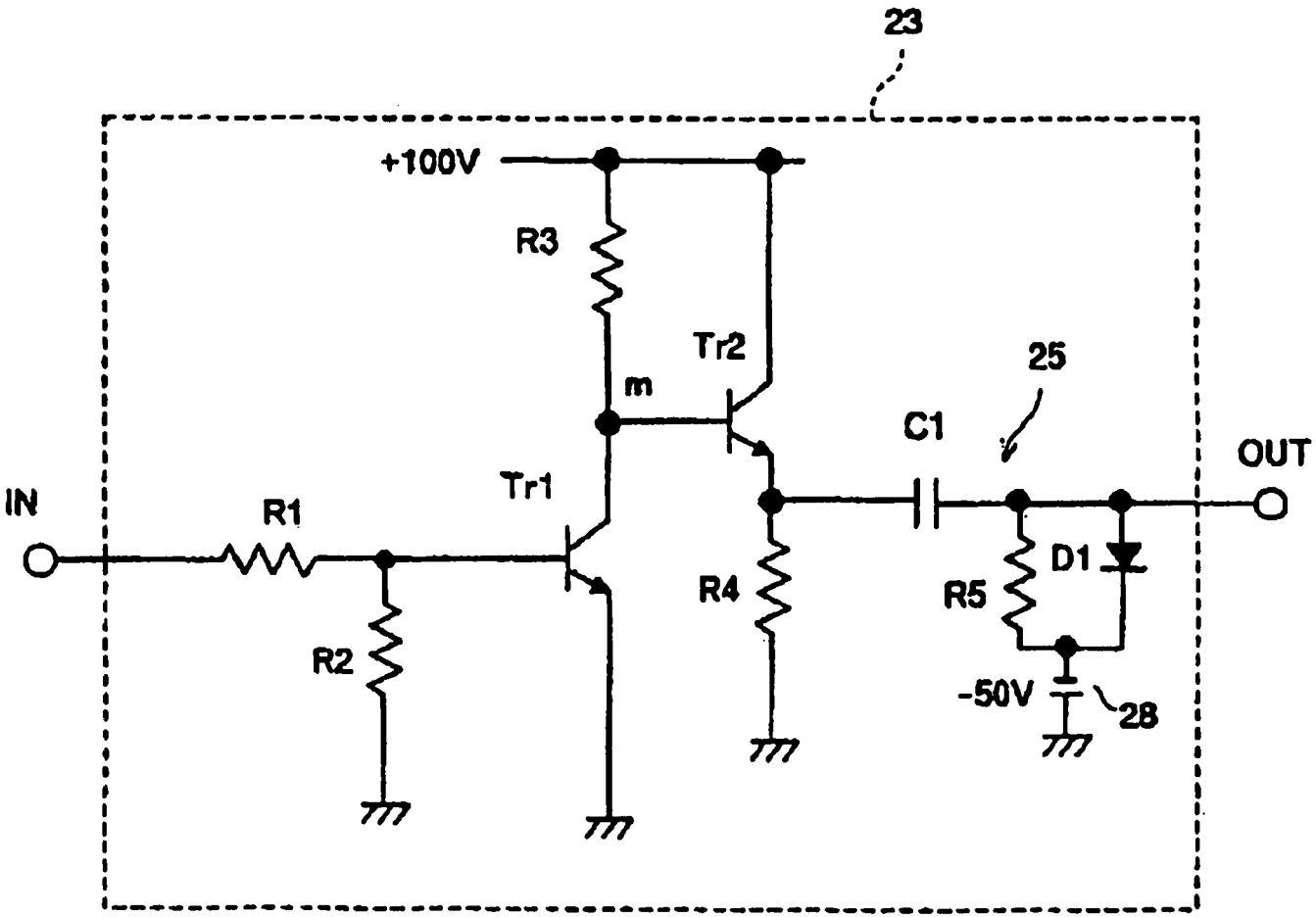
FIG. 48 is a diagram showing an example of a structure of a waveform amplifier for generating a waveform of a drive signal of the hopping voltage pattern.
Figure 49:
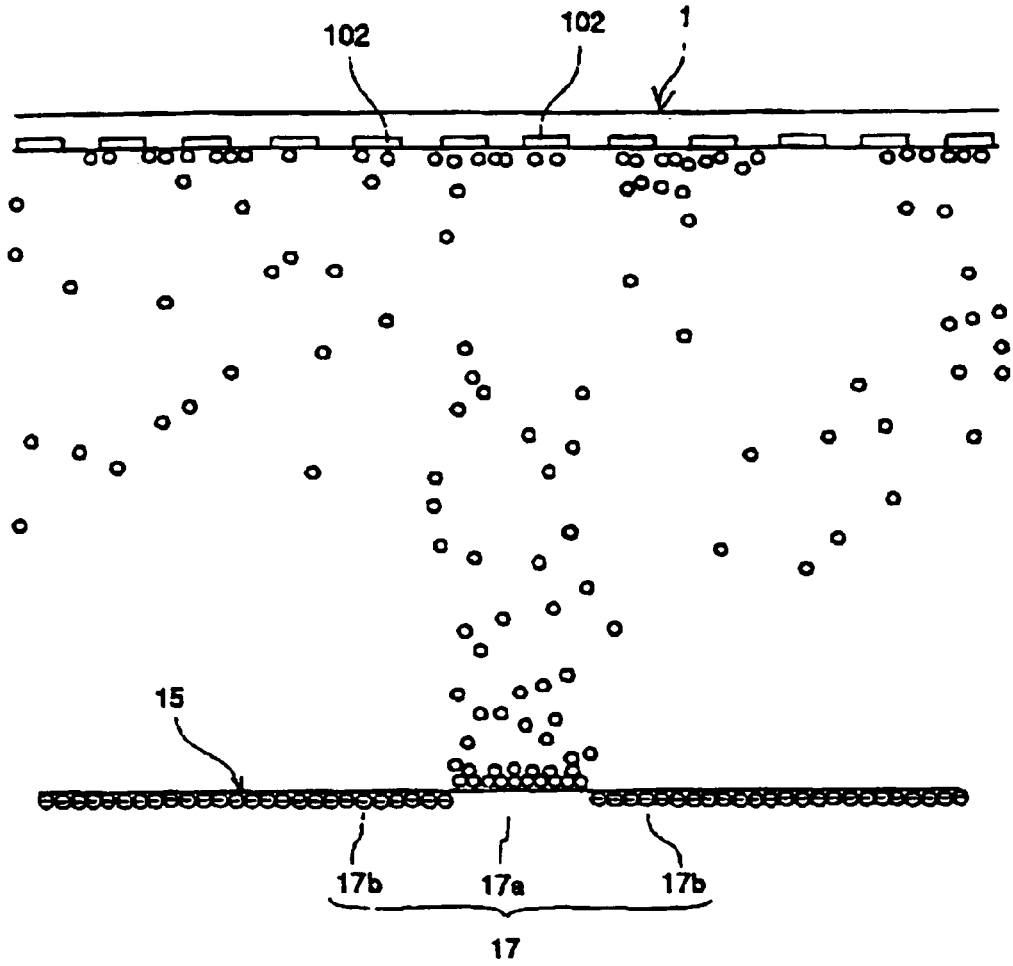
FIG. 49 is a diagram showing a toner position at the end of the development.

As shown in FIG. 48, the waveform amplifier 23 for generating the drive waveforms is obtained by inserting a power supply circuit 28 of −50 V in series with the resistor R5 and the diode D1 facing the direction opposite to the GND direction of the clamp circuit 25 of the circuit shown in FIG. 31. A DC voltage of −50 V is biased to the output signals of the waveform amplifier 23. As a result, a waveform of −50 to −150 V is obtained. FIG. 49 shows an example of a behavior of the toner T in this case. This figure shows a distribution of the toner at the end of the development. As is seen when FIG. 49 is compared with FIG. 23, the number of toner particles adhering to the image portion 17*a* is almost doubled. The toner adhering to an image portion (used for development) increases, and an image with high image concentration and without the contamination of the non-image portion can be formed.

In the case in which toner of a negative charging property is used for the respective electrodes of the electrostatic transport substrate 1, it is advisable to apply a voltage of −V5 to −V6 (V5>V6) in the developing area and to apply a voltage of +V7 to +V8 (V8>V7) in the area following the developing area. In other words, the waveform to be generated is a waveform for applying a voltage of −V to −(V+α) in the developing area and applying a voltage of +V to +(V+α) in the area following the developing area. Accordingly, an amount of development by the toner and an amount of collection of the floating toner can be increased.

Similarly, in the case in which toner of a positive charging property is used, it is advisable to apply a voltage of +V9 to +V10 (V10>V9) in the developing area and to apply a voltage of −V11 to −V12 (V12>V11) in the area following the developing area. In other words, the waveform to be generated is a waveform for applying a voltage of +V to +(V+α) in the developing area and applying a voltage of −V to −(V+α) in the area following the developing area. Accordingly, an amount of development by the toner and an amount of collection of the floating toner can be increased. The the voltages V9, V10, V11 and V12 may have the same absolute value or different absolute values.

Figure 50:
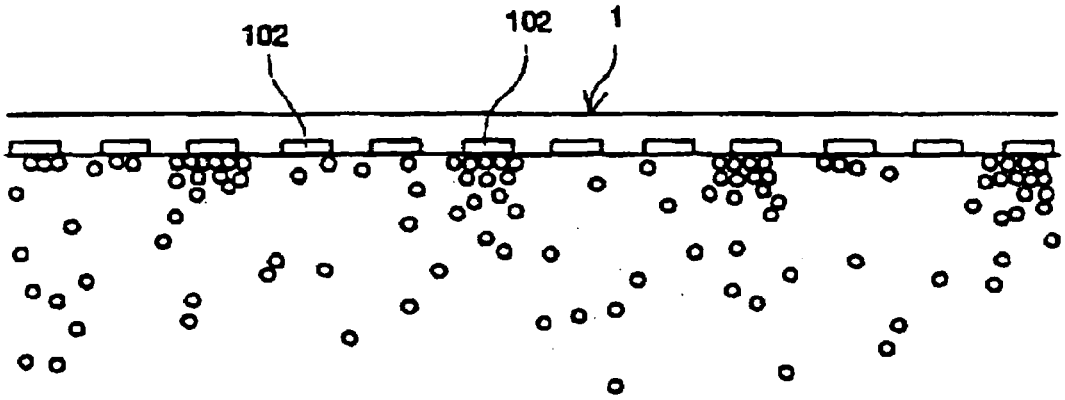
FIG. 50 is a diagram showing a toner position when 1,000 μsec has elapsed after applying a drive waveform of the collecting and carrying voltage pattern.
Figure 50:
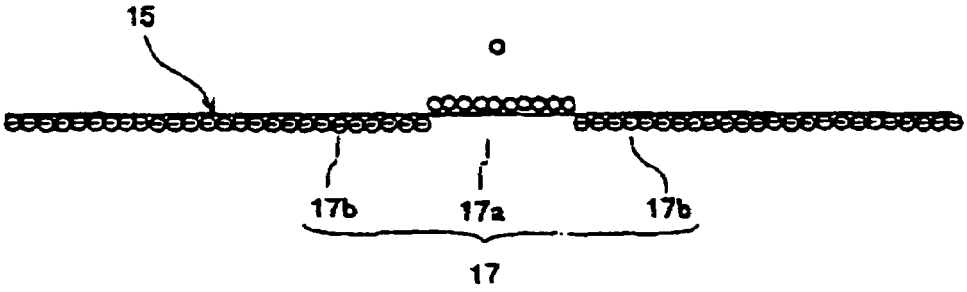

In addition, the gap between the electrostatic transport substrate 1 and the OPC photosensitive member 10 is increased from 200 μm to 400 μm using a voltage pattern of the drive signals. FIG. 50 shows an example of a behavior of the toner T in this case. This figure shows a distribution of the toner when 1,000 μsec has elapsed after the application of drive waveforms of the collecting and carrying voltage pattern. As is seen when FIG. 50 is compared with FIG. 44, the floating toner is relatively attracted to the electrostatic transport substrate 1 side. In this way, scattering of the toner can be further prevented.

Figure 51:
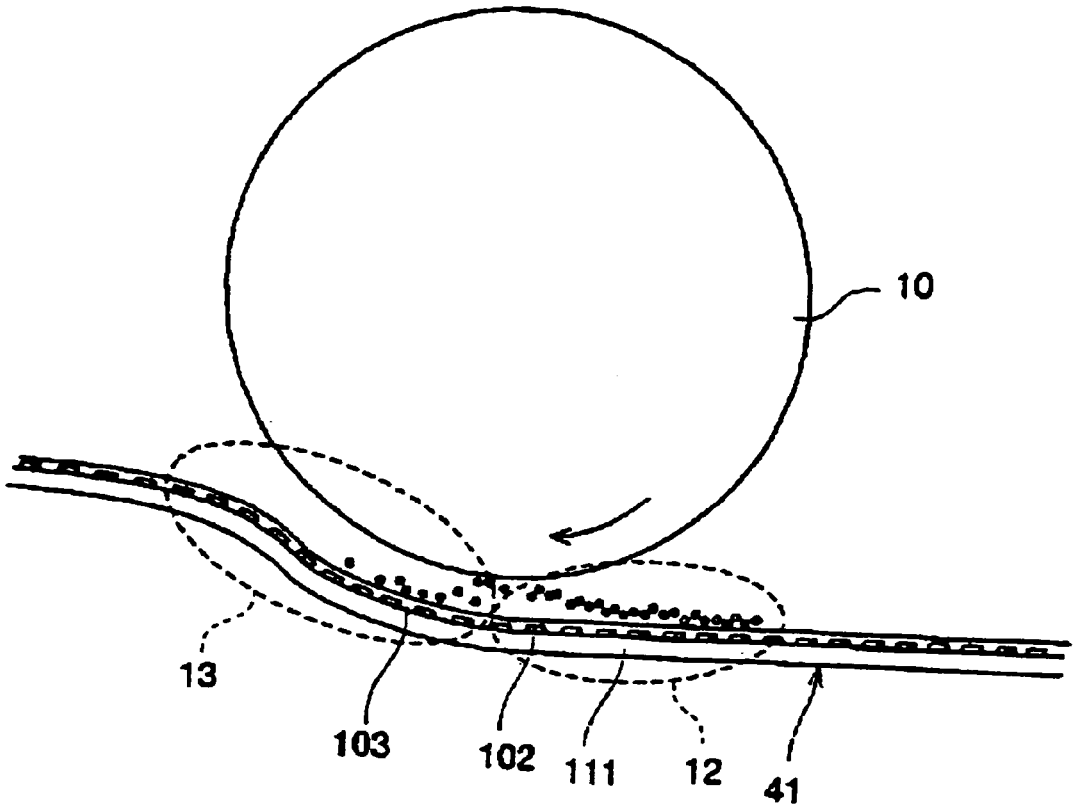
FIGS. 51 and 52 are diagrams showing a structure of another modification of the developing device.

Further, as shown in FIG. 51, an electrostatic transport substrate 41 is used, in which plural electrodes 102 are provided on a flexible base substrate 111 and a protective layer 103 is formed. A part of this electrostatic transport substrate 41 corresponding to the collecting area 13 is curved along a surface shape of the photosensitive member 10. When the number of rotations of the photosensitive member 10 was increased (peripheral velocity of the photosensitive member 10 was increased), scattering of the toner occurred. This seems to be because, since the gap between the photosensitive member 10 and the electrostatic transport substrate 1 increases further on a downstream side of the photosensitive member 10, a toner collection time is reduced, and the OPC photosensitive layer moves away from the electrostatic transport substrate 1 before the floating toner is attracted to the side of the electrostatic transport substrate 41.

Figure 52:
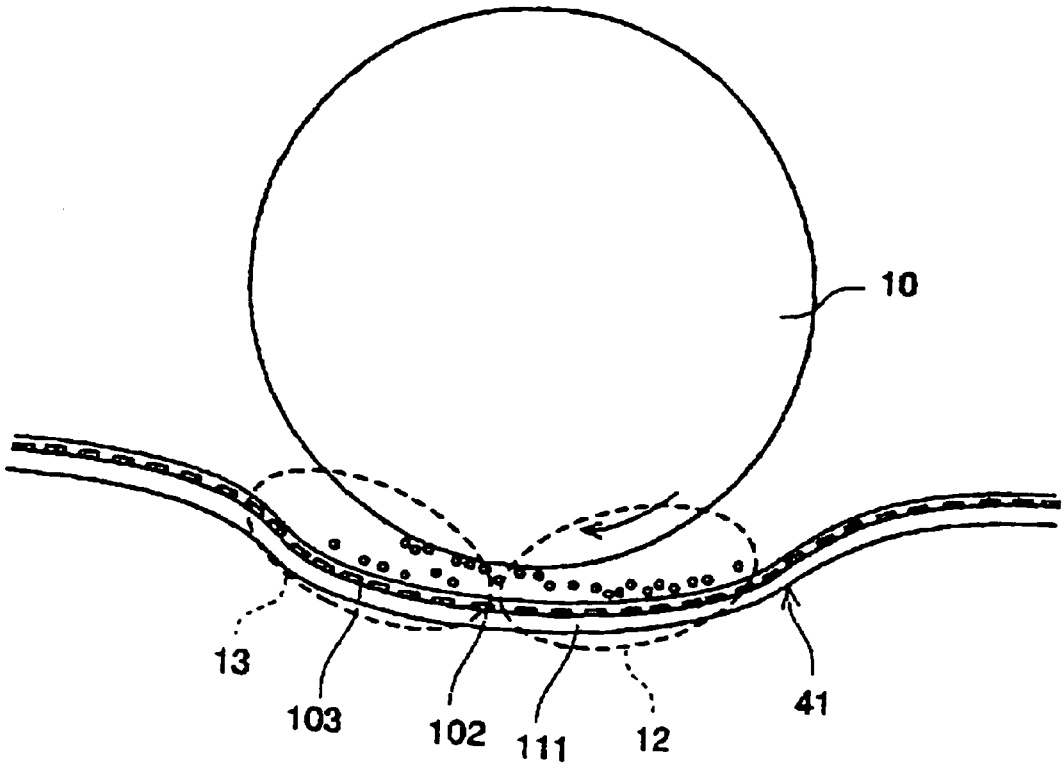

Thus, by using a flexible substrate as the electrostatic transport substrate 41 to keep the gap between the electrostatic transport substrate 41 and the photosensitive member 10 substantially uniform in the collecting area 13, time for sufficient collection of the toner can be secured. Further, since the floating toner can be attracted to side of the electrostatic transport substrate 41, scattering of the toner can be eliminated. In this case, when a development time is insufficient, as shown in FIG. 52, the flexible transport substrate 41 is curved in accordance with a curvature of the OPC photosensitive member 10 even in the developing area 12 so that the development time can be secured. In addition, in the case in which the electrostatic transport substrate 41 is curved, in a part forming a curved surface, the gap between the electrostatic transport substrate 41 and a latent image carrying member (photosensitive member 1) is increased further on the downstream side in the moving direction of the latent image carrying member. Accordingly, a flow of the air can be attenuated promptly without being disturbed, and collection of the floating toner can be performed reliably.

As an example of the transport substrate having a flexible fine-pitch thin layer electrode, a polyimide base film (thickness of 20 to 100 μm) is used as a base material (base substrate 111), and a film of Cu, Al, Ni—Cr, or the like with a thickness of 0.1 to 3 μm is formed on the base substrate 111 by a vapor deposition method. If the width of the transport substrate is 30 to 60 cm, the transport substrate can be manufactured by a roll-to-roll apparatus, and mass productivity is extremely improved. A common bus line froms simultaneously electrodes with a width of about 1 to 5 mm. As specific means for the vapor deposition method, a method such as a sputtering method, an ion plating method, a CVD method, an ion beam method, or the like is possible. For example, in the case in which the electrodes are formed by the sputtering method, in order to improve adhesion with polyimide, a Cr film may be interposed. As pre-treatment, adhesion can be improved by plasma treatment or primer treatment. As a method other than the vapor deposition method, a thin layer electrode can also be formed by an electro deposition method. In this case, first, electrodes are formed on a polyimide base material by electroless deposition. It is possible to manufacture an Ni film with a thickness of 1 to 3 μm roll-to-roll by, after sequentially immersing the electrodes in Sn chloride, Pd chloride, and Ni chloride to form base electrodes, subjecting the base electrodes to electrolytic deposition in an Ni electrolytic solution.

The electrodes 102 are formed on those thin layer electrodes by resist application, patterning, and etching. In this case, if the thin layer electrodes have a thickness of 0.1 to 3 μm, fine pattern electrodes with width or interval of 5 μm to several tens of μm can be formed accurately by photolithography and etching treatment. Subsequently, as the surface protective layer 103, $SiO_2$, $TiO_2$, or the like with a thickness of 0.5 to 2 μm is formed by sputtering or the like. Alternatively, PI (polyimide) is applied as the surface protective layer at a thickness of 2 to 5 μm by a roll coater or other coating apparatuses and baked for finishing. When a trouble occurs with only PI, it is sufficient to form $SiO_2$ or other inorganic films on an uppermost surface at a thickness of 0.1 to 2 μm by sputtering.

In addition, as another example, it is also possible to use a polyimide base film (with a thickness of 20 to 100 μm) as a base material (base substrate 111) and form Cu, SUS, or the like with a thickness of 10 to 20 μm as an electrode material on the base substrate 111. In this case, conversely, polyimide is applied on a metal material at a thickness of 20 to 100 μm by the roll coater and baked. Thereafter, the metal material is patterned in a shape of the electrodes 102 with the photolithography and etching treatment, and polyimide is coated on surfaces of the electrodes 102 as the protective layer 103. In the case in which there is unevenness corresponding to the thickness of 10 to 20 μm of the metal material electrodes, semi-planarization including proper steps is performed. For example, a polyimide material or a polyurethane material with a viscosity of 50 to 10,000 cps, more preferably 100 to 300 cps is spin-coated and left to stand, whereby the unevenness of the substrate is smoothed by surface tension of the material, and the uppermost surface of the carrying substrate is planarized. Thereafter, a stable protective film material is obtained by heat treatment.

As yet another example in which strength of the flexible transport substrate is increased, SUS, an Al material, or the like with a thickness of 20 to 30 μm is used as a base material, and a diluted polyimide material with a thickness of about 5 μm is coated with the roll coater on a surface of the base material as an insulating layer (insulation between the electrodes and the base material). Then, this polyimide is, for example, subjected to pre-baking at temperature of 150° C. for thirty minutes and post-baking at temperature of 350° C. for sixty minutes to form a thin layer polyimide film as the base substrate 101. Thereafter, after applying plasma treatment and primer treatment for improvement in adhesion to the base substrate 101, Ni—Cr is deposited at a thickness of 0.1 to 2 μm as a thin layer electrode layer, and the electrodes 102 of a fine pattern with a thickness of several tens of μm is formed by photolithography and etching. Moreover, the surface protective layer 103 of $SiO_2$, $TiO_2$, or the like is formed on surfaces of the electrodes 102 at a thickness of about 0.5 to 1 μm, whereby a flexible carrying substrate can be obtained.

In accordance with another modification of the present invention, since the gap between the photosensitive member 10 and the electrostatic transport substrate 1 increases further on the downstream side of the photosensitive member 10, when the number of rotations of the photosensitive member 10 is increased (peripheral velocity is increased), a toner collection time is reduced. Then, the OPC photosensitive layer moves away from the electrostatic transport substrate 1 before the floating toner is sufficiently attracted to the side of the electrostatic transport substrate 1.

Thus, the hard type electrostatic transport substrate 1 is used to sequentially increase a plus bias voltage, which is applied to the drive signals of the collecting and carrying voltage pattern in accordance with an increase in the gap between the electrostatic transport substrate 1 and the OPC photosensitive member. Accordingly, scattering of the toner can be eliminated when the peripheral velocity is increased. FIG. 53 shows a relation between the gap between the OPC photosensitive member 10 and the planar electrostatic transport substrate 1 and a plus bias voltage with respect to length of the collecting area 12 in this case. Conditions in this case are as described below. Only a few toner particles are originally floating on the side of the OPC photosensitive member layer in the base portion and a collecting electric field is large compared with an image portion, and a bias voltage is therefore set such that the collecting electric field of the image portion is maintained constant. The conditions are as described below. A photosensitive member and a planar transport substrate have a diameter of 60 mm. The collecting area 13 starts immediately below a center of a photosensitive member. A collecting and carrying voltage pattern is +100 V, 0 V, and 0 V (+bias 50 V), and an electrostatic latent image potential is 0 V in the image portion, and −170 V in the non-image portion. A charging polarity of the toner is negative (−20 μC/g).

Figure 54:
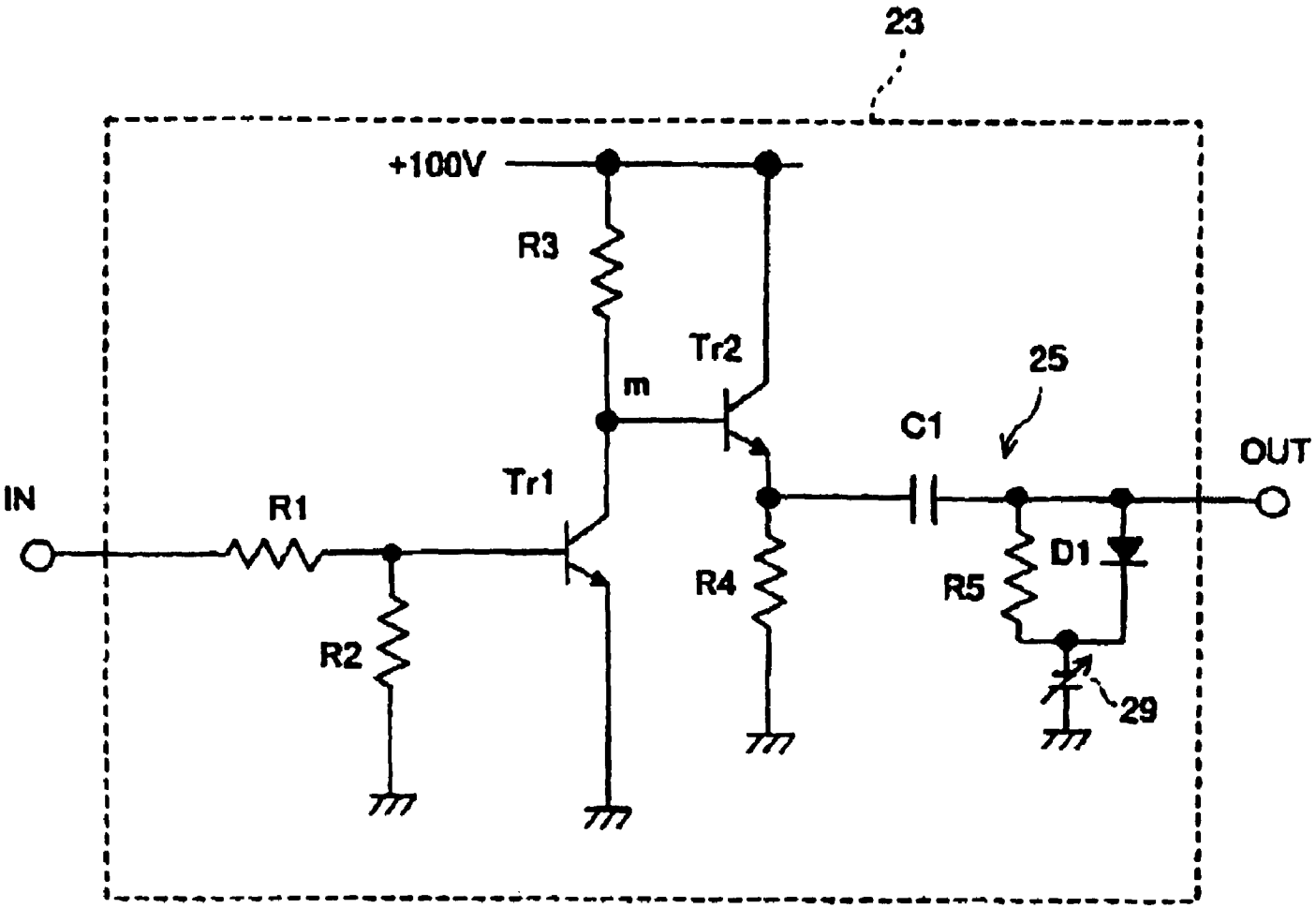
FIG. 54 is a diagram showing a structure of a waveform amplifier for generating a waveform of a drive signal of the hopping voltage pattern in another modification of the developing device.

In accordance with a further modification of the present invention, as shown in FIG. 54, the bias voltage of the drive signals to be applied to the respective electrodes 102 of the electrostatic transport substrates 1 and 41 can be changed. FIG. 54 shows an example of the waveform amplifier 23 for outputting drive signals of the hopping voltage pattern in this case. In the circuit of FIG. 48, a bias power supply circuit 29 capable of changing an output voltage is provided instead of the bias power supply circuit 28 for outputting a fixed voltage. A bias voltage can also be made variable for the waveform amplifiers 22 and 24 for outputting drive signals of the carrying voltage pattern or the collecting and carrying voltage pattern. In addition, an output voltage of the bias power supply circuit 29 can be adjusted by a main control unit (not shown). A charging amount of the toner and a surface potential of the OPC photosensitive member vary according to the temperature and humidity of a surrounding environment and an operating time of a printer. In the case of a copying machine, a user may wish to copy an original document of low image density with high density or may wish to copy an original document by skipping the non-image portion.

Thus, by allowing a bias value to change, a satisfactory image can be always formed without scattering of the toner regardless of a change in the environment, the operational change of the machine, the image density of the original document, and then like. In addition, even if a structure for controlling a bias voltage in a feedback manner is not adopted, a fluctuation in the characteristics among machines after assembling the machine can be adjusted such that an optimal image is obtained by adjusting the bias voltage.

Figure 55:
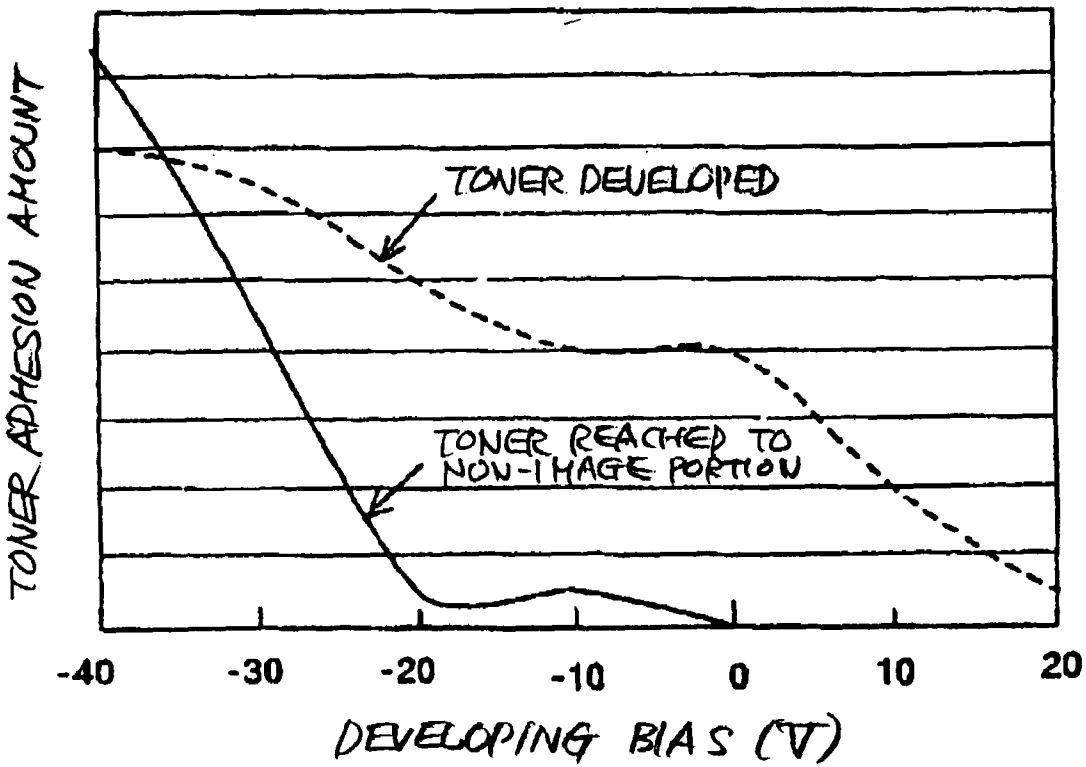
FIG. 55 is a diagram showing a relation between a developing bias voltage and an amount of toner adhesion.

A developing bias and a toner deposition amount on the non-image portion when a DC bias voltage (developing bias) is superimposed on a pulse-like drive waveform will be described with reference to FIG. 55.

First, as conditions concerning a latent image carrying member, electrodes of the transport substrate, spaces, and the like, it is assumed that a toner average diameter is 8 μm, an average Q/m is −20 μC/g, a gap between the transport substrate and the latent image carrying member is 200 μm, a line pattern width of a latent image is 30 μm, there are three to ten lines of the line patterns, an interval (non-image base portion) of the line patterns is 450 μm, a potential in a latent image line pattern portion (image portion) is 30 V, a non-image portion potential is 110 V, carrying electrodes 102 has a width of 30 μm and an interval of 30 μm, and a basic drive pulse with respect to the electrodes 102 is 0 to −100 V/three-phase drive, 3 kHz, and 66% duty. FIG. 56 shows a relation between a development bias and a toner deposition amount with respect to the non-image portion at the time when development was performed by varying the DC voltage bias in the range of +20 V to −40 V with respect to this basic drive pulse. In addition, FIG. 56 shows a relation among potentials of the electrodes, the photosensitive member, and the like.

The conditions of the above-mentioned latent image pattern are strict for developing the pattern including extremely thin lines. As shown in FIG. 55, when the DC bias voltage is increased from −40 V by 10 V each time, the number of toner particles (represented by solid line in FIG. 55) reaching the non-image also decreases, and the number of toner particles used for developing a line latent image (number per unit length; represented by broken line in FIG. 55) also decreases. The results show measurement values of an amount of the toner having reached the non-image with respect to a developing bias voltage, when the toner has deposited within a development time in which the latent image carrying member passes a nip area for development.

In a developing step, it is required that a minimum dot can be developed without contamination of the non-image portion. For this purpose, it is sufficient that there is no toner reaching the non-image portion and toner can reach a latent image of a minimum dot width. From this standpoint, it is noted that the developing bias is within the range of −30 to +10 V, more preferably −20 V to 0 V when the minimum dot width can be developed without contamination of the non-image portion. The average value of the drive pulse voltages in that case is in the range of −63.3 to −23.3 V, more preferably −53.3 to −33.3 V.

In addition, as a result of performing evaluation of toner deposition with the developing gap and the drive pulse conditions as parameters, it was found that, in conditions of relatively high values of frequencies of drive pulses (drive waveforms), a normal image was obtained when an average value potential of the pulse was between an image portion and a non-image portion. In addition, in conditions of relatively low values of frequencies of drive pulses, a potential at the first start point of a hopped toner is not an average value, and a potential of low "L" of the hopping voltage pattern is predominant (a column corresponding to a Low Potential (V) of the electrodes as shown in FIG. 56). For example, when an average velocity of toner, which is accelerated and flies, is 0.3 m/sec, a time in which the toner moves a distance in a height direction of 30 μm, and an electric field intensity falls to ⅕, is 100 μsec. Therefore, in this case, if a time constant of an applied voltage of the drive waveform is 100 μsec or more, an initial velocity is obtained, and a hopping operation becomes possible. Accordingly, it was confirmed that, with a drive pulse with an application time of the low "L" potential is 100 μsec or more, a preferable image is obtained at 5 kHz or less in the case of duty 50% and 3.3 kHz or less in the case of duty 66%.

Figure 57:
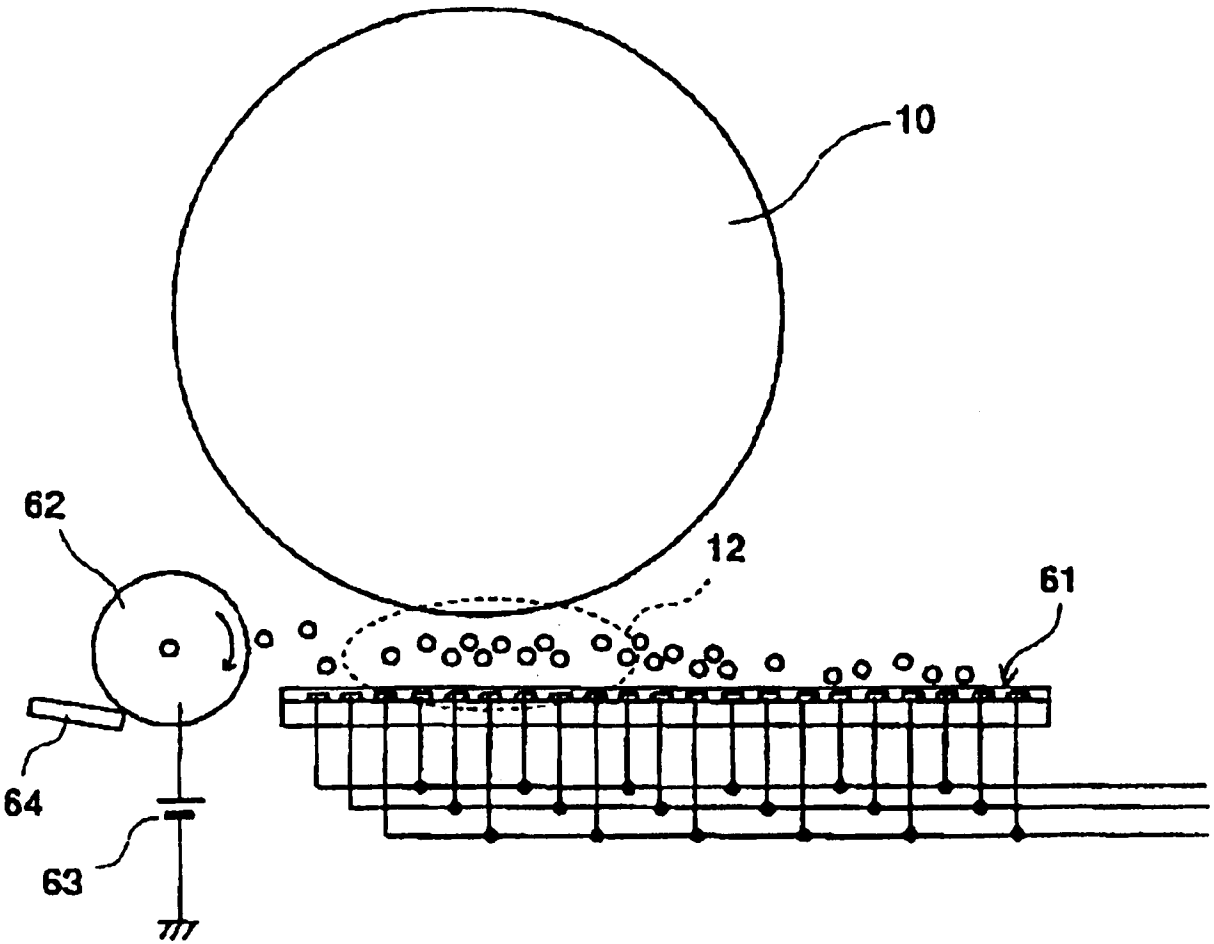
FIG. 57 is a schematic diagram showing a structure of another modification of the developing device.

As shown in FIG. 57, instead of collecting toner by using the transport substrate in the collecting area 13, development may be performed by using a transport substrate 61 which does not provided with the collecting area 13. In this case, a collection roller 62 is provided in the vicinity of an exit of the developing area 12 as means for forming an electric field of a direction in which the toner is directed to the side opposite to the photosensitive member 10. Further, a collection blade 64 is provided for applying a bias voltage for electric field generation from a bias power supply 63 to the collection roller 62 and for peeling toner to be collected from a surface of the collection roller 62.

In such a structure, the collection roller 62 formed of a metal roller with a diameter of 20 mm was arranged in the exit of the developing area 12 with a gap of 0.5 mm from the OPC photosensitive member 10, and +500 V was applied to this collection roller 62 as a bias voltage. Then, most of floating toner electrostatically adhered to the collection roller 62 serving as the metal roller, and scattering of the toner was reduced. Moreover, the collection roller 62 was rotated in the same direction as the OPC photosensitive member 10, and both the OPC photosensitive member 1 and the collection roller 62 were moved in opposite directions to stop a current of the air caused by the photosensitive member 62. Then, the toner could be collected entirely, and scattering of the toner was eliminated. In this way, the means for forming an electric field of a direction, in which the toner is directed to the side opposite to the photosensitive member 1, is not limited to the transport substrate, and a roller member, a planar member, and the like may also be used.

Figure 58:
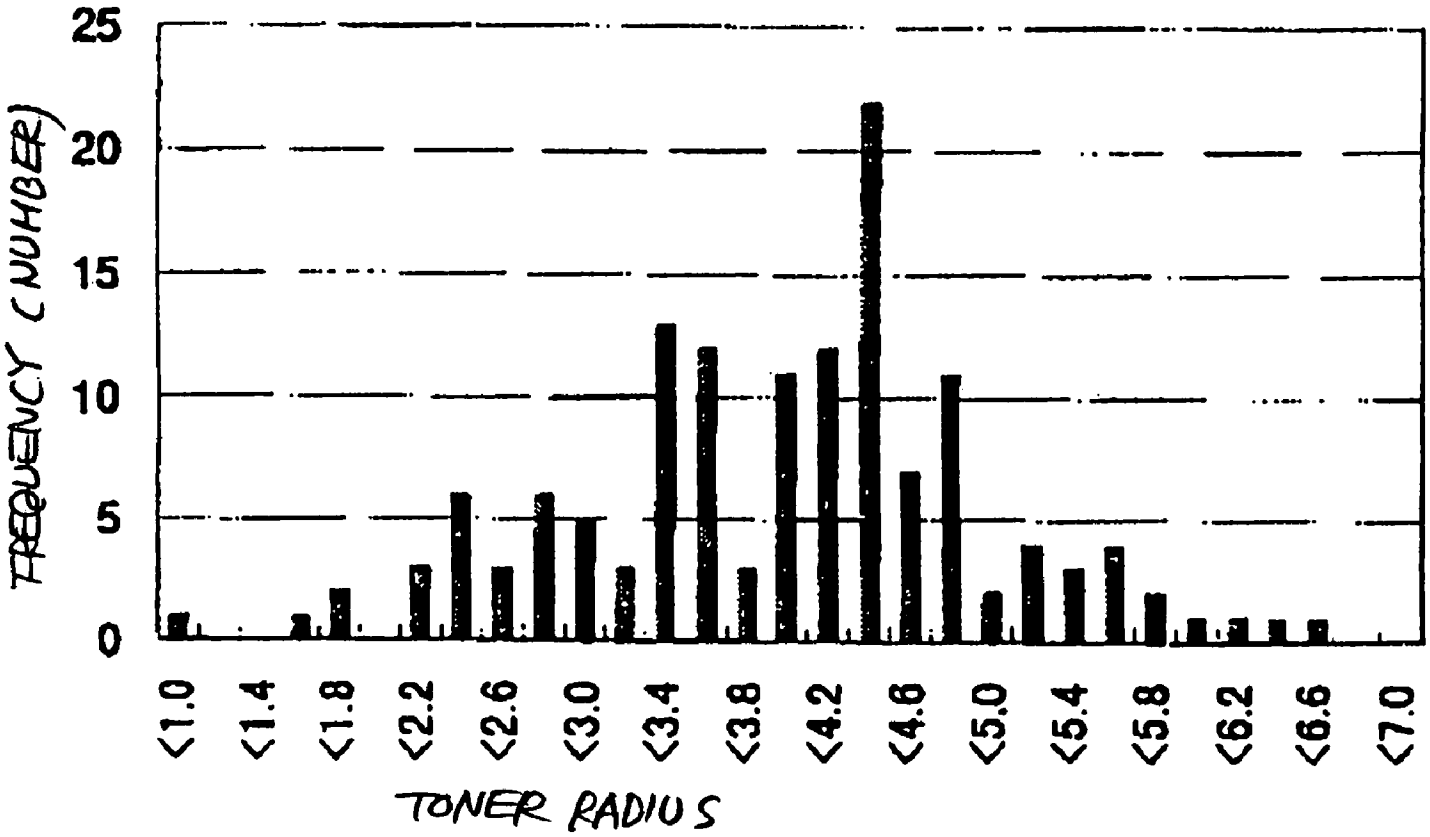
FIG. 58 is a diagram showing a distribution of radii of toner used in a simulation.
Figure 59:
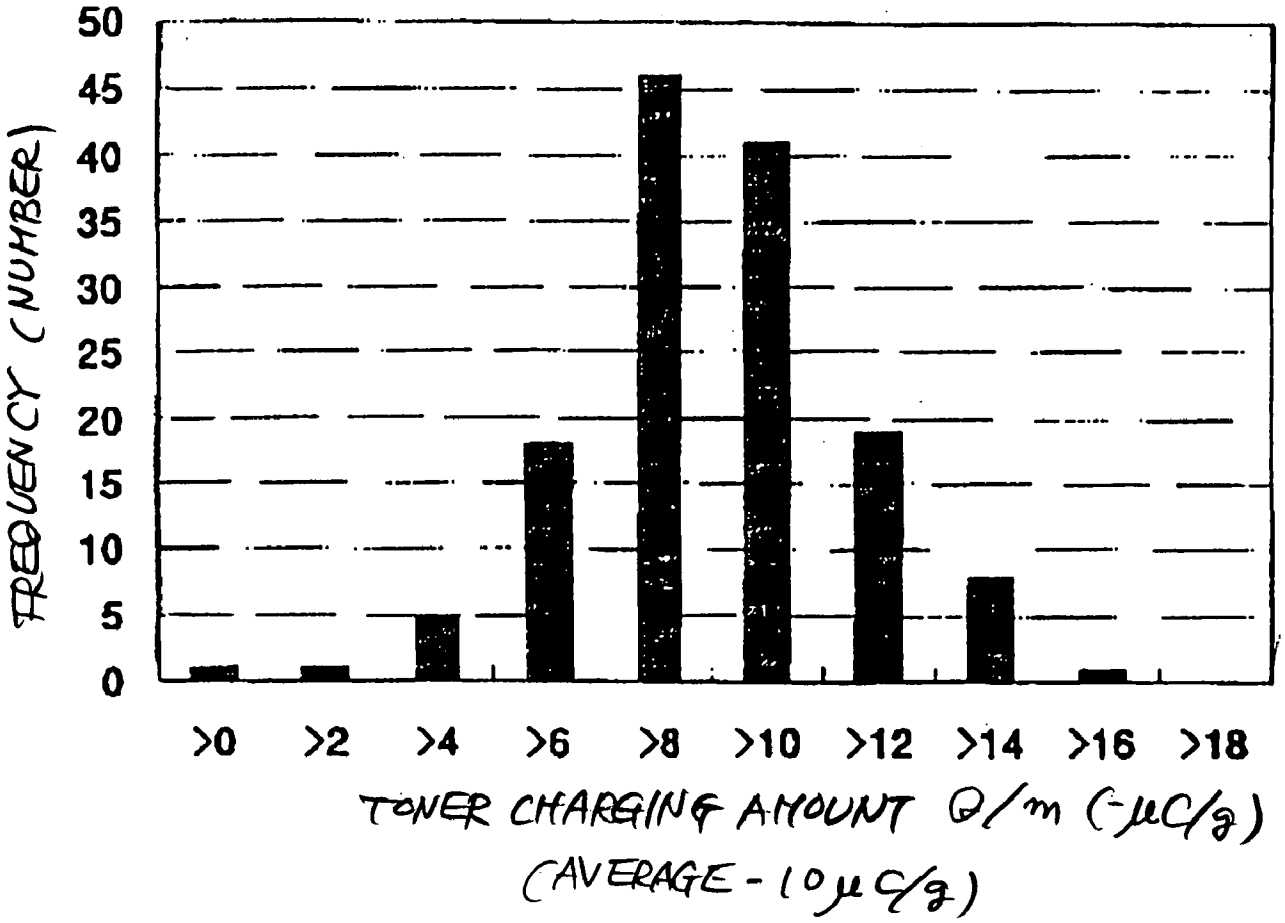
FIG. 59 is a diagram showing a distribution of a charging amount Q/m of the toner used in a simulation.

A distribution of particle diameters (radii) and a distribution of a charging amount Q/m of the toner used in the simulation described above are shown in FIGS. 58 and 59, respectively. Those distributions are examples based upon conventional actual measurement values of toner.

Figure 60:
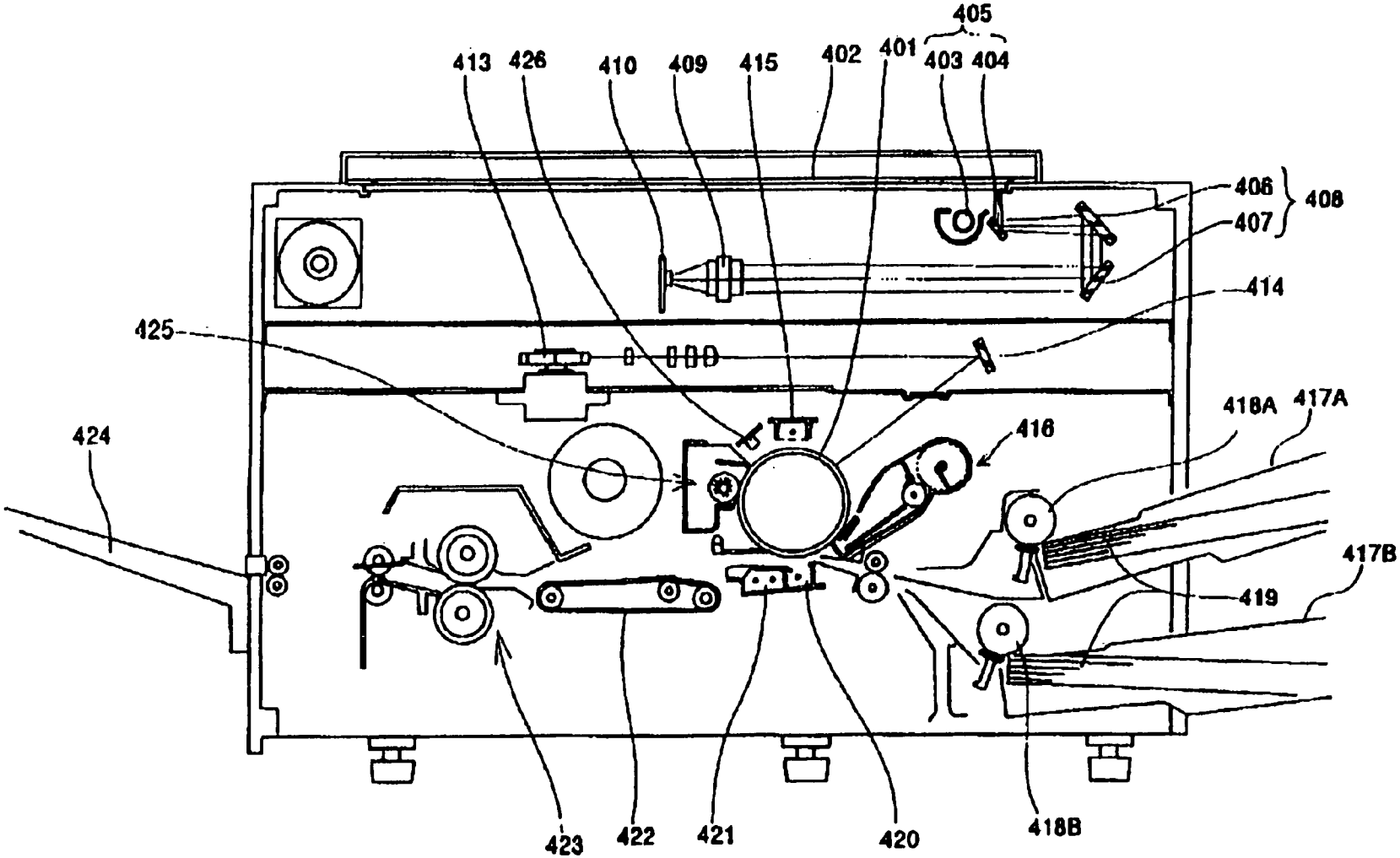
FIG. 60 is a schematic diagram showing a structure of a copying machine in accordance with this embodiment.

FIG. 60 shows a schematic structure showing the copying machine of the present invention. As shown, a scanner apparatus is provided in an upper part of a main body of this copying machine. When an original document is placed on a contact glass 402 of the scanner apparatus and a copy start switch (not shown) is pressed, reading of the original document starts. In detail, both of scanning optical system 405 including a light source 403 for illuminating the original document and a scanning optical system 408 including mirrors 406 and 407 move to optically scan the original document. Then, the original document is read as image signal by an image reading element 410 arranged behind the lens 409, and the read image signal digitized to be changed to a digital image signal. The digital signal drives a laser diode (LD) which is not shown, to emit a laser beam.

This laser beam is applied to a photosensitive member or drum 401 via polygon mirror and a mirror 414 to scan the photosensitive drum 401 in a main-scanning direction while being reflected by the polygon mirror 413. Prior to scanning, the photosensitive drum 401 is uniformly charged by a charging device 415 while being driven to rotate clockwise in FIG. 60 by driving means (not shown). Then, after the photosensitive drum 401 is scanned by the laser beam, an electrostatic latent image is formed on the surface of the photosensitive drum 401. This electrostatic latent is developed by a developing device 416 so that a toner image is formed.

A charger unit 415 is disposed above the photosensitive drum 401 in FIG. 60. Two paper supply means 417A and 417B are disposed on the left side of the photosensitive drum 401 and stack transfer papers serving as recording media in cassettes thereof. When a copying operation starts, a paper feeding roller 418A or 418B of one of the paper supply means 417A and 417B is driven to pick up a transfer paper of a size and a posture corresponding to image information at the top of the transfer papers stacked on the cassette and feed to a supply path. A registration roller pair is disposed on the most downstream side of the paper supply path to receive the transfer paper from the paper supply means. The registration roller pair function to feed the transfer paper between the photosensitive member 401 and a transfer charger 420 at timing for registration between transfer paper and the toner image on the photosensitive drum 401 which is to be transferred to the image portion of the transfer paper.

The toner image on the photosensitive drum 401 is electrostatically transferred onto the transfer paper by corona discharge emitted by a transfer charger 420. Then, the transfer paper is separated from the photosensitive drum 401 by a separation charger 421 and fed to a fixing device 423 through a conveyor belt 422. The fixing device 423 nips the transfer paper by a heating roller and a pressurizing roller and fixes the toner image on the transfer paper with heat and pressure. The transfer paper with the toner image is discharged from the fixing device 423 through discharge rollers and stacked on a discharge tray.

A residual toner remaining on the surface of the photosensitive drum 401 after transferring the toner image to the paper is removed by a cleaning device 425. The surface of the photosensitive drum 401 cleaned in this way is charged by a discharge 426 to be initialized.

Next, a characteristic structure of the copying machine of the present invention will be described.

Figure 61:
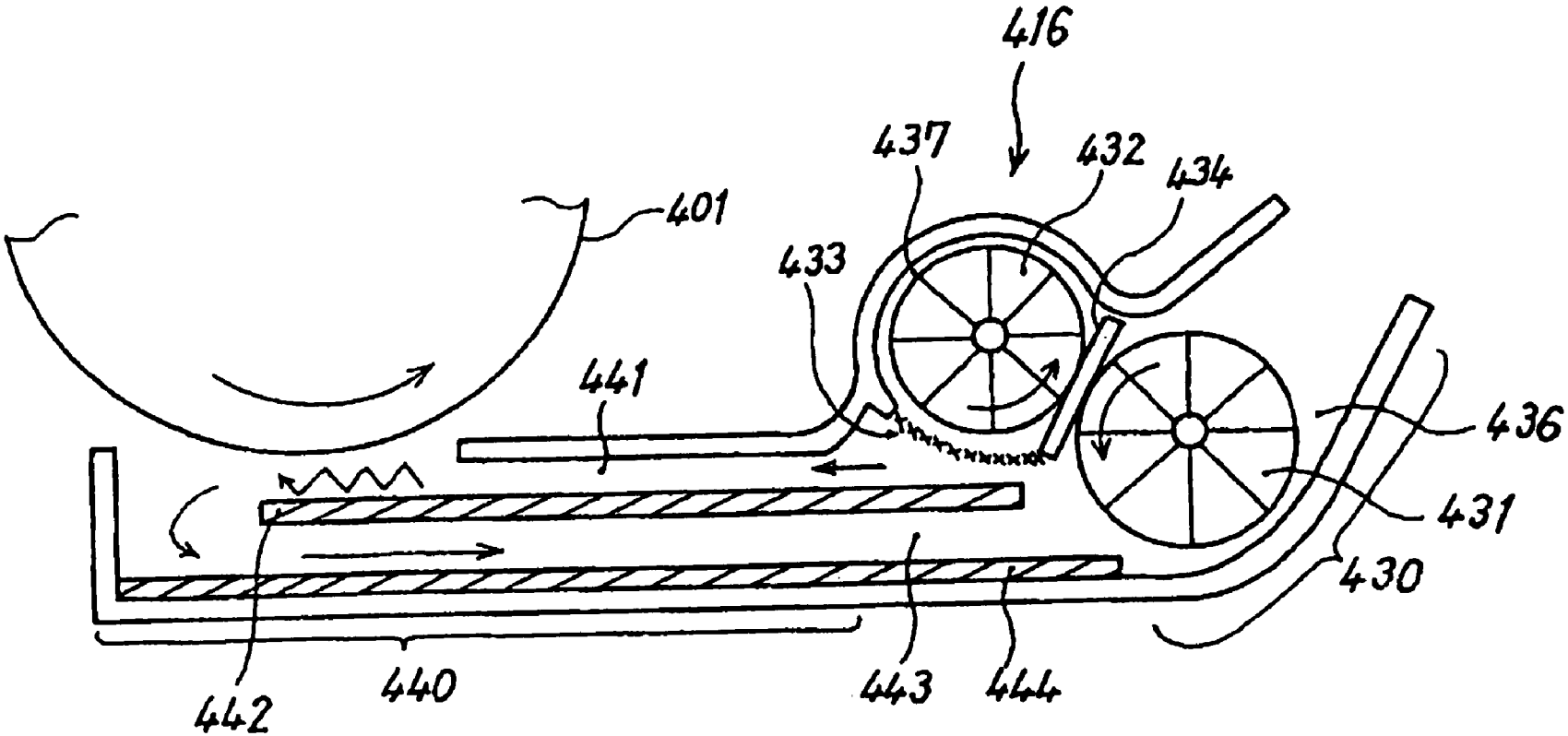
FIG. 61 is a schematic diagram showing a structure of a developing device of the copying machine.

FIG. 61 shows a structure of a principal portion of the developing device 416 and the photosensitive member or drum 401. The developing device 416 includes a toner supply section 430 accommodating a mixture of toner and a charge facilitating material, and a toner transport section 440 for carrying toner tp the developing position.

Figure 62:
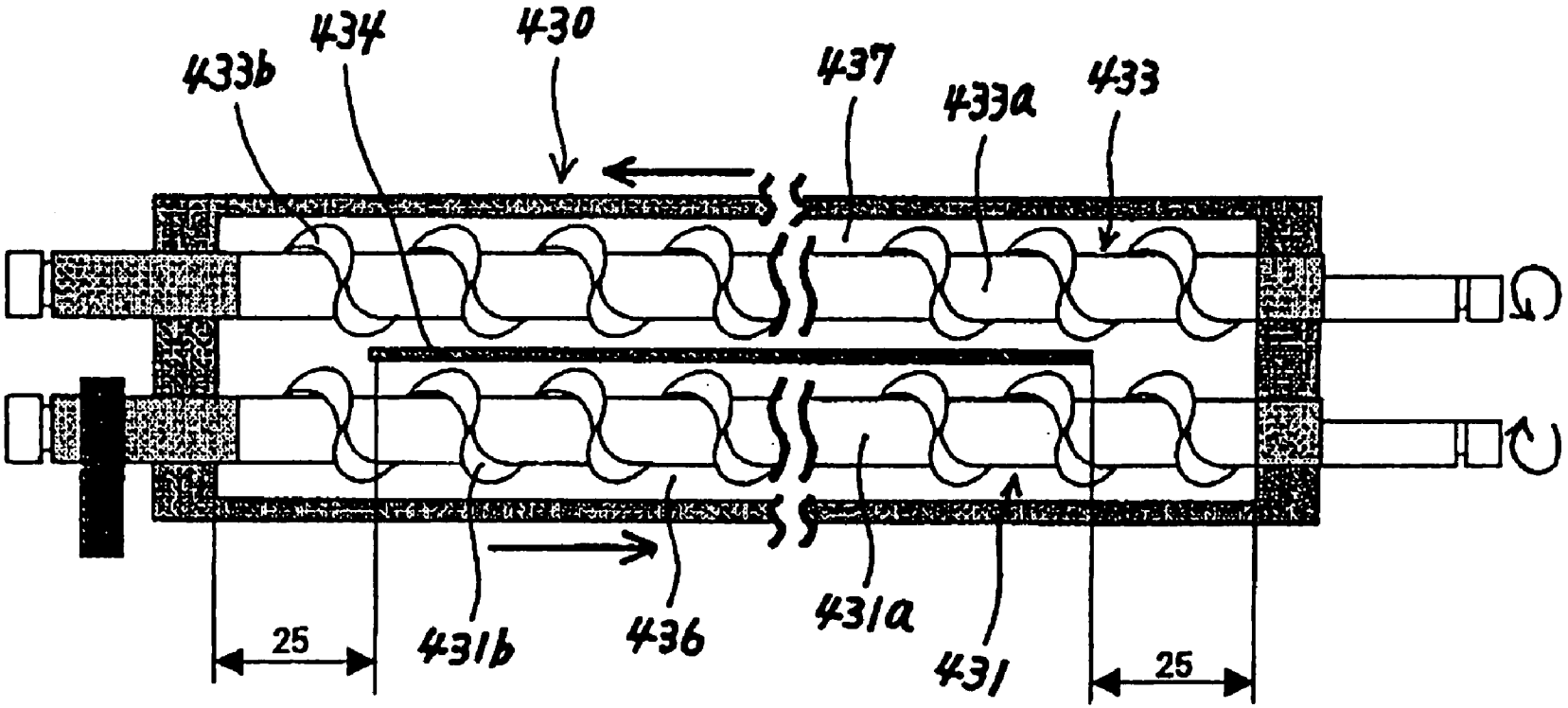
FIG. 62 is a plan sectional view showing a structure of a toner supply portion of the developing device.
Figure 63:
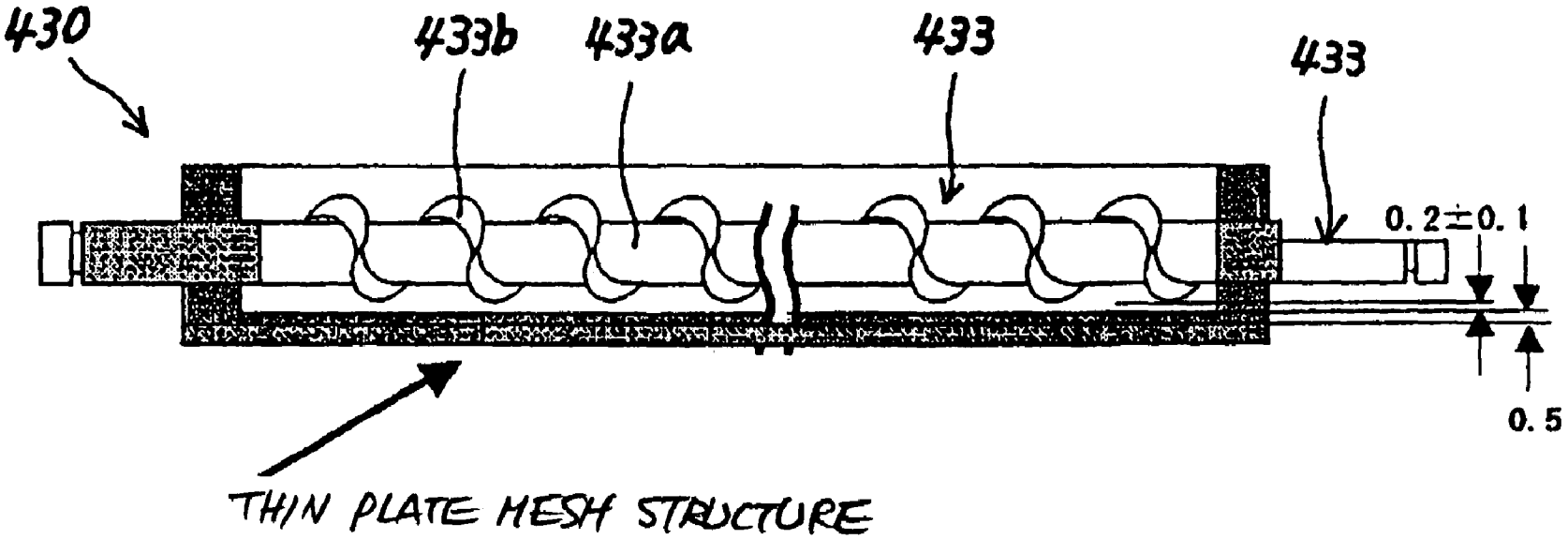
FIG. 63 is a longitudinal sectional view showing a structure of the toner supply portion.
Figure 64:
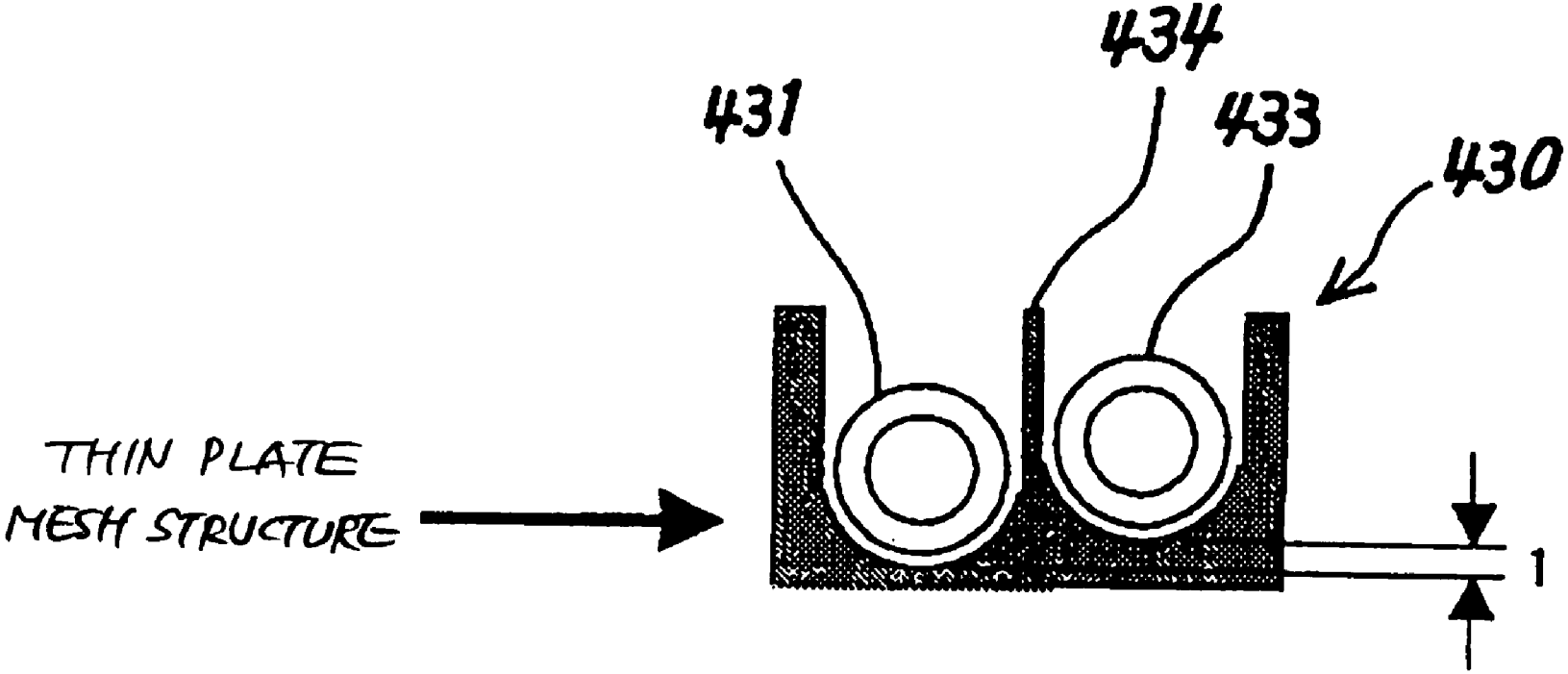
FIG. 64 is a transverse sectional view showing a structure of the toner supply portion.

FIGS. 62 to 64 show a structure of the toner supply section 430. As shown, the toner supply section 430 is partitioned into two chambers such as a first receiving chamber 436 and a second receiving chamber 437 by a partition wall 434. The first receiving chamber 436 and the second receiving chamber 437 are provided with a first transport screw 431 and a second transport screw 432, as rotating members, respectively. The transport screws are structured such that spiral projections 431*b* and 433*b* are protrudingly provided on surfaces of rotation shafts 431*a* and 433*a*, respectively. In the vicinity of both ends of the toner supply section 430, there are communicating spaces in which the partition wall 434 is not provided over a length L2 (e.g., 25 mm). The two receiving chambers 436 and 437 communicate with each other here.

As shown in FIG. 62, the first transport screw 431 is driven to rotate by a screw drive system (not shown) to thereby agitate and transport the mixture received in the first receiving chamber 436 from the left side to the right side in FIG. 2. The mixture, which has been transferred to a communication space 25 formed on the right side in FIG. 62 enters the second receiving chamber 437. Then, the mixture is transported from the right side to the left side in FIG. 62 by the second transport screw 434 which is driven to rotate by the screw drive system. Subsequently, when the mixture is transported to the communication space 25 formed on the left side in FIG. 62, the mixture returns to the first receiving chamber 436. In this way, in the toner supply section 430, the mixture circulates counterclockwise in FIG. 62 while being agitated and transported.

Not shown toner concentration detecting device is disposed in the first receiving chamber 436 for detecting a toner concentration of the mixture to output a toner concentration signal to a toner replenishing control device through these devices are not shown in FIG. 62. The control device controls a toner replenishing device (not shown) in response to the toner concentration signal to replenish the first receiving chamber 436 with an appropriate amount of toner. Accordingly, the toner concentration of the mixture in the toner supply section 430 is maintained in a predetermined range. The toner replenished anew in the first receiving chamber 436 is taken into the mixture and, then, rubbed by a friction facilitating material and frictionally charged.

It is desirable that a predetermined gap is formed between a tip of the spiral projection 433*b* of the second transport screw 432 and a mesh 433. A value of the gap is about ⅕ to 10 times a diameter of the toner. In addition, the gap is desirably about ⅓ to 2 times a carrier diameter because replacement efficiency and mixing and agitating efficiency of the mixture are improved. Moreover, toner cloud can be satisfactorily generated in gaps among friction facilitating particles.

As shown in FIG. 61, the mesh 433 is provided at the bottom of the first receiving chamber 436. In the first receiving chamber 436, the toner is sufficiently charged in the mixture which is agitated and transported in a screw axis direction. Then, when the mixture passes over the mesh 433, the toner is separated from the mixture and dropped in the toner transport section 440 by a sieving function of the mesh 433.

A metal material is used for the mesh 433. Further, a potential difference is provided between the mesh 433 and the electrostatic transport substrate 442 by potential difference generating means such as bias applying means. An electric field for electrostatically moving the toner from the side of the mesh 433 to the side of the transport substrate is formed owing to the potential difference. Accordingly, separation of the toner from the mixture in the second receiving chamber 437 and discharge of the toner from holes of the mesh 433 are facilitated so that and improvement in toner supply efficiency is realized.

An electrode member may be provided between the mesh 433 and the electrostatic transport substrate for applying a bias to the electrode member and the mesh 433 to facilitate discharge of the toner. In this case, the toner can be electrostatically moved stepwise from the mesh 433 to the electrode member and from the electrode member to the electrostatic transport 442. Accordingly, a low bias electric field can be realized to generate toner cloud satisfactorily so as to prevent damage to the toner and the electrostatic transport substrate 442. When an alternating-current bias or a pulse bias is applied between a plate of the mesh 433 and the electrode member, the toner can be reciprocatingly vibrated and prevent the toner from adhering to the mesh 433, the electrode member, and the electrostatic transport substrate 442. The the electrode member may be constituted by a wire, plural parallel wires, or a mesh-like electrode.

In addition, vibration generating means such as an ultrasonic vibrator for vibrating the mesh 433 may be provided to facilitate discharge of the toner, with the result that the toner is prevented from being adhered to the mesh 33 in which the toner in the second receiving chamber 437 is attracted to the mesh 433 strongly with an electrostatic force. It is sufficient to set a vibration period to about 5 to 60 kHz. The vibration generating means may be constituted by means for driving the toner mechanically, means using a magnetic coil, and means according to electrostriction. All of the means can prevent clogging of the mesh 433 with the vibration of the friction facilitating material or the toner.

The toner transport section 440 has a double structure which consists of a transfer portion 441 using the electrostatic transport substrate 442 as a bottom plate and a collection portion 443 using an electrostatic transport substrate 444 as a bottom plate below the transfer portion 441 in the direction of gravity. The toner, passed through the mesh 433 and dropped into the toner transport section 440 is supplied to a surface of the electrostatic transport substrate 442. Then, the toner is carried from the right side to the left side in FIG. 61 while being hopped by the ETH phenomenon and develops the electrostatic latent image on the photosensitive member or drum 401 the developing area facing the photosensitive drum 401. The toner which has not contributed to the development but passed the developing area, drops out from an end of the electrostatic transport substrate 442 to be supplied to the surface of the electrostatic transport substrate 444 of the collection portion 443. Then, the toner is carried from the left side to the right side in FIG. 61 while being hopped this time and returned to the first receiving chamber 436 of the toner supply section 430. Accordingly, the toner, which has not contributed to the development, is recycled.

In the toner supply section 430 of such a structure, the agitating and transporting means for agitating and transporting toner and the friction facilitating material is constituted by the first transport screw 431, the second transport screw 432, a rotation drive system for driving to rotate these screws and the like. In addition, the collection section 443 functions as recycle means for recycling the toner by returning the toner, which has passed the developing area without contributing to the development on the surface of the electrostatic transport substrate 442, to the first receiving chamber 436 . Accordingly, wasteful disposal of the toner can be controlled.

In addition, discharge facilitating means for facilitating discharge of the toner from the holes of the mesh 433 is constituted by the metal mesh 433, the electrostatic transport substrate 442, the potential difference generating means for generating a potential difference between the mesh 433 and the electrostatic transport substrate 442, and the like. It is desirable to cause the discharge facilitating means to function at least when the toner is carried by the electrostatic transport member 442. Accordingly, an adverse influence on an image quality due to fluctuation in an amount of toner supply can be avoided.

Figure 65A:
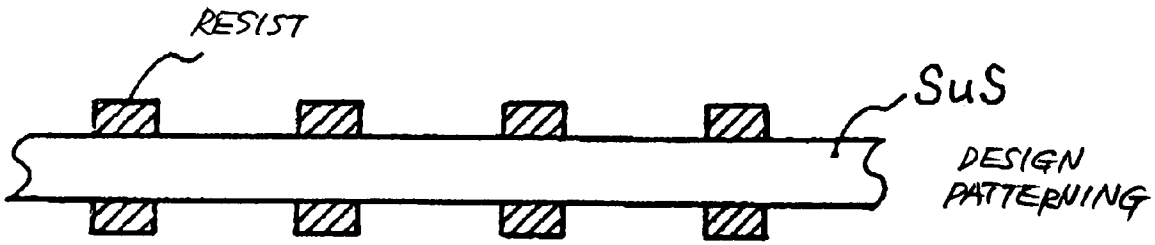
FIGS. 65A to 65C are diagrams for explaining a mesh formation process.
Figure 65B:
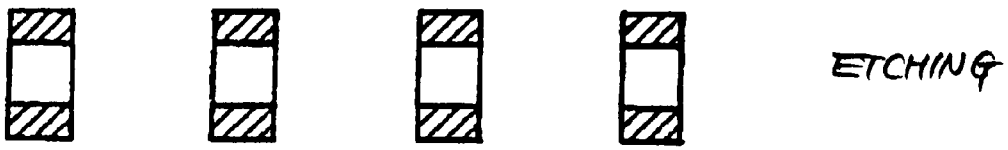
Figure 65C:
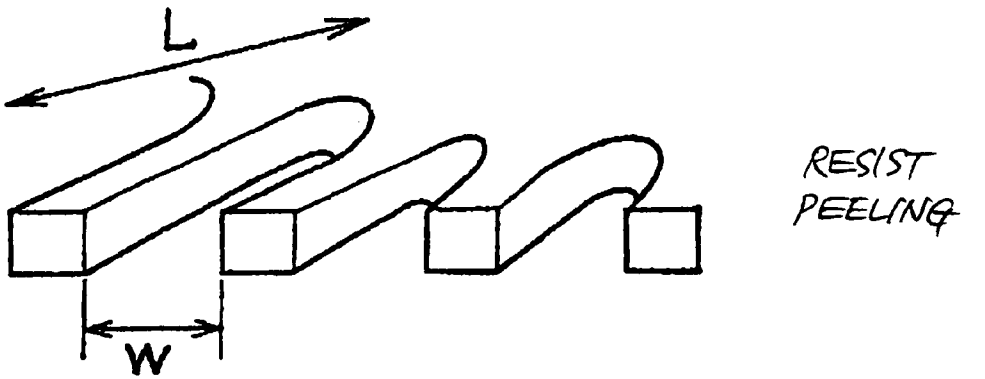

The mesh 433 consists of a metal material and is formed easily and inexpensively by etching, electroforming, or the like of a metal film (plate). FIGS. 65A to 65C shows a mesh formation process by etching. First, as shown in FIG. 65A, a pattern of designed holes, is obtained by applying micromachining of laser processing to a metal film such as SUS, is formed of a resist. Next, as shown in FIG. 65B, holes are formed by performing etching with $FeCl_3$ or the like. Moreover, as shown in FIG. 65C, the resist is peeled to complete the mesh 433.

Figures 66A, 66B, 66C:
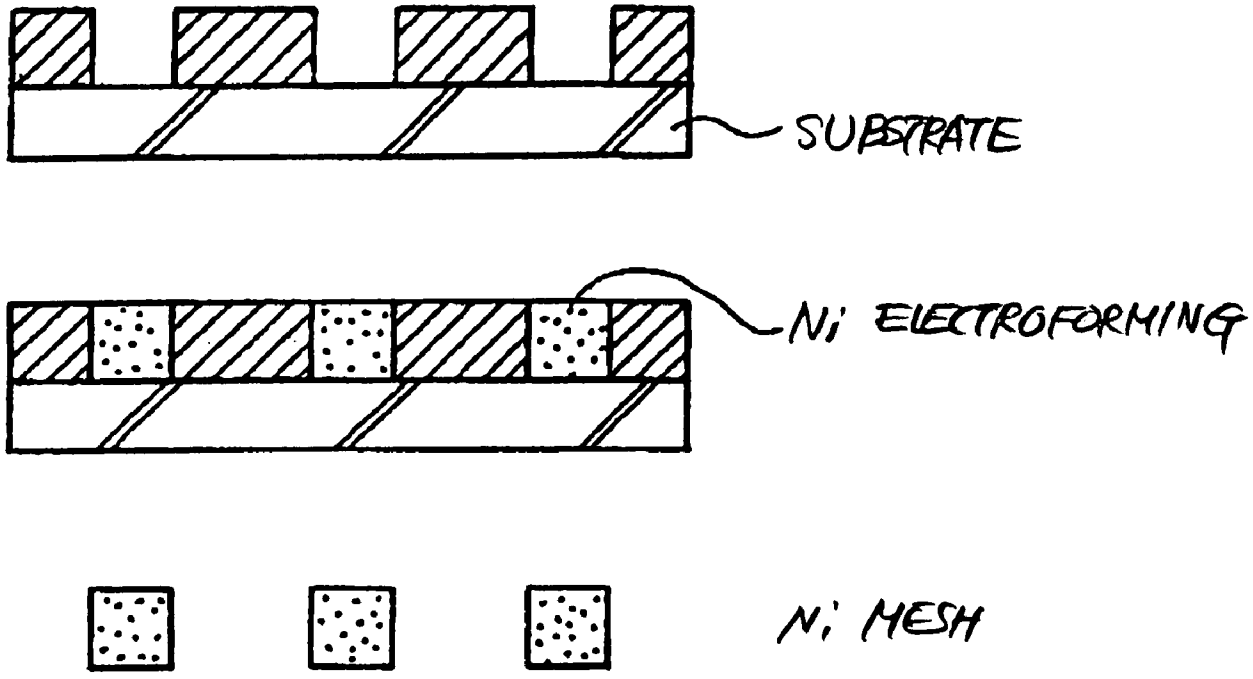
FIGS. 66A to 66C are diagrams for explaining mesh formation by electro-forming.

It is sufficient to perform the mesh formation by electroforming according to a process as shown in FIGS. 66A and 66B. In addition, a weaving formation process for a thin line wire is also possible.

The mesh 43 may be constituted by a material which desirably shows flexibility and friction durability. Circular, elliptical, square, rectangular, star, and deformed shapes can be adopted as a shape of the holes of the mesh 433. According to the present invention, as shown in FIG. 65C, the holes of the mesh 433 has an elliptical shape, a size of an opening in a longitudinal direction thereof is set to a length L of the holes, and a size of an opening in a latitudinal direction is set to a width W of the holes.

It is desirable that the thickness T of the mesh 433 be set in the range of 20 to 150 μm, more preferably 30 to 80 μm. In this case, it is preferable that a relation among the thickness T, the length L, and the width W be in the range of $500W \geqq L$ and $W/5 \leqq T \leqq 3W$. This is because, if the length L and the width W of the hole have a relation $500W \geqq L$, the mesh 433 can secure both rigidity as a metal film and a hole shape. In addition, this is because, if the width W and the thickness T have a relation $W/5 \leqq T \leqq 3W$, planarity as a metal film and curvature processing can be secured.

It is desirable to set an open area ratio of the mesh 433 in the range of 20 to 70%. This is because it was experimentally confirmed that, when an entire image to be developed is black, in order to secure a discharge amount of the mesh without unevenness, the open area ratio has to be set in such a range.

Figure 67A:
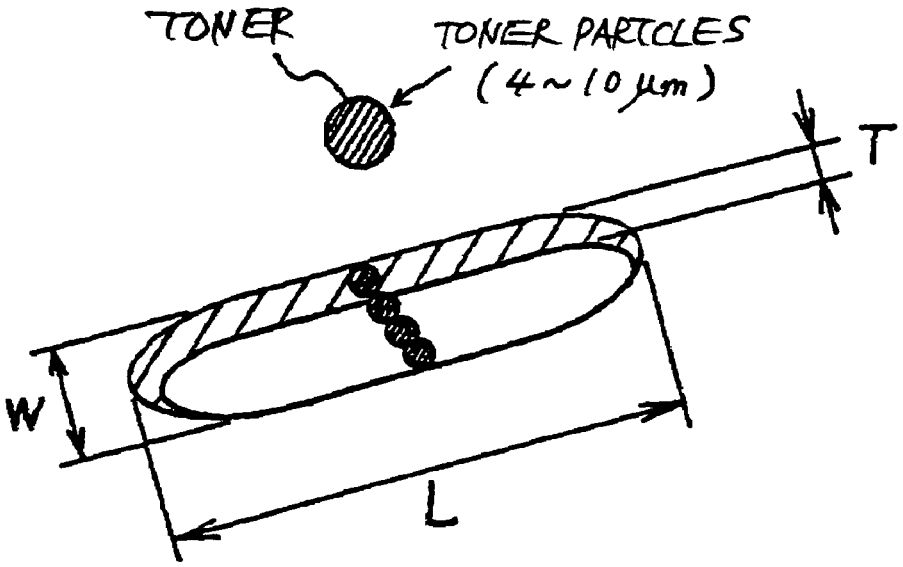
FIG. 67A is a diagram for explaining a relation between a hole of a mesh and an average particle diameter r of toner particles.
Figure 67B:
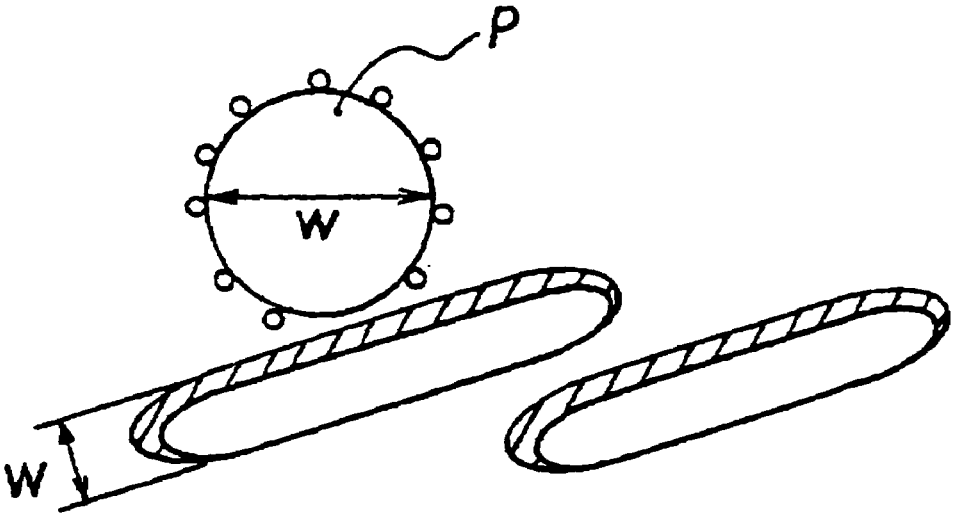
FIG. 67B is a diagram for explaining a relation between the hole of the mesh and an average particle diameter R of carrier particles.

As described above, the holes of the mesh 443 must be larger than an average particle diameter r of the toner and smaller than an average particle diameter R of the friction facilitating particles P. Moreover, as shown in FIGS. 67A and 67B, it is preferable to set the width W so as to satisfy relations $6r \geqq W$ and $2W \leqq R$. By setting the width W so as to satisfy a relation $6r \geqq W$ with respect to the average particle diameter r of the toner, clogging of the mesh due to cloud-like toner hardly occurs, and the toner can be easily discharged continuously through the holes of the mesh 433. In addition, by setting the width W so as to satisfy a relation $2W \leqq R$ with respect to the average particle diameter R of the friction facilitating particles P, a margin is given to the width W such that the friction facilitating particles P do not pass through the holes of the mesh 433 even if the friction facilitating particles P are worn and reduced in diameter owing to a particle diameter distribution of the friction facilitating particles P and continuous use.

Figure 68:
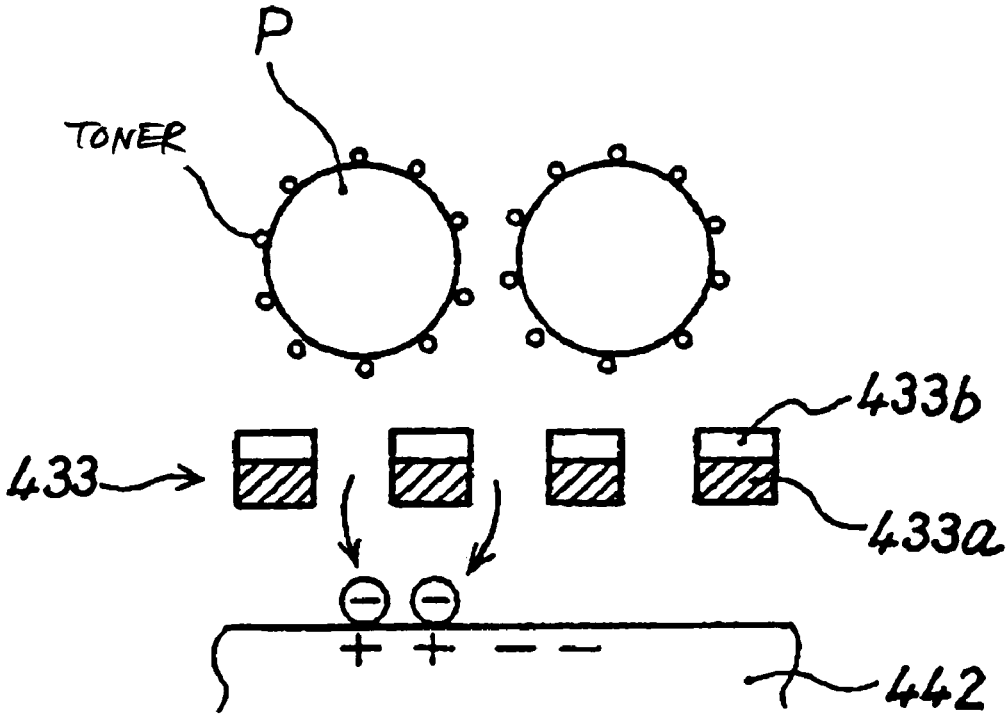
FIG. 68 is a diagram showing a structure of another mesh.

In addition, as shown in FIG. 68, the mesh 433 may have a double structure in which the surface facing the electrostatic transport substrate 442 is made of a metal material 433*a* and the contact surface with the mixture is made of an organic resin 433*b*. In the mesh 433 of such a structure, the part in contact with the friction facilitating particles P is made of an organic material. As a result, damage due to friction against the friction facilitating particles P is small compared with the metal material, and durability of the mesh 433 can be improved.

Figure 69:
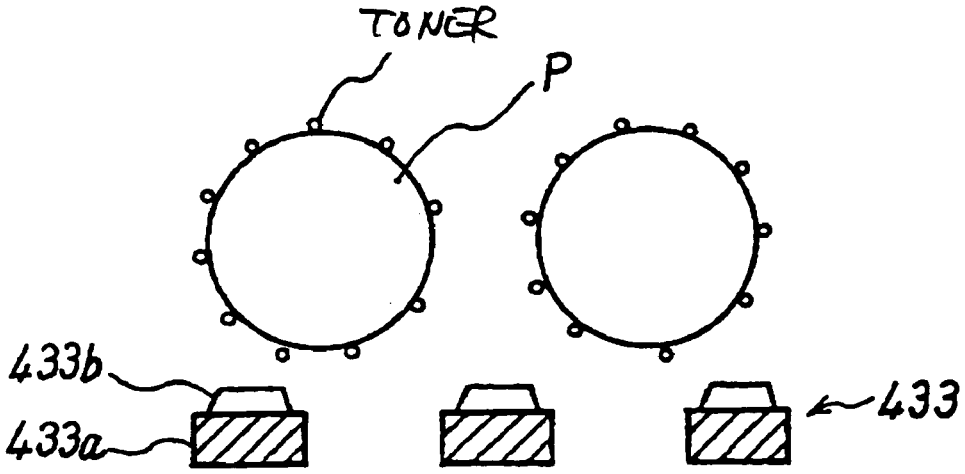
FIG. 69 is a diagram showing a structure of yet another mesh.

Moreover, as shown in FIG. 69, hole inlets made of the organic material are formed in manner as to be larger than hole outlets made of the metal material. By forming the outlet side with metal, a bias effect to be described later can be improved.

Figure 70:
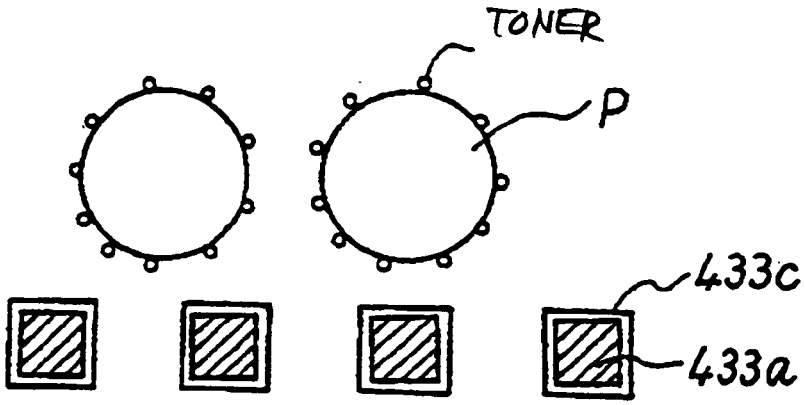
FIG. 70 is a diagram showing a structure of yet another mesh.

As shown in FIG. 70, the mesh 433 may be formed such that a base is made of the metal material 433*a*, and a surface in contact with the toner is entirely covered with an insulating protective film 433*c*. This protective film 433*c* is a thin film with a thickness of 0.5 to 30 μm such that deterioration of an electric field intensity is not caused and is made of a material such as $SiO_2$, SiN, $Ta_2O_5$, or polyimide. In the mesh 433 of such a structure, the surface in contact with the charged toner is entirely covered with the insulating protective film 433*c* so that injection of charges from the metal material portion 433*a* to the toner can be eliminated, and a charging amount can be kept at a proper amount. In addition, the metal material portion 433*a* and the toner do not come into contact with each other, so that deterioration of a developer can be reduced compared with a mesh in which toner is in contact with a metal portion.

Figure 71:
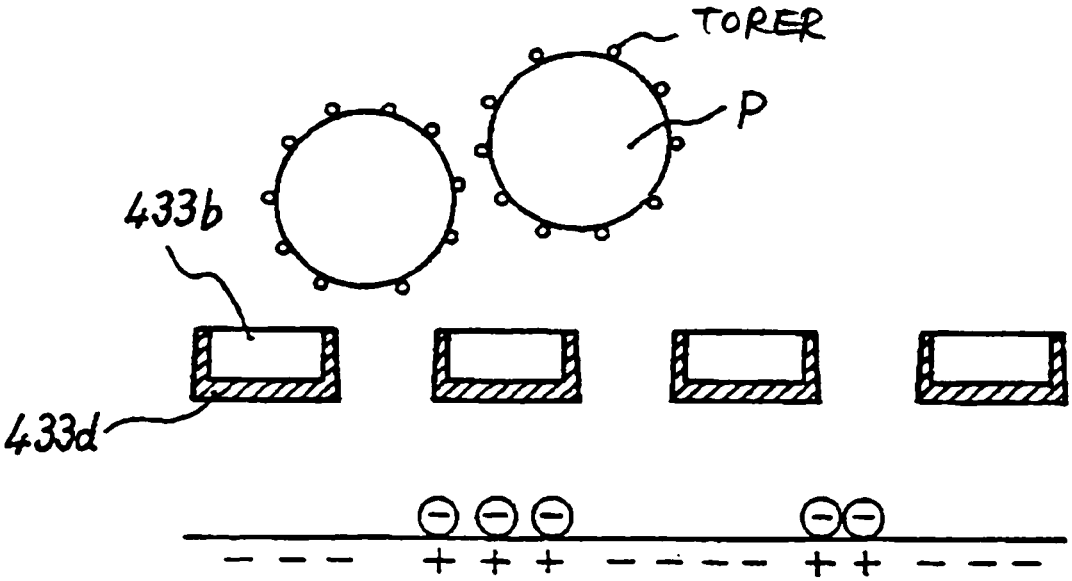
FIG. 71 is a diagram showing a structure of yet another mesh.

In addition, as shown in FIG. 71, the mesh 433 may be formed such that the organic resin material 433*b* is used as a base, and a metal film 433*d* may be formed with a metal material by vapor deposition or electroforming on an external surface of the base. The organic resin material 433*b* preferably has a high charging capability for charging the toner. Further, the metal film 433*b* is a thin film with a thickness of 0.5 to 5 μm. A bias voltage is applied to the part of the metal film 433*d* for forming an electric field, in which the charged toner in the mesh 433 is directed to the outside through the holes of the mesh 433. Because the base is the organic resin material 433*b*, the mesh 433 of such a structure is excellent in flexibility and elasticity and has a large shape stability. Therefore, even though a force is applied thereto from the outside, a shape thereof can be kept stably. In addition, contact between the mesh 433 and the toner therein can facilitate charging of the toner. Further, a bias voltage applied to the metal film portion 433*d* on the outside of the mesh 433 can improve a bias effect. Thus, discharge efficiency of the toner can be improved.

Figure 72:
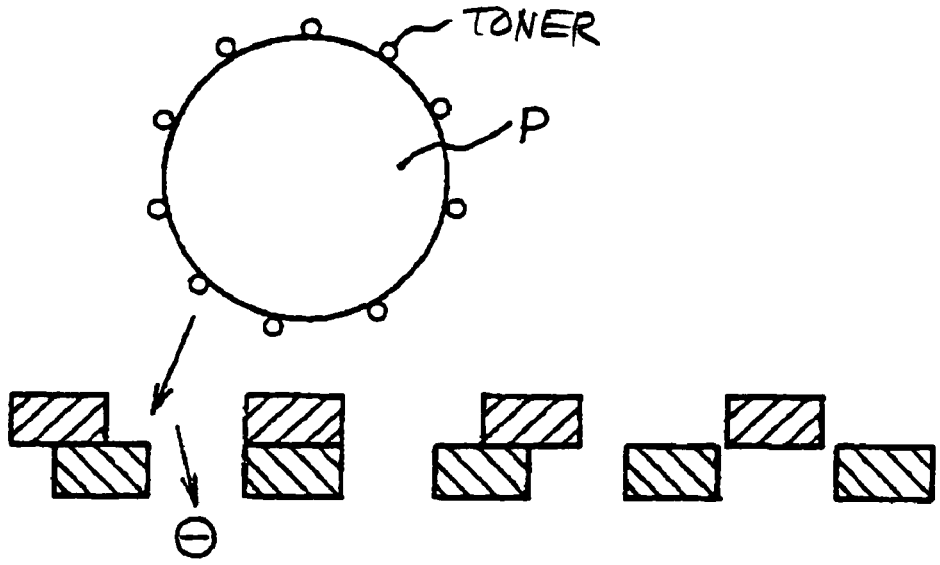
FIG. 72 is a diagram showing a structure of yet another mesh.

In addition, as shown in FIG. 72, the mesh 433 may be formed by sticking a mesh consisting of an organic resin material to a mesh consisting of a metal material. The organic resin material preferably has a high charging capability for charging the toner. The meshes are stuck by heating and jointing or hot-press. The mesh consisting of the organic resin material has shape restoration because of its flexibility and elasticity. In addition, it is assumed that holes of the mesh consisting of the organic material are equal to or larger than holes of the mesh consisting of the metal material and are equal to or smaller than half an average particle diameter of the friction facilitating particles P. Accordingly, the mesh of the metal material exposes over the mesh of the organic material. With this exposure, a bias effect by a bias voltage applied to the mesh of the metal material can be improved. Thus, discharge efficiency of the toner can be improved.

Figure 73:
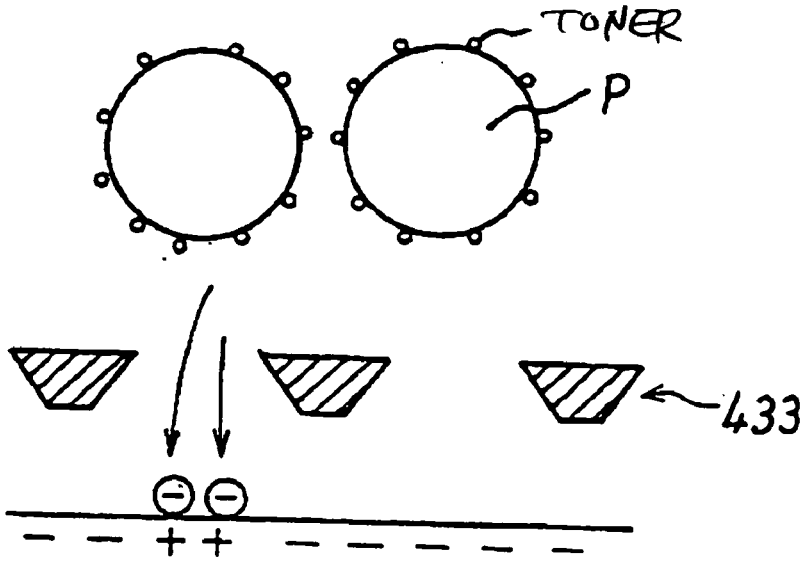
FIG. 73 is a diagram showing a structure of yet another mesh.

In addition, as shown in FIG. 73, the mesh 433 may be formed in a shape in which there is inclination and a hole diameter expands toward the external surface. As a size of the holes, as described above, the relation among the length L, width W, and thickness T of the mesh is in the range of $500W \geqq L$ and $W/5 \leqq T \leqq 3W$, and the relation between the width W and the average particle diameter r of toner 48 and the average particle diameter R of the friction facilitating particles P is in the range of $6r \geqq W$ and $2W/R$. In this way, the inclination toward the external surface in the mesh 433 can prevent adhesion of the toner inside the hole and improve a bias effect of an opening portion and development efficiency.

In this copying machine and the developing device 416, a desirable toner which satisfies predetermined requirements is designated as toner suitable for use. This designation can be performed by, for example, shipping the copying machine and the developing device 416 with the designated toner. In addition, for example, designated toner together with a main body of the copying machine and the developing device 416. Further, for example, the designation may be performed by specifying the product number, product name, or the like of the designated toner on the main body of the copying machine, the developing device, a user's manual for the copying machine and the developing device, and the like. Moreover, for example, the designation maybe performed by notifying a user of the requirements, the product number, the product name, and the like with a letter, electronic data, or the like.

A smallest diameter portion of the holes of the mesh 433 is set to a size allowing 80% or more toner particles to pass through the holes with respect to a particle diameter distribution of the toner designated in this way. Thus, most of the toner particles in the mixture can be supplied to the electrostatic tgransport substrate. It is desirable to set a size of the smallest diameter portion of the holes to a value which makes a toner passage ratio lower than 100%. This is because passage of relatively large toner particles is prevented to a certain degree to sharpen a particle diameter distribution of the toner which contributes to the development so that stable development capability can be obtained.

In addition, in this copying machine and the developing device 416, designated as the friction facilitating material suitable for use is a material mainly composed of friction facilitating particles consisting of a nonmagnetic material. It is sufficient to perform this designation in the same manner as in the toner. In general, a nonmagnetic material is easily granulated compared with a magnetic material, and reduction in diameter and sharpening of a particle diameter distribution are also easy for the nonmagnetic material. Thus, it becomes possible to cause the friction facilitating material to show stable friction charging performance. In addition, reduction in manufacturing costs can also be expected. The nonmagnetic material to be used may be an organic material or a non-organic material depending upon charging performance. In the case in which a material of a negative charging property is used as the toner, a material such as quartz ($SiO_2$), glass, a polyacrylic resin, polyamide, a nylon resin, or a melamine resin can be applied as a nonmagnetic material of a positive charging property. In addition, in the case in which a material of a positive charging property is used as the toner, a material such as Teflon (registered trademark) resin, ploy-chlorinated resin, or polyethylene resin can be applied as a nonmagnetic material of a negative charging property. Because those materials do not require magnetic field control, the materials can function as carrier materials which are simple and have high durability.

A smallest diameter portion of the holes of the mesh 433 is set to a size which prevents passage of 80% or more toner particles with respect to a particle diameter distribution of the friction facilitating material mainly composed of the friction facilitating particles consisting of the nonmagnetic material designated as described above. Thus, most of the toner particles in the mixture can be retained in the toner supply section 430. It is desirable to set a size of the smallest diameter portion of the holes to a value which makes a friction facilitating material passage ratio lower than 100%. This is because of a reason described below. That is, in the toner supply section 430, the friction facilitating particles are reduced in size by friction over time following agitation and carrying of the mixture. A new friction facilitating material is replenished periodically while the friction facilitating particles, which have been reduced in size to some extent, are passed through the holes over time, so that stable toner charging property can be maintained. Because the friction facilitating particles are charged in a polarity opposite to that of the toner, when the friction facilitating particles are supplied to the surface of the electrostatic transport substrate 442 through the holes, the friction facilitating particles are carried in the direction opposite to a direction of the toner on the surface. Thus, it is extremely rare that the friction facilitating particles are carried to the developing area. Usually, the friction facilitating particles are crushed by hopping over time while building up in the vicinity of the toner supply section 430. Although it is conceivable that a part of particulates after the crushing is carried toward the developing area, the particulates are very fine. Thus, the particulates are less likely to adversely affect an image quality.

As described above, the holes of the mesh 433 are formed in an elliptical shape which is of an eccentric shape and has a long diameter portion and a short diameter portion. In the mesh 433 having such holes, an open area ratio can be easily adjusted to the range of 20 to 80% by devising an arrangement and a pitch of the holes. It is desirable to set the open area ratio to 40 to 60% from the view point of rigidity and toner separation efficiency of the mesh 433.

Figure 74:
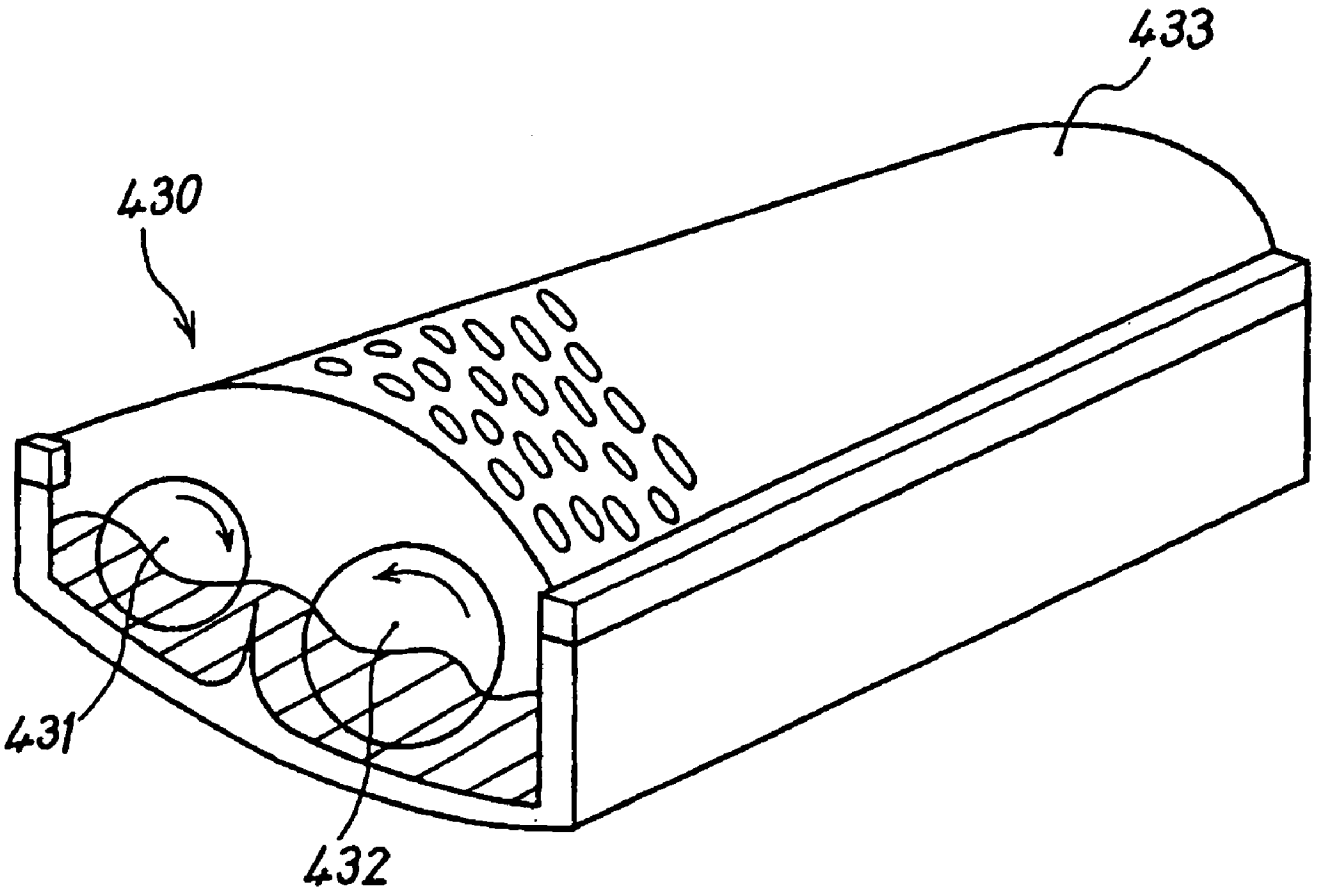
FIG. 74 is a perspective view showing the toner supply portion.

FIG. 74 shows the toner supply section 430 as mentioned above. As shown, the holes of the mesh 433 are disposed in a posture in which a longitudinal direction thereof is along a direction perpendicular to a transport direction of the transport screws 431 and 432 as the agitating and carrying means. With such disposal, bending of the mesh 433 can be avoided while a high open area ratio of the mesh 433 is secured.

Specifically, the inventors have found that, when the elliptical holes are disposed in the above-mentioned posture, bending in a latitudinal direction of the mesh 433 can be avoided compared with the case in which the holes are disposed in a posture in which the longitudinal direction thereof is along the transport direction of the transport screws. This seems to be because a stronger rib structure can be constituted when the former disposal is adopted. The bending in the latitudinal direction occurs owing to the following reason. That is, a mixed material in the toner supply section 430 presses the mesh 433 while being transported in the screw axis direction to thereby follow a linear pressing track extending in the longitudinal direction with respect to the mesh 433. The mesh 433 is easily bent in the latitudinal direction owing to such a linear pressing track. A size in the longitudinal direction of the mesh 433 is about 120 to 300 mm. In addition, a size in the latitudinal direction thereof is about 5 to 20 mm.

As described above, the two transport screws 431 and 432 forming a part of the agitating and transport means, are rotation members which include rotation shafts 431*a* and 432*a* and spiral projections 431*b* and 433*b* protrudingly provided in a spiral shape on surfaces of the rotation shafts 431*a* and 432*a*. Such transport screws can replace old and new mixtures, that is, supplies a new mixture to the position opposed to the mesh 433 while retracting a mixture, from which toner has been consumed in the opposed position, from there by transporting the mixtures in an axial direction while spirally moving the mixtures. Thus, it is possible to avoid a decrease in toner supply performance caused by continuously transporting the mixture, from which the toner has been consumed, in the position opposed to the mesh 433 without retracting the mixture. If a brush made of plural raisings is used as the spiral projections 431*b* and 433*b* instead of a brush made of a rigid material such as metal, agitation efficiency for the mixture can be further improved.

In accordance with present invention, a friction facilitating material mainly composed of friction facilitating particles consisting of a single material, or a friction facilitating material mainly composed of friction facilitating particles consisting of two or more materials may be designated as a friction facilitating material suitable for use.

In the case in which the friction facilitating material mainly composed of friction facilitating particles consisting of a single material is designated, even if the friction facilitating particles are worn over time, a surface material thereof is not changed. Therefore, stable charging performance can be obtained for a long period. It is desirable to use as the single material a material which is excellent in wear resistance and has a constant saturation charging amount and a small charge distribution. Examples of such a material include inorganic materials, which are highly rigid and excellent in charging performance, such as $BaTiO_3.SiO_2$, $Na_2SiQ_3$, $B_2O_3.SiO_2$, $Al_2O_3$, $Si_3N_4$, $TiO_2$, and $ZrO_2$. In addition, the material may be an organic material such as a polyacrylic resin, polyamide, a nylon resin, or a melamine resin. Even if the friction facilitating particles are constituted by a single material, the specific gravity of the particles can be adjusted by adjusting a degree of crystallinity of the material or giving a fine porosity to the material with a sintered compact of an aggregate of microcrystal.

In the case in which the friction facilitating material mainly composed of friction facilitating particles consisting of two or more materials is designated, a frequency of replenishment of the friction facilitating particles can be reduced while excellent charging performance is obtained by a combination of a material excellent in charging property and a material excellent in durability. Examples of a material, which can realize a charging property, durability, an anti-humidity property, and a high specific gravity, include $BaTiO_3.SiO_2$, $Na_2SiO_3$, $B_2O_3.SiO_2$, $Al_2O_3$, $Si_3N_4$, $TiO_2$, and $ZrO_2$. It is sufficient to mix those materials in particles with a diameter of 0.5 to 20 μm at an appropriate ratio, add a binder, and granulate the materials with a spray method or a coagulation method, and then dry and sinter the materials. In addition, it is also possible that the organic material such as a polyacrylic resin, polyamide, a nylon resin, or a melamine resin be mixed at an appropriate ratio in particles with a diameter of 0.5 to 50 μm and an organic solvent or a binder be added, and then the materials be subjected to grain boundary combination with a spray method or a nozzle injection method.

A material mainly composed of friction facilitating particles with a surface layer coated over a core material may be designated as the friction facilitating material suitable for use. The friction facilitating particles are obtained by coating a surface layer over a surface of a core material, for which a specific gravity is made appropriate, using an organic material or an inorganic material having charging performance. Although there is a slight defect in durability, a specific gravity and a charging property can be adjusted easily, so that excellent charging performance can be obtained. In the case in which toner of a negative charging property is used, quartz ($SiO_2$), glass, a polyacrylic resin, polyamide, a nylon resin, a melamine resin, or the like can be used as a surface material of a positive charging property. In addition, in the case in which toner of a positive charging property is used, Teflon (registered trademark) resin, a ploy-chlorinated resin, a polyethylene resin, or the like can be used as a surface material of a negative charging property. The surface layer can be formed of the organic material among those materials by solving the material in a solution or a melt to spay and apply the material on the core material or coating the material on the core material with an immersion method or the like. The thickness of the surface layer is preferably about 1 to 5 μm. It is also possible that a carrier core material be immersed in a suspension, in which a fine particle material made of an inorganic material with a diameter of 0.5 to 15 μm having charging performance is dispersed together with a binder, coated on a surface thereof, and subjected to baking and junction reaction.

Figure 75:
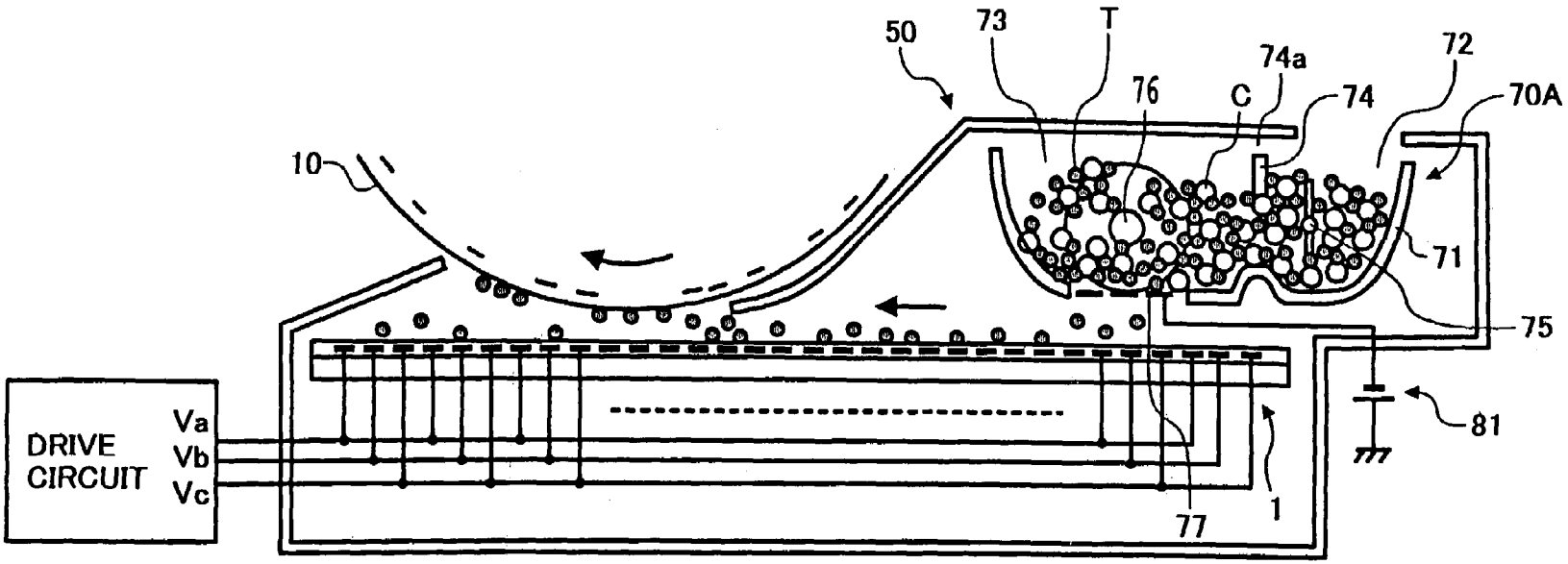
FIG. 75 is a schematic diagram showing a structure of a developing device using a first modification of the toner supply portion.

FIG. 75 shows a structure of a developing device 50 including a toner supply section 70 in accordance with a first modification pf the present invention. As shown, this toner supply portion 70 has a developer container 71 for containing a developer consisting of toner T and a carrier C. This developer container 71 is provided with a toner hopper portion 72, to which toner is supplied from a toner cartridge (not shown), and an agitation tank 73, which agitates and charges the toner T and the carrier C. The toner hopper portion 74 and the agitation tank 73 is partitioned by a partition member 74.

An agitator 75 for agitating and carrying a developer is rotatably arranged in the toner hopper portion 72. In addition, a developer agitating and transport is disposed in the agitgation tank 73 as rotating and agitating means for agitating the toner T and the carrier C carried from the toner hopper portion 72 in manner as to frictionally charge toner T and the carrier C. The screw 76 is arranged so as not to come into contact with an inner wall surface of the developer container 71. In addition, a mesh electrode 77 is arranged on a bottom surface of the agitation tank 73.

Figure 76:
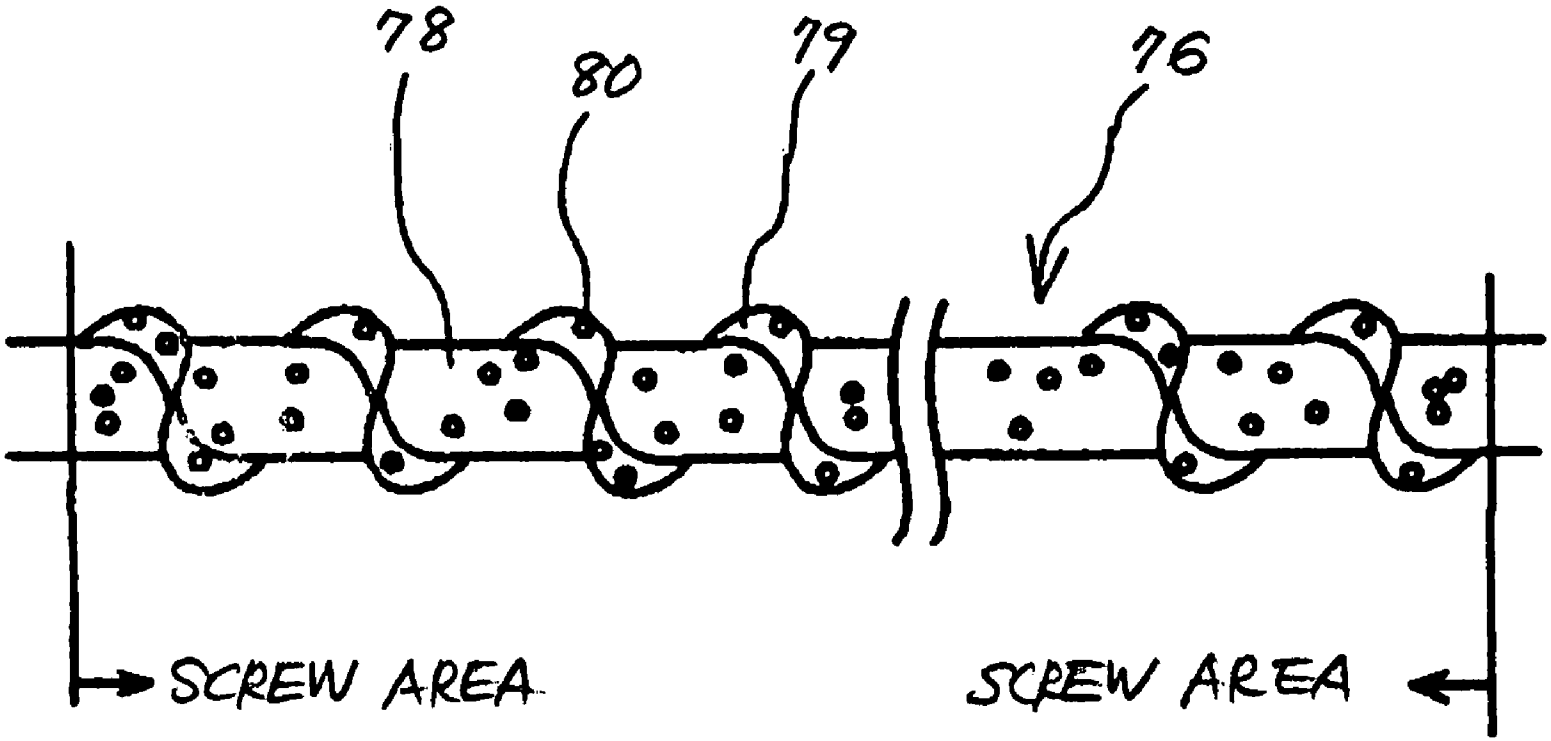
FIG. 76 is a diagram showing a developer agitating and transport screw device of the developing device.

The developer agitating and transport screw 76 supplies fresh toner at one end in a longitudinal direction and uniformly mixes the fresh toner with a circulating developer. As shown in FIG. 76 as well, the developer agitating and transport screw 76 is formed with a spiral screw 79 on a peripheral surface of a main shaft portion 78. Inorganic particulates 80 serving as a charging functional material with respect to the toner T, for example, barium titanate glass powder (average particle diameter: 5 μm) 80 is sprayed to the surface of the screw 76 at high speed to form a film.

Examples of an available material for this developer agitating and transport screw 76 include resin materials such as synthetic resins PE (polyethylene), PC (polycarbonate), PETP (polyethylene terephthalate), PP (polypropylene), and ABS (acrylonitrile-butadien-styrene) and a material of SUS, aluminum, iron, copper, or alloy of these metals. In addition, it is possible to use a material which has a conductive film formed on a surface of the resin material.

A material for this screw must have a small thermal deformation property and must be excellent in heat resistance and adhesion with toner and excellent in dimensional stability and strength. In the resin materials, a resin obtained by reinforcing a resin material with carbon or glass fiber such as aramid is used. Among the resin materials, ABS resin/PC resin (containing 30% of glass fiber) is inexpensive and has thermal stability, and is preferably used.

In the toner supply portion 70 of the modification as described above, toner is supplied from a not-shown toner cartridge (not shown) to the toner hopper portion 72 by a line in a direction from a front side to an inner side in FIG. 75. In this case, a developer consisting of the toner T and the carrier C is mixed and agitated by the agitator 75 rotating in the clockwise direction and fed into the agitation tank 73. Thus, the toner T is charged in the toner hopper portion 72, the toner T is charged to some degree.

Then, the developer agitating and transport screw 76 arranged in the agitation tank 73 is rotated in the clockwise direction, so that the developer is charged while being agitated again. A voltage of the same charge as the toner T is applied to the mesh electrode 77 by a power supply 81. Accordingly, the developer, which has been agitated, charged, and transported to the position of the mesh electrode 77 is applied with the voltage of the same charge as the toner T. The toner T attracted to the peripheral surface of the carrier C is substantially uniformly supplied to a toner electrostatic carrying member 1 arranged in a position facing holes of the mesh electrode 77.

On the other hand, because an opening 74*a* is provided above the partition member 74, a part of the developer is returned from the agitation tank 73 to the toner hopper portion 72 and is agitated to be mixed with fresh toner supplied anew. Thus, mixing and agitation are performed sufficiently.

In this modification, as the spiral screw 76 as shown in FIG. 76, a screw member with a main shaft diameter of 6 mm, a length of 230 mm, and a screw area of 175 mm formed by injecting a melted resin of ABS resin/PC resin containing 30% of glass fiber was used, and a film was formed by spraying inorganic particulates 33 (barium titanate glass powder, average particle diameter: 5 μm) as a charging functional material with respect to the toner, to a surface of the screw at high speed.

Then, this developer agitating and rotating screw 76 was rotated at a peripheral velocity of 60 mm/sec. As a result of visually observing a toner pattern of polymerized toner with an average particle diameter of 7 μm fed from the mesh electrode area of a feeding area 5×100 mm for the toner T, a belt without toner unevenness was able to be identified.

In addition, the structure can be simplified by using the screw member as agitating means, and efficient agitation and charging can be performed by forming the charging functional material on the surface of the screw member.

Next, a toner supply portion 70A in accordance with a second modification will be described with reference to FIG. 77. In this modification, a rotating agitation member 82 is arranged as agitating means in the agitation tank 73.

Figure 78:
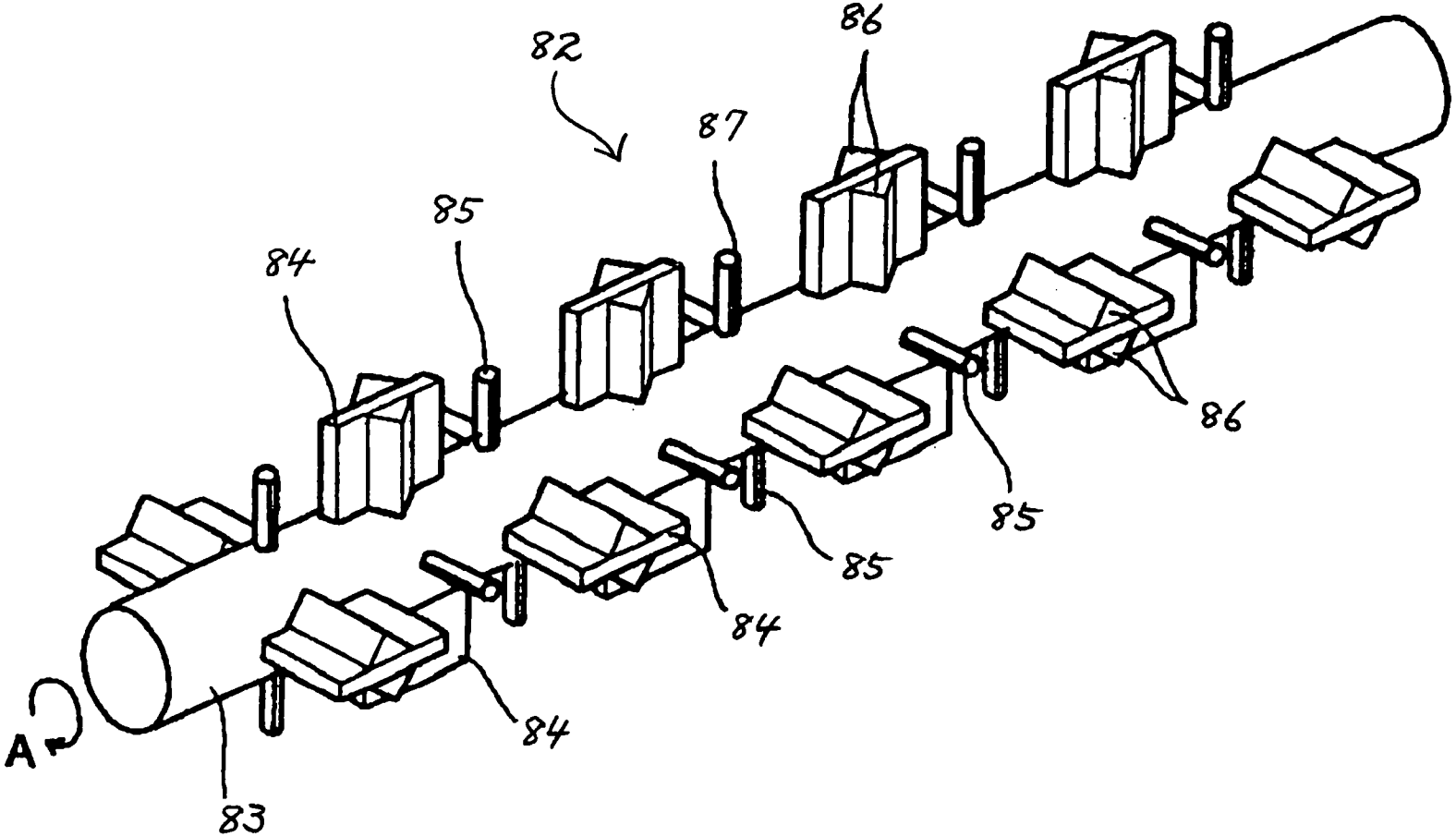
FIG. 78 is a perspective view showing an agitation member of the developing device.

As shown in FIG. 78, in this agitation member 82, plural agitation fins 84, which are flat members, are arranged on a peripheral surface of a main shaft 83 in positions different from each other in an axial direction. Specifically, two agitation fins 84 are arranged on opposed sides of the main shaft 83 (in a positional relation of 180°), and the agitation fins 84 adjacent to each other in the axial direction are shifted by 90° to be arranged in a comb shape (zigzag).

In addition, ribs 85 are arranged among the agitation fins 84 of the agitation member 82. In this case, the agitation fins 84 are in axially symmetrical positions in upper and lower portions of the main shaft 83. The fins 84 in left and right portions of the main shaft 83 are arranged so as to be placed among pairs of the fins in the upper and lower portions of the main shaft 83. The ribs 85 are arranged so as to be placed among the fins 84 in the upper, lower, left, and right portions of the main shaft 83.

Figure 79A:
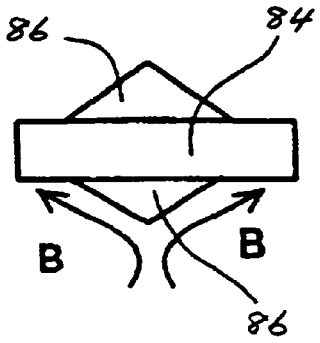
FIGS. 79A and 79B are diagrams showing an agitation fin of the agitation member.
Figure 79B:
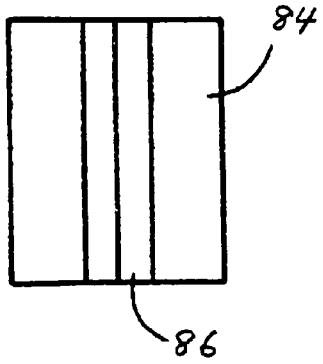
Figure 80A:
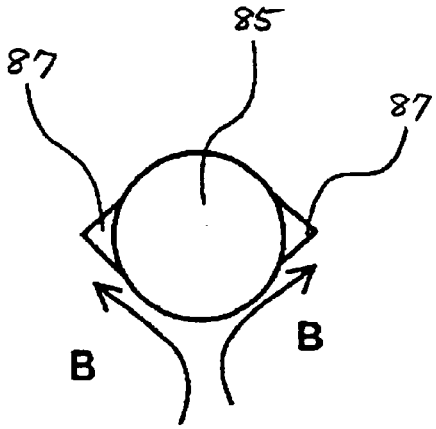
FIGS. 80A and 80B are diagrams showing a rib of the agitation member.
Figure 80B:
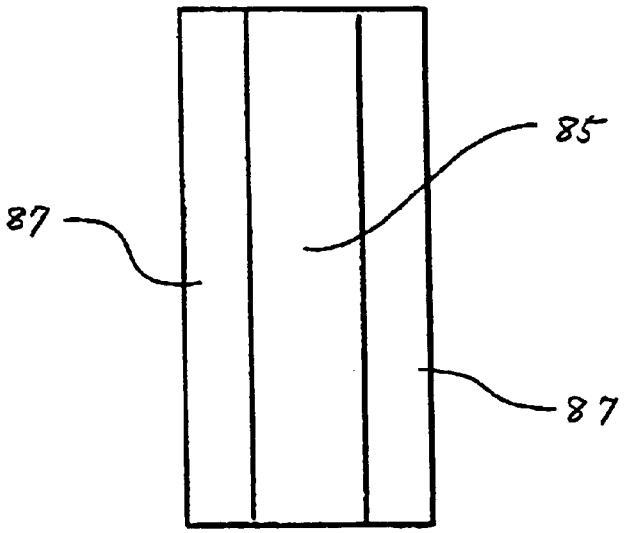

Further, as shown in FIGS. 79A and 79B, triangular projections 86 are provided on surfaces (both surfaces) of the agitation fin 84. In addition, as shown in FIGS. 80A and 80B, triangular projections 87 are provided in opposed positions on a peripheral surface of the rib 85 (opposed positions in an axial direction in a relation with the main shaft 61).

Figure 77:
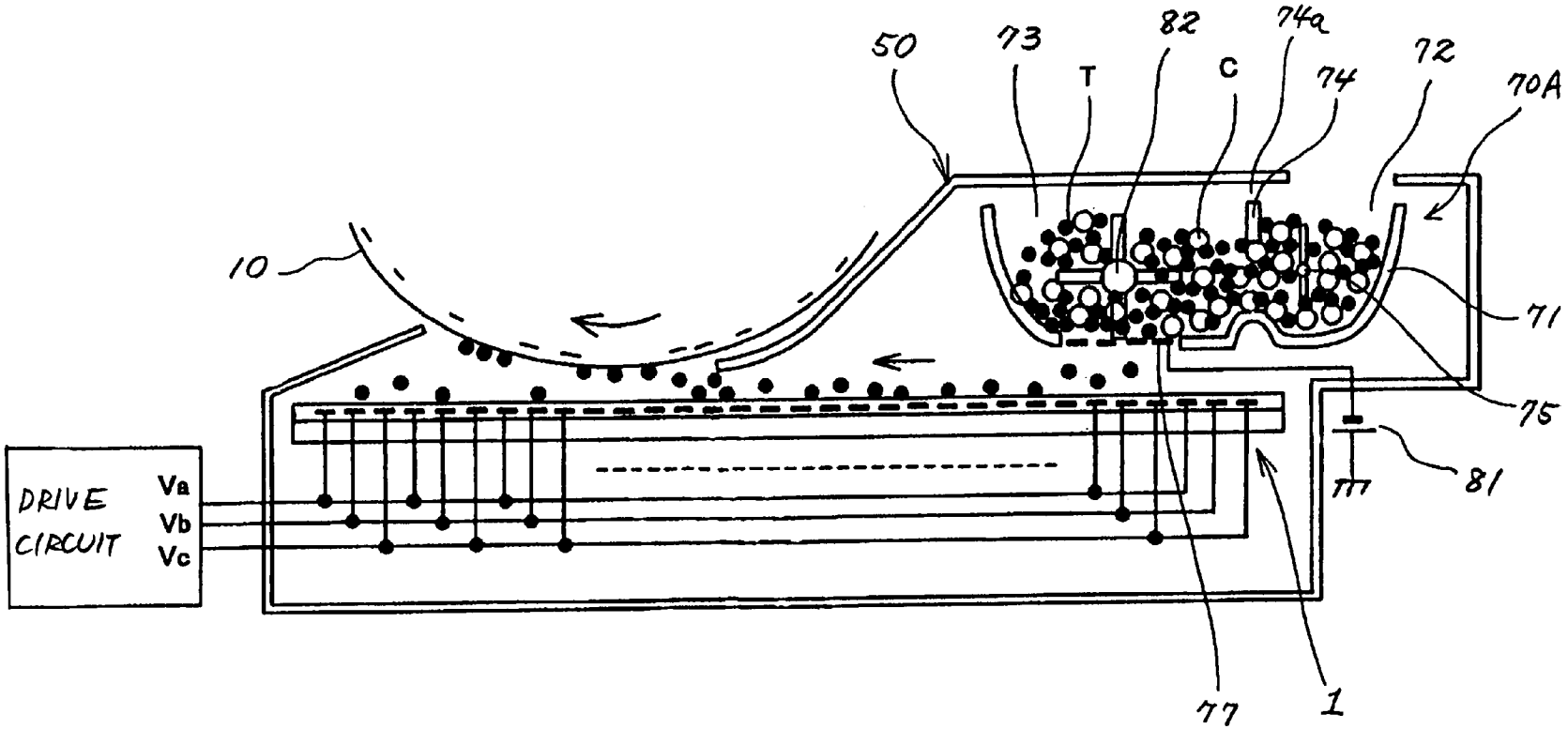
FIG. 77 is a schematic diagram showing a structure of a developing device including a second modified example of the toner supply portion.

Because the toner supply portion 70A is constituted as described above, as in the above first modification, first, toner is supplied from a toner cartridge to the toner hopper portion 72 by a line in a direction from a front side to an inner side in FIG. 77. In this case, a developer consisting of the toner T and the carrier C is mixed and agitated by the agitator 75 rotating in the clockwise direction and fed into the agitation tank 73. At this point, in the toner hopper portion 72, the toner T is charged to some degree by mixing and agitation.

Then, the agitation member 82 serving as rotating and agitating means arranged in the agitation tank 73 is rotated in the clockwise direction (a direction of arrow A in FIG. 78), whereby the developer is charged again while being agitated by the agitation fins 84 and the ribs 85 with turbulent flow in directions of arrow B in FIGS. 79A, 79B, 80A, and 80B.

A voltage of the same charge as the toner T is applied to the mesh electrode 77 arranged at the bottom of the agitation tank 73 by the power supply 81. Accordingly, the developer, which has been agitated, charged, and carried to the position of the mesh electrode 77 is applied with the voltage of the same charge as the toner T. The toner T attracted to the peripheral surface of the carrier C is substantially uniformly fed to the toner electrostatic transport member 1 arranged in a position facing holes of the mesh electrode 77.

On the other hand, because an opening 74*a* is provided above the partition member 74, a part of the developer is returned from the agitation tank 73 to the toner hopper portion 72 and is agitated to be mixed with fresh toner supplied anew. Thus, mixing and agitation are performed sufficiently.

The agitation (diffusion) and the transport the developer by the agitation fin 84 will be described with reference to FIGS. 79A and 79B.

The developer is transported in a rotating direction in accordance with the rotation of the agitation fins 84. Thus, the triangular projections 86 are formed substantially in a central part of the agitation fin 84. Therefore, the developer starts to be pushed by vertexes of the projections 86 (triangular shapes) according to the rotation. The pushed developer is agitated and transported to the left and right (in directions of arrows B) along slopes of the projections 86 and, at the same time, the developer around the pushed developer is also agitated and transported . Since the agitation fin 84 having the triangular projections 86 is provided around the main shaft 83 at every 90 degrees, the developer is transported to the left and right and agitated (diffused) in succession, and a toner concentration in the agitation tank 73 is made uniform.

A function of the rib 85 will be described with reference to FIGS. 80A and 80B.

The rib 85 is provided with triangular projections 87 in the same direction as the axial direction of the main shaft 83 around a cylindrical member and is arranged in a position of a gap between the agitation fins 84. The rib 85 is provided with a function of further agitating the developer which has been transported to the left and right directions by the agitation fins 84. Because the developer is transported to the left and right along a partial arc shape of the rib 85 and is further transported (diffused) in inclined directions of the triangular projections 87, further uniformalization of the developer is realized.

In this modification, as the agitation member 82 as shown in FIG. 78, in the developer container 71, there was arranged an agitation member with a main shaft diameter of 6 mm, a length of 230 mm, and an agitation fin area of 175 mm formed by injecting a melted resin of ABS resin/PC resin containing 30% of glass fiber.

Then, this agitation member 82 was rotated at a peripheral velocity of 60 mm/sec. As a result of visually observing a toner pattern of polymerized toner with an average particle diameter of 7 μm fed from the mesh electrode area of a feeding area 5×100 mm for the toner using a barium titanate glass with a diameter of 0.3 mm and a mesh electrode 77 of SUS (an opening of 0.2×0.15 mm) as carriers, a belt without toner unevenness was able to be identified.

In this way, the agitation member, which has the plural flat members arranged in positions different from each other in the axial direction on the peripheral surface of the main shaft and has a function of agitating and charging a developer, is used as agitating means consisting of a rotating member, whereby agitation and charging efficiency can be improved. In this case, the triangular projections are formed on the surface of the flat member, so that the agitation and charging efficiency can be further improved.

In addition, the plural rib members are provided in different positions in the axial direction in parts where the flat members of the main shaft of the agitating means are not provided, and the triangular projections are formed on the surfaces of the rib members, whereby agitation in a radial direction and an axial direction of the main shaft can be performed easily. Thus, the agitation and charging efficiency is further improved.

In this modification, the agitation member 82 is designed to rotate in the clockwise direction. Alternatively, the agitation member 82 of the same structure with two lines of the agitation fins 84 and the ribs 85 may be used to drive a developer with a butterfly (pendulum) system.

In this case, the triangular projections 86 are also formed on both the surfaces of the agitation fin 84, so that the developer is agitated by reciprocal movements of the agitation member 82. As a result, as in the second modification for rotating the agitation member 82, a belt without toner unevenness was able to be observed on the toner electrostatic carrying member 1.

Figure 81:
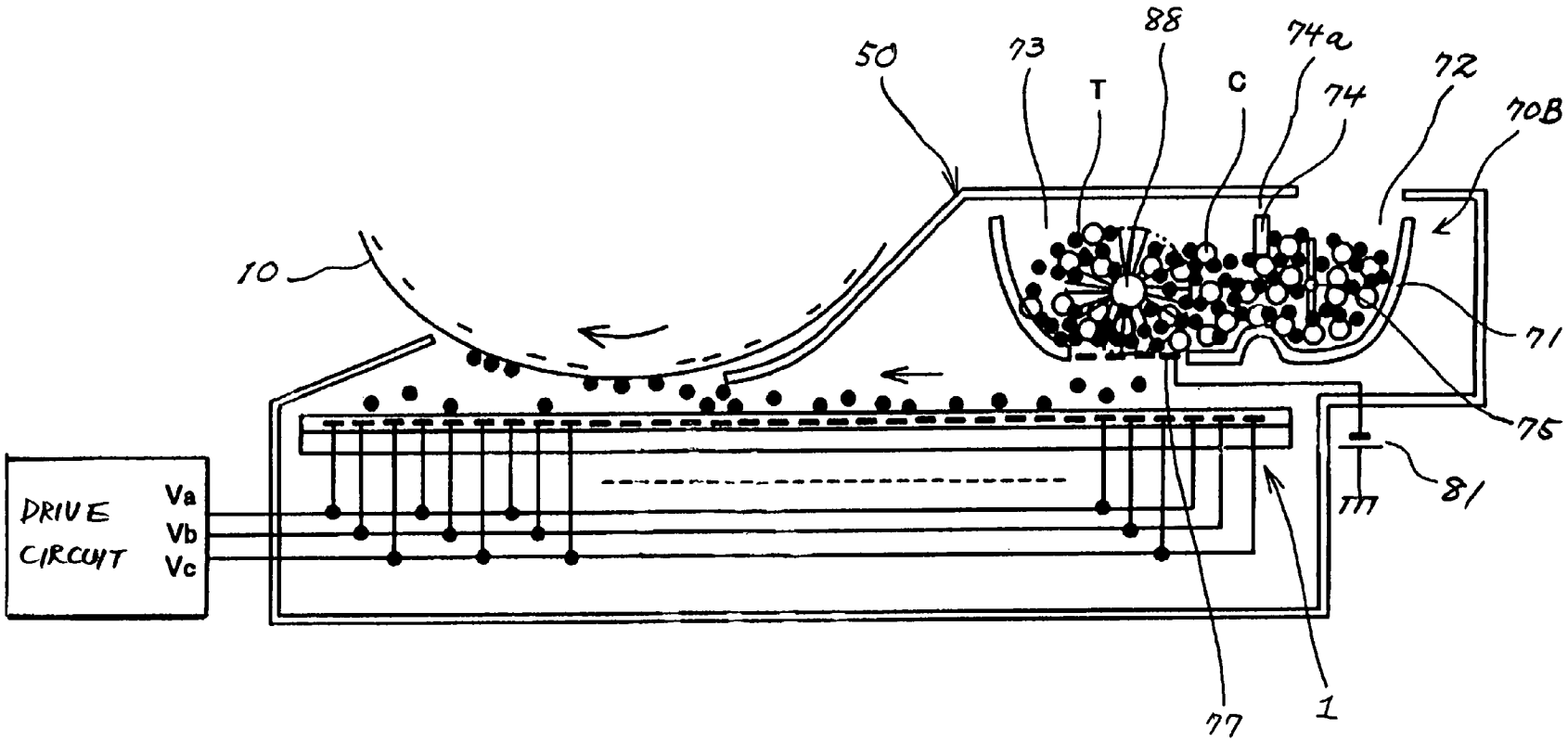
FIG. 81 is a schematic diagram showing a structure of a developing device using a third modification of the toner supply portion.

Next, a toner supply portion 70B in accordance with a third modification will be described with reference to FIG. 81. In this modification, a roll brush (fur brush) 88 is arranged as rotation agitating means in the agitation tank 73.

Figure 82:
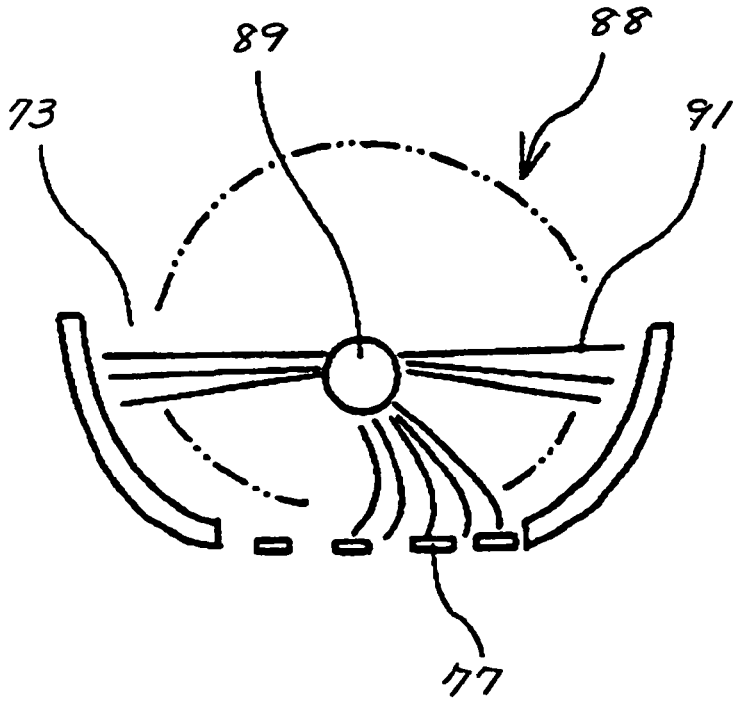
FIG. 82 is a diagram for explaining a fur brush and mesh electrodes of the developing device.

The fur brush 88 is set so as to be rotatable in a right (clockwise) direction. As shown in FIG. 82, the fur brush 88 has a structure in which insulating fibers (brush) 91 are wound around a core metal 89 of SUS or the like. Fibers of nylon, which had a thickness of ϕ0.1 to 1 mm, planting density of 4 to 20 pieces, and a pile length of 1 to 15 mm, were used as the insulating fibers 91. Further, as shown in FIG. 82, the fur brush 88 is set such that a tip of the brush is in contact with the mesh electrode 77, and the same charge as the respective modification is applied to the mesh electrode 77 with the same diameter of the holes.

Because the toner supply portion 70B is constituted as described above, the carrier C and the supplied toner T are mixed and agitated by the agitator 75 in the toner hopper portion 72 of the developer container 71 and the toner T is fed into the agitation tank 73 to come into contact with the fur brush 88 serving as the rotating and agitating means. Accordingly, the toner T is charged to a selected charge (negative).

The toner T is frictionally charged with the carrier (barium titanate glass) C and to negative by coming into contact with the insulating fibers 91 of the fur brush 88. In this case, the toner T is carried among fibers of the fur brush 88 and on the surface thereof by an adhesive force such as an image force. The charged toner having reached the mesh electrode 77 in accordance with the rotation of the fur brush 88 tends to be separated from the brush by an electric field. In addition, a mechanical peeling force acts on the electrostatically absorbed toner, and the toner tends to be separated from the brush. Thus, supply of the toner becomes easy. In addition, clogging of the mesh can be prevented.

Then, the toner T is supplied to the toner electrostatic transport member 1 arranged on the opposite side of the mesh, from the holes of the mesh electrode 77. Here, observation of a belt of the toner T fed to the toner electrostatic transport member 1 confirmed that no toner unevenness was found as in the above-mentioned modification.

Figure 83:
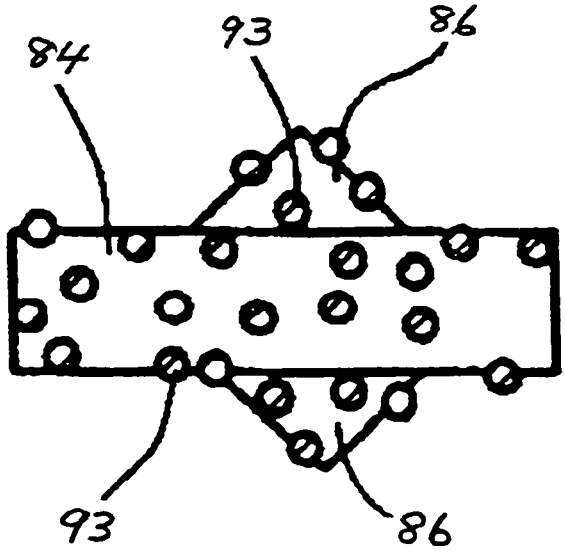
FIG. 83 is a diagram showing an agitation fin of an agitation member in accordance with a fourth modification of the toner supply portion.
Figure 84:
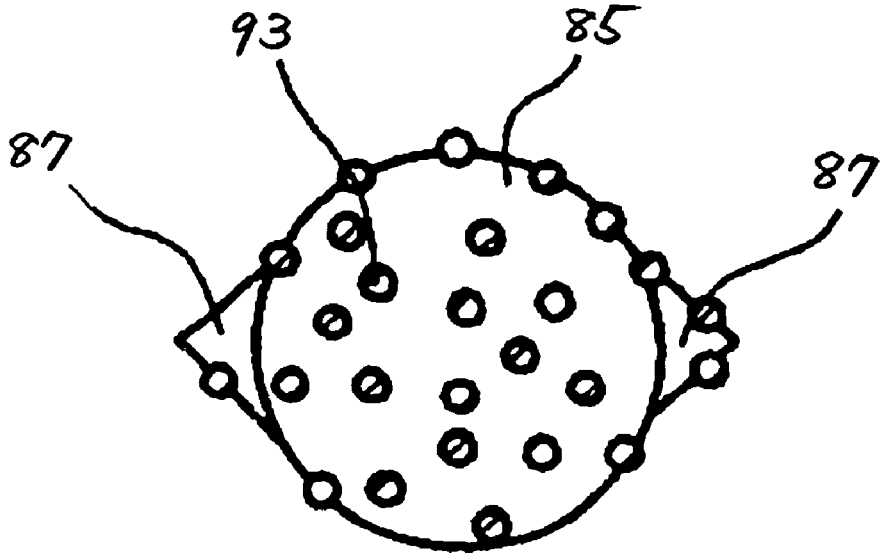
FIG. 84 is a diagram showing a rib of the agitation member.
Figure 85:
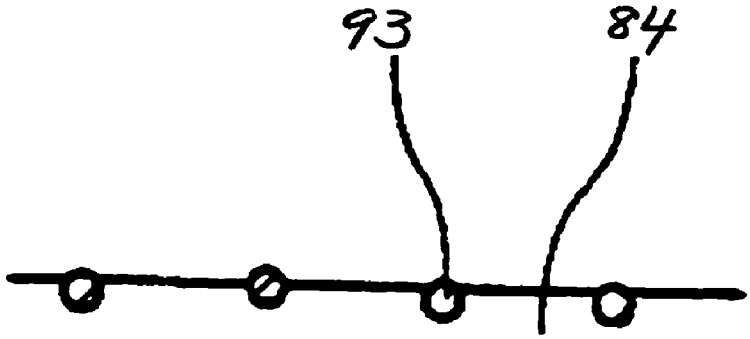
FIG. 85 is a diagram showing a section of an agitation fin of the agitation member.

Next, a toner supply portion in accordance with a fourth modification will be described with reference to FIGS. 83 to 85.

In this modification, the agitation member 82 (see FIG. 78) of the second modification is used, and charging material particulates 93 are contained in materials forming the main shaft 83, agitation fins 84, and ribs 85 of this agitation member 82.

Specifically, the charging material particulates 93 of the same material as the carrier C were contained. For example, a material obtained by mixing barium titanate glass powder (with an average diameter of 9 μm) in ABS resin/PC resin (containing 20% of glass fibers), injecting melted resin therein, and molding the resin after cooling was used. When the molded product (containing 20% of barium titanate) is observed with a microscope, as shown in FIGS. 83 to 85, the barium titanate glass powder (charging material particulates 93) is embedded in a resin surface with a part thereof exposed. In addition, another available method of forming the material is that ultra-fine particles are sprayed directly on the resin surface at high speed to form a film.

By using the agitation member 82 molded in this way, in carrying and agitation by the agitation fins 84 and the ribs 85, agitation and charging with high efficiency can be obtained through friction (contact) with the particulates 93 in addition to friction (contact) with the carrier C.

Moreover, since the particulates 93 is included in the inner wall surface of the developer container 71, further improvement in the efficiency of agitation and charging can be realized.

In the modification, barium titanate glass is used as the functional material for the agitation member. However, glass powder consisting of a material such as aluminum glass or soda glass may be used. In addition, an organic material such as polyimide can also be used.

Figure 86:
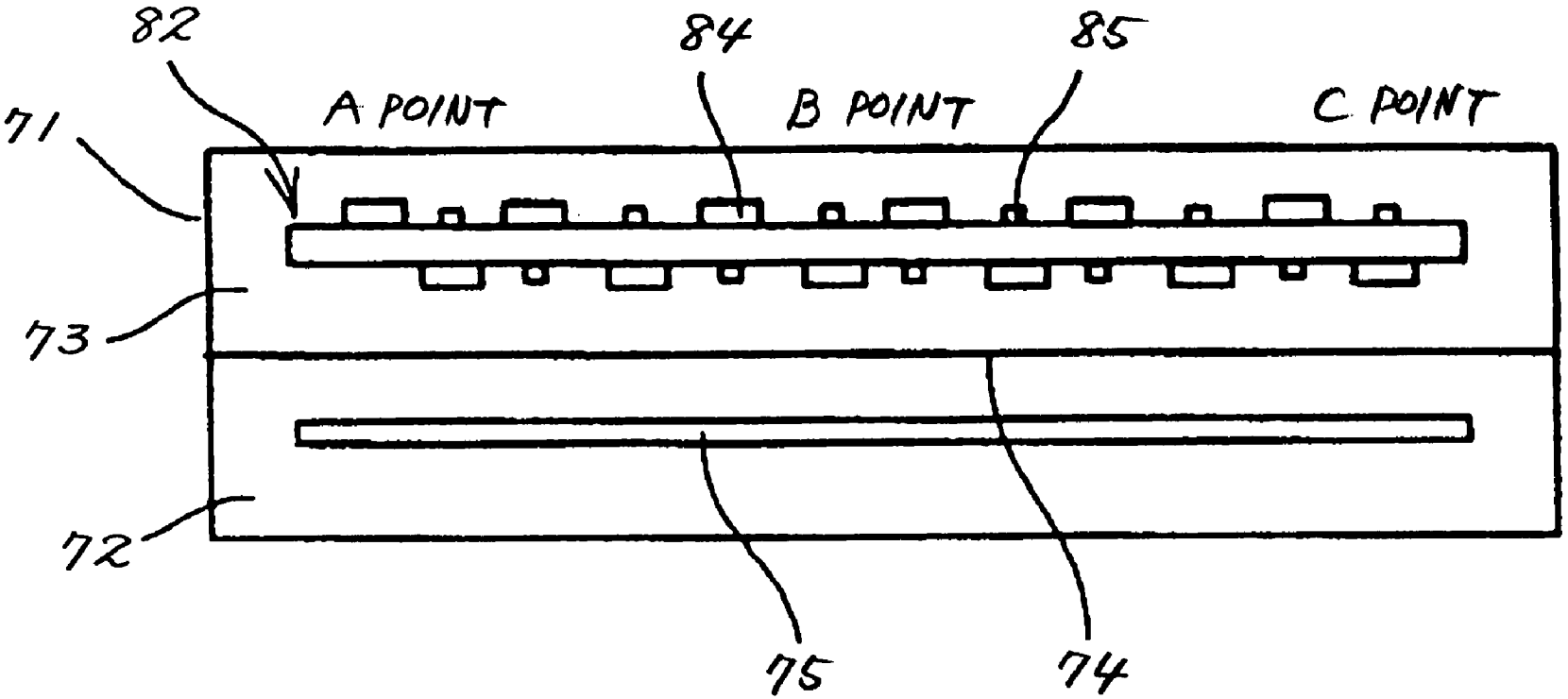
FIG. 86 is a diagram showing a test device used in the first, the second, and the third modification.

Concerning the above-mentioned first, second, and third modifications, with a test device as shown in FIG. 86 (the agitation member 82 of the second modification is shown in the figure, which is equivalent to the screw 76 in the first modification and the fur blush 88 in the third modification ), the rotating and agitating means was rotated at a peripheral velocity of 60 mm/sec, toner containing 4 wt % of toner components was supplied to the rotating and agitating means to agitate the toner for a predetermined time, the toner was sampled at A point, B point, and a C point in FIG. 86 as measurement points, and a charging amount was measured by a blow-off method.

Figure 87:
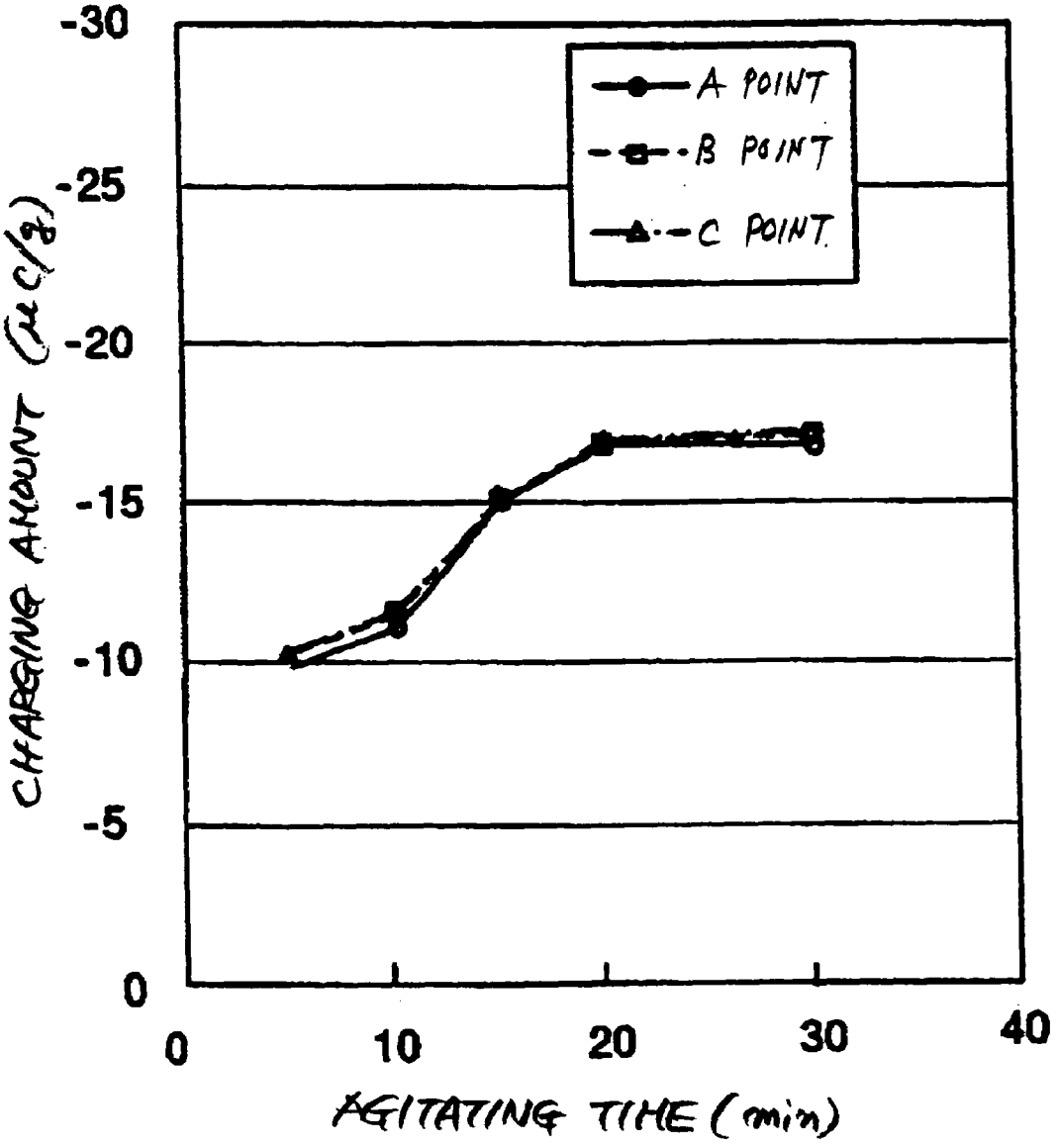
FIG. 87 is a diagram showing a result of measurement of a relation between an agitation time and a charging amount at respective measurement points of FIG. 86 of a developing device including the toner supply portion of the first modified example.
Figure 88:
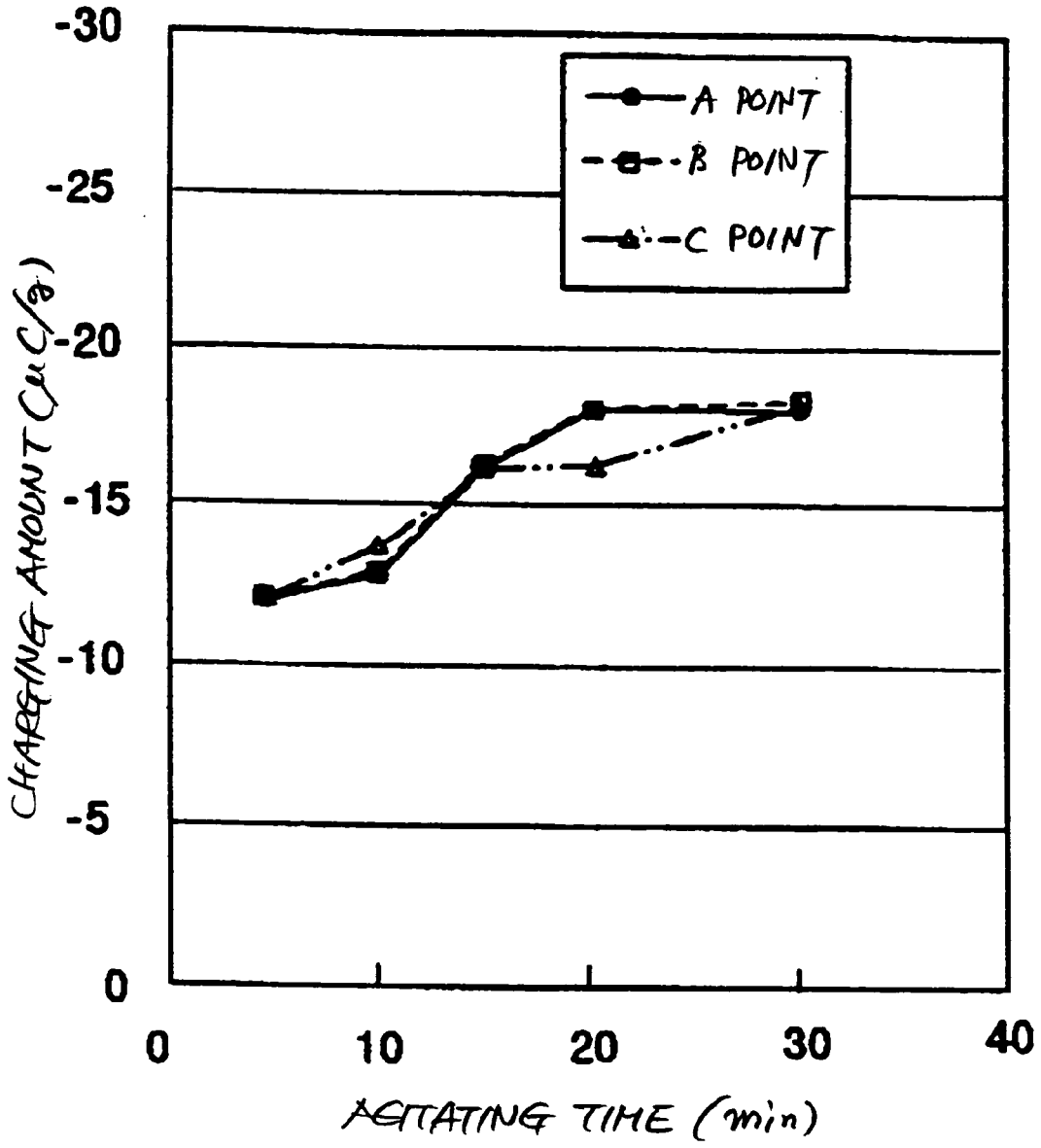
FIG. 88 is a diagram showing a result of measurement of a relation between an agitation time and a charging amount at respective measurement points of FIG. 86 of a developing device including the toner supply portion of the second modification.
Figure 89:
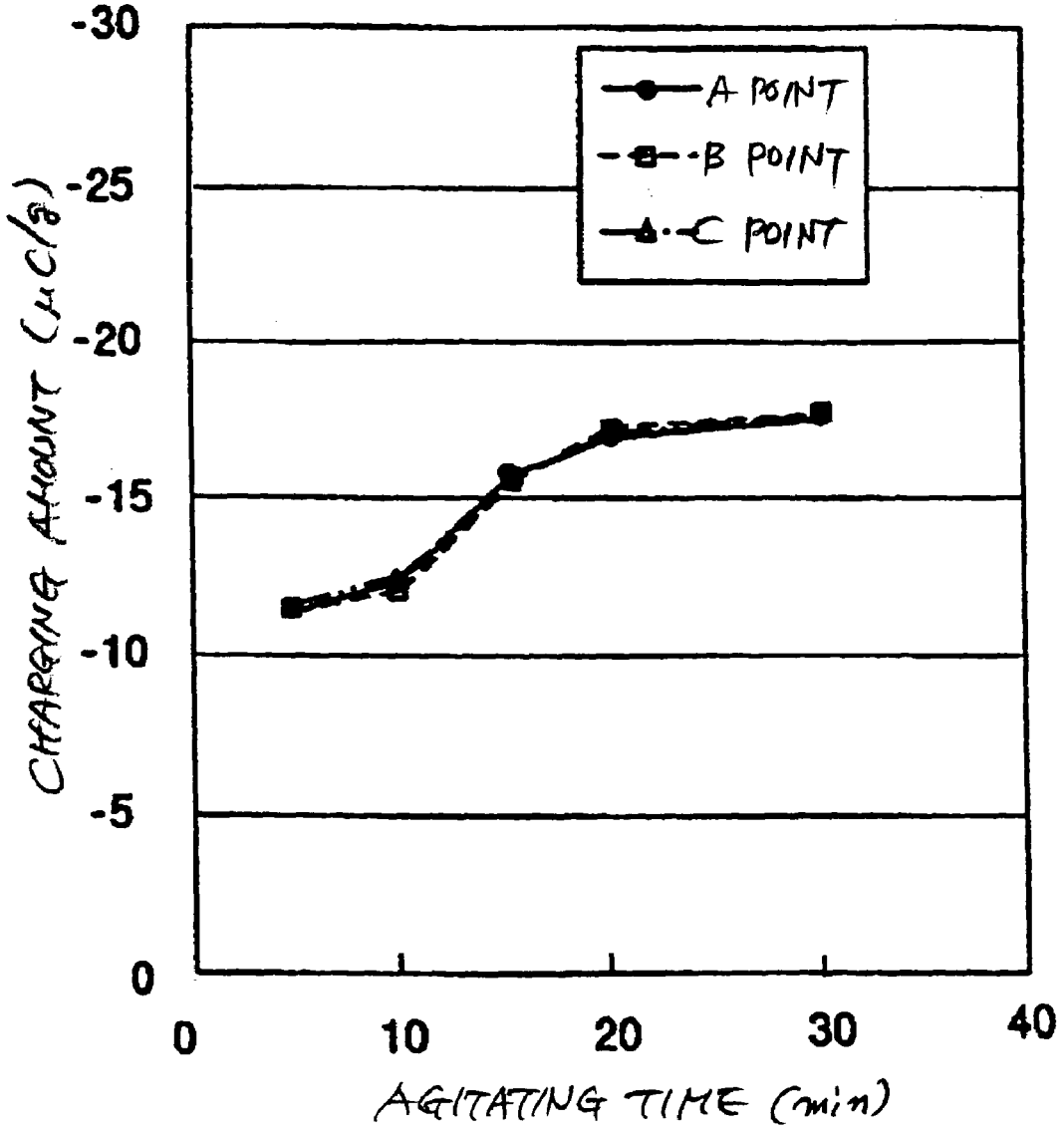
FIG. 89 is a diagram showing a result of measurement of a relation between an agitation time and a charging amount at respective measurement points of FIG. 86 of a developing device including the toner supply portion of the fourth modification.

FIGS. 87, 88, and 89 show the results of the measurement of the first modification, the second modification and the fourth modification, respectively. In all the modifications, a charging amount sufficient for use in an image forming apparatus was able to be identified. A large difference was not found among the modification, and a difference due to a position was rarely found.

Figure 90:
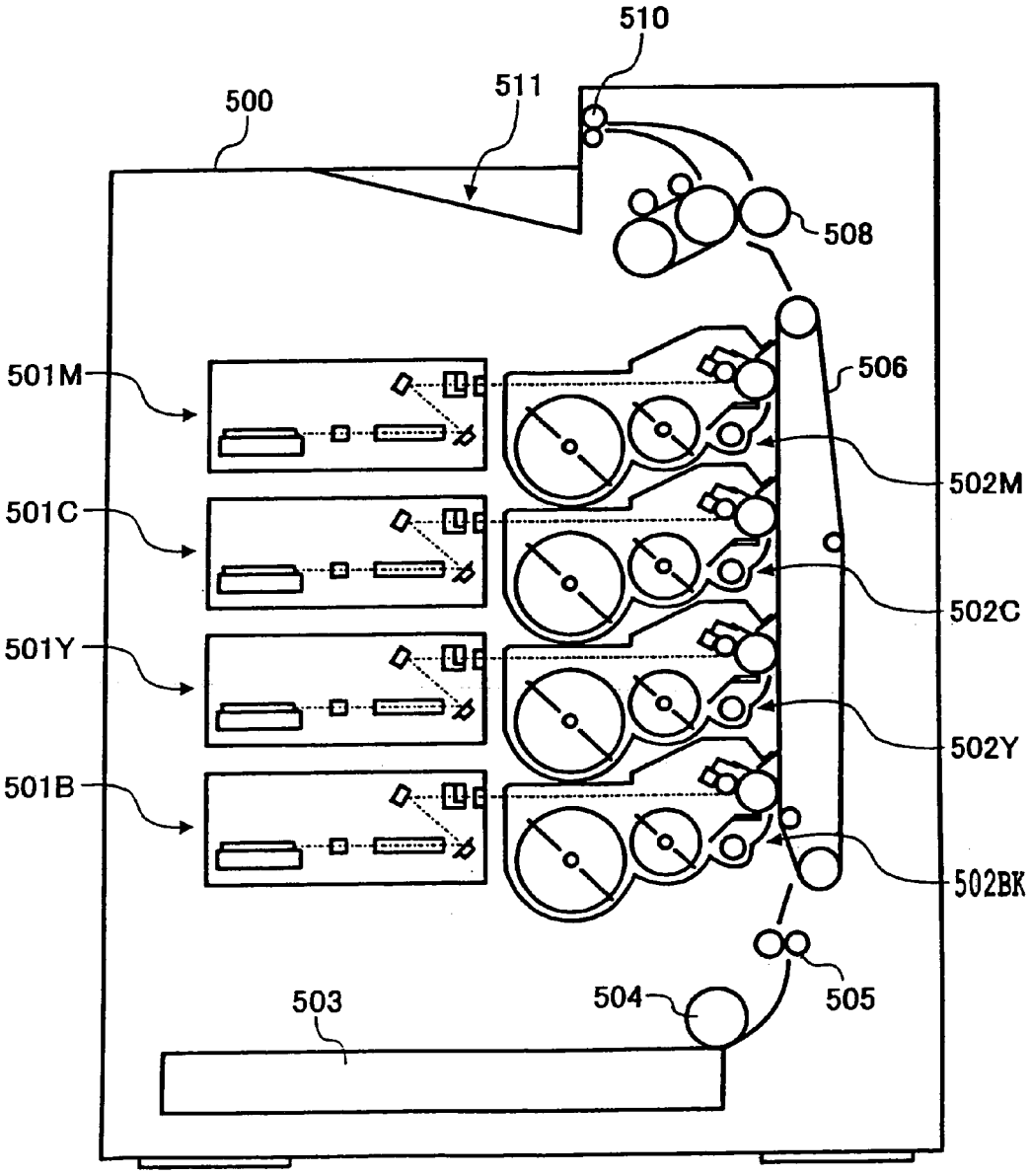
FIG. 90 is a schematic diagram showing a structure of an example of a color copying machine in accordance with the present invention.

FIG. 90 shows a schematic structure of a color copying machine in accordance with the present invention. This color copying machine 500 is designed to form full color image with four colors of black (Bk), yellow (Y), cyan (C), and magenta (M) and includes process cartridges 502Bk, 502Y, 502C, and 502M for the respective colors. Since the process cartridges for the respective colors have substantially the same structure, in the following description, reference signs Bk, Y, C, and M are omitted if necessary.

Figure 91:
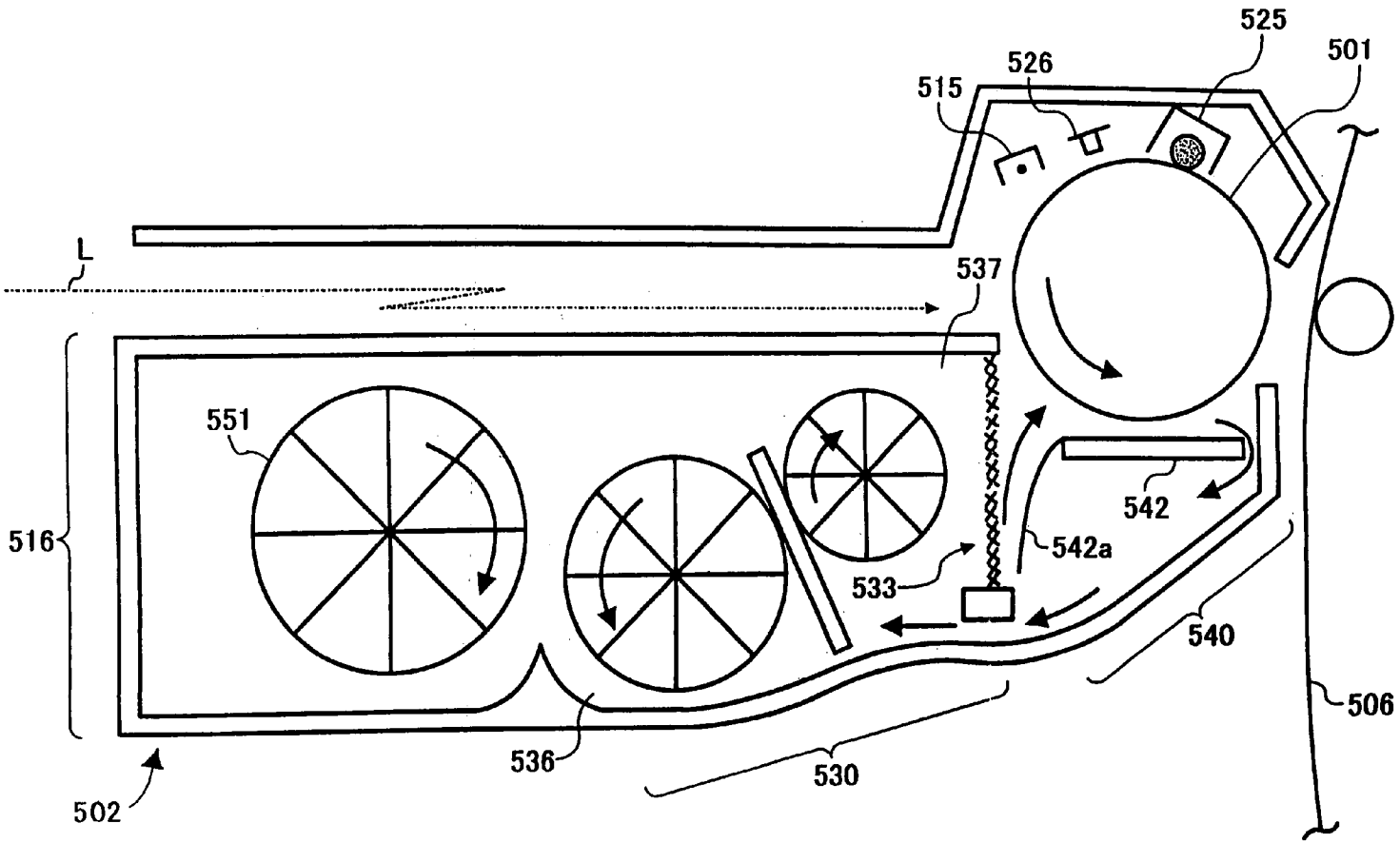
FIG. 91 is a diagram showing a process cartridge of the color copying machine.

As shown in FIG. 91, the process cartridge 502 is a unit of a photosensitive member 501, a charging device 515, a discharge lamp 526, a cleaning device 525, and a developing device 516 and is detachably mountable to a main body of the copying machine. Further, the process cartridge 502 is replaced when it has fulfilled a usable life thereof.

The developing device 516 includes a toner replenish portion 50 in addition to a toner carrying portion 540 and a toner supply portion 530. Fresh toner for replenishing in the toner replenish portion 50 is supplied into a first receiving chamber 536 of the toner supply portion 530 by a replenishing rotation member 551. As in the copying machines as described above in the toner supply portion 530, a mixture of toner and a friction facilitating material is circulated and transported between two receiving chambers. Then, in a course of agitation and carrying in the second receiving chamber 537, the toner in the mixture is separated by a sieving function of a mesh 533 and supplied into the toner transport section 540. An electrostatic transport substrate 542 is disposed in the toner transport section 540.

In a carrying area 542*a* of this electrostatic transport substrate for transfer 542, a deformable material is used in a base thereof. Accordingly, the carrying area 542*a* is formed as a flexible portion and takes a curved posture so as to transfer the toner against the gravity in an early period of transport and transports the toner obliquely upward in a latter period of carrying. Because a plate member is used for bases of the development area and collection area of the electrostatic transport substrate 542, the developing area and the collecting area never deform flexibly and are disposed so as to take substantially a horizontal posture.

Even with such an electrostatic transport substrate 542, the toner can be carried toward the development area opposed to the photosensitive member 501 while being hopped by the ETH phenomenon. Toner carried to the collecting area without contributing to the development, falls from an end of the electrostatic transport substrate 542 and then moves down along a tapered surface to be returned to the second receiving chamber 537.

Disposed on the left side of the process cartridges 502Bk, 502Y, 502C, and 502M in FIG. 90 are optical writing devices 501Bk, 501Y, 501C, and 501M, respectively. The optical writing devices optically scan photosensitive members of the corresponding cartridges. Specifically, the optical writing devices optically scan the photosensitive members using a semiconductor laser which emits a laser beam modulated according to image data for respective colors sent from a scanner device, a collimate lens, a light deflector such as a polygon mirror, a scanning and focusing optical system, and the like.

Disposed on the right side in the figure of the process cartridges 502Bk, 502Y, 502C, and 502M in FIG. 90 is a belt unit for endlessly moving a paper conveyor belt 506. Disposed in a loop of the paper conveyor belt 506 are transfer means facing the process cartridges 502Bk, 502Y, 502C, and 502M via the belt.

Disposed in a lower part of the main body of the copying machine is a paper feeding device 503 accommodating transfer paper stacks. A transfer paper at the top of the transfer papers is supplied to a paper feeding path by a paper feeding roller 504 at predetermined timing. Then, the transfer paper is supplied to the paper conveyor belt 506 through a registration roller pair 505. The paper conveyor belt 506 sequentially passes the transfer paper to positions facing the process cartridges 502Bk, 502Y, 502C, and 502M in accordance with endless movement of the belt. In a course of this process, toner images of Bk, Y, C, and M are sequentially superimposed and transferred onto the transfer paper, and a full color image is formed. The transfer paper on which the full color image has been formed in this way is delivered from the paper conveyor belt 506 to a fixing device 508 and then stacked in a stack portion 511 through a paper discharge roller pair 510.

Figure 92:
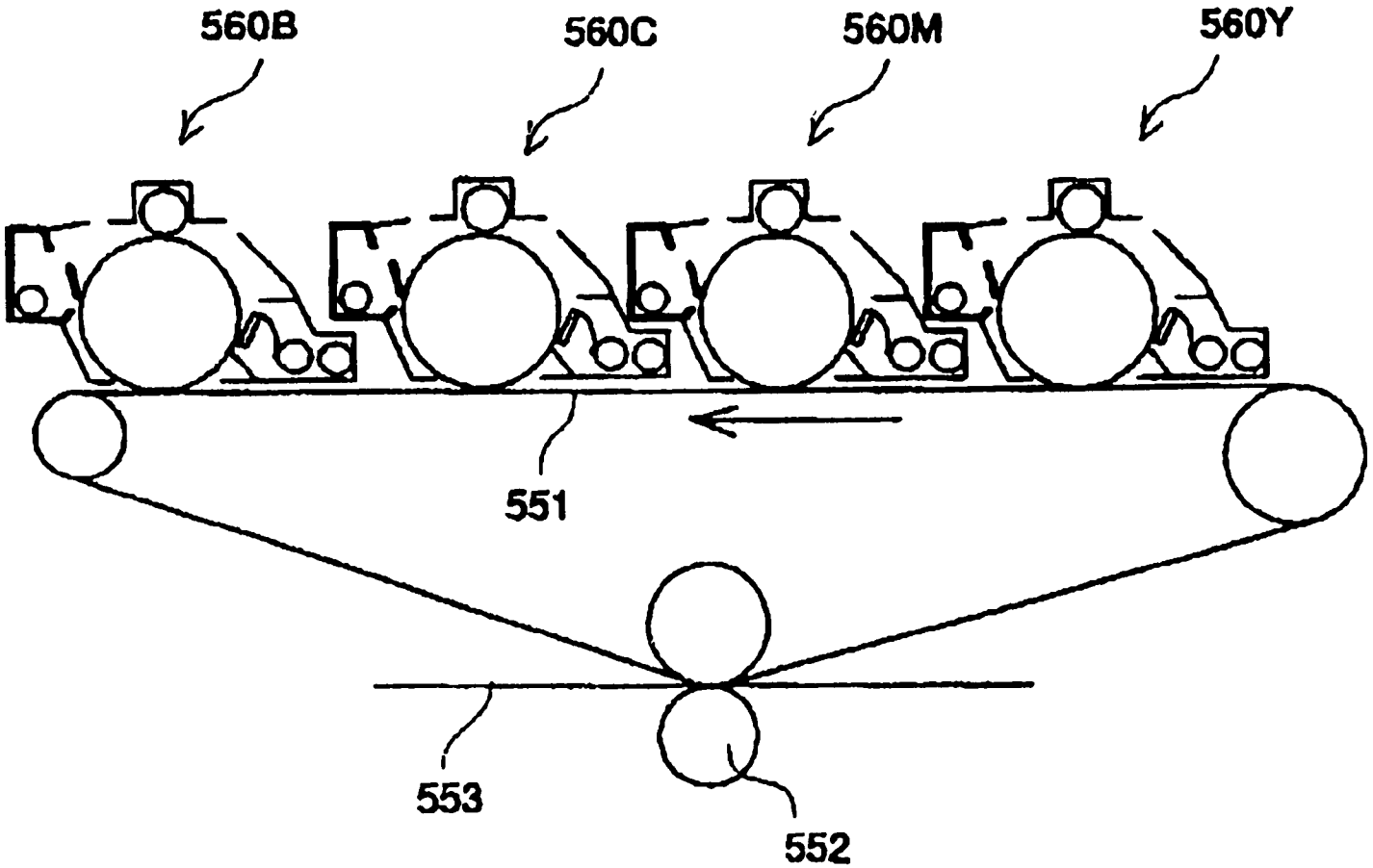
FIG. 92 is a schematic diagram showing a structure of another example of the color copying machine in accordance with the present invention.

FIG. 92 shows a schematic structure of another color copying machine in accordance with the present invention. In this color copying machine, process cartridges 560Y, 560M, 560C, and 560Bk of four colors are arranged in parallel along a transfer belt 551 which is moved endlessly while being stretched oblongly in the horizontal direction. In the following description, reference signs Y, M, C, and Bk are omitted if necessary.

Figure 93:
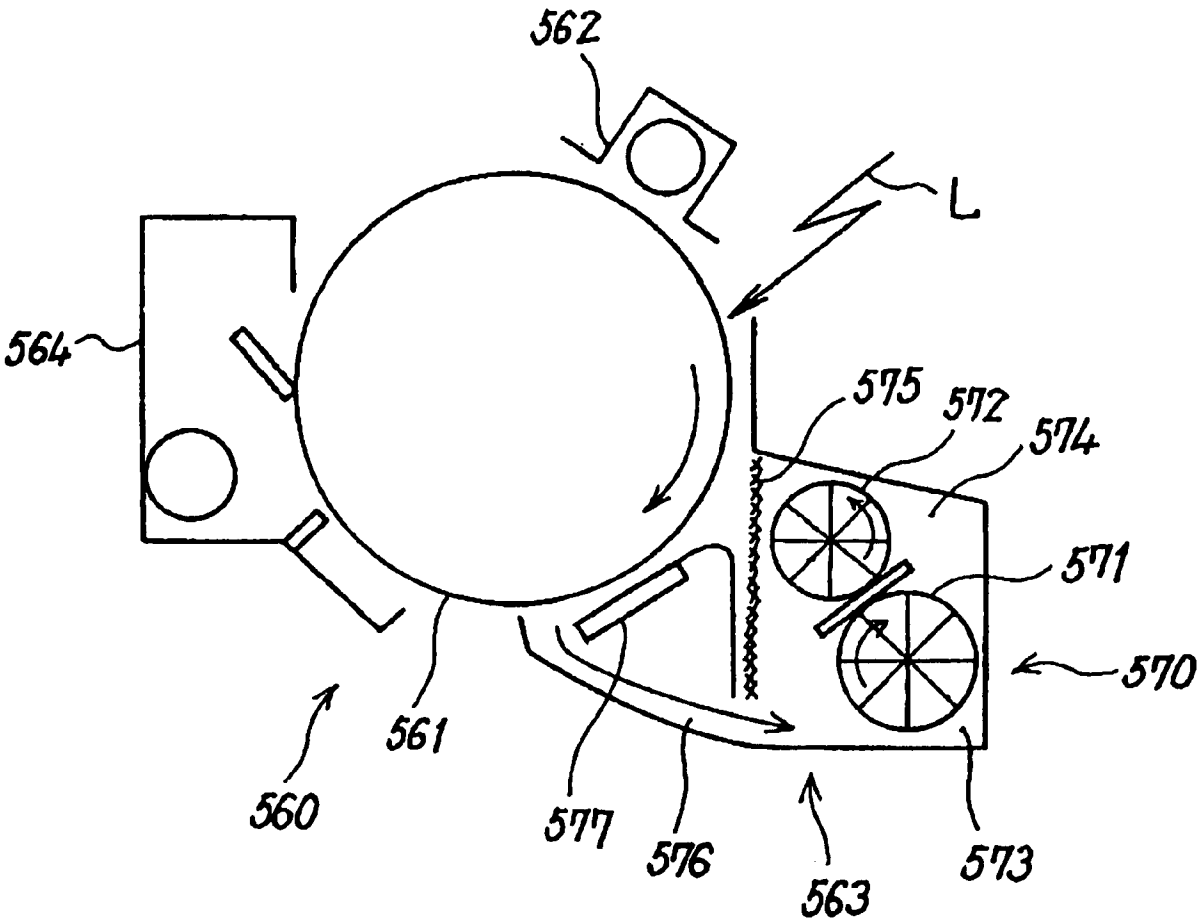
FIG. 93 is a diagram showing a process cartridge of the color copying machine of the present invention.

As shown in FIG. 93, the process cartridge 560 is a cartridge in which a photosensitive member 561, a charging device 562, a developing device 563, a cleaning device 564, and the like are integrally formed, and is constituted so as to be detachably mountable to a main body of the copying machine.

The developing device 563 has a first transport screw 571 and a second transport screw 572 inside a toner supply section 570. The first transport screw 571 and the second transport screw 572 agitate and transport mixtures in a first receiving chamber 573 and a second receiving chamber 574 in an axial direction thereof, respectively. Then, toner in the mixture is separated by a sieving function of a mesh 575 provided in a sidewall of the second receiving chamber 574 to be supplied to a toner carrying section 576. The supplied toner is transported toward a developing area while being hopped by the ETH phenomenon on a surface of an electrostatic transport substrate 577, which has a flexible portion and a substrate portion, to develop an electrostatic latent image on the photosensitive member 561. Toner which has not contributed to the development falls from an end of the electrostatic transport substrate 577 and is then returned into the first receiving chamber 573 by its own weight along a taper on a bottom surface of the toner transport section 576.

Toner images on the photosensitive member developed by the process cartridges 560Y, 560M, 560C, and 560Bk for the respective colors are superimposed on the transfer belt 551 and transferred, respectively, to form a four color toner image. This four color toner image is secondarily transferred onto transfer paper 553, which is conveyed in timing, collectively in a secondary transfer nip formed by the transfer belt 551 and a secondary transfer roller 552. Then, the four color toner image changes to a full color image in conjunction with white of the transfer paper 553.

In accordance with the present invention, the ETH phenomenon is caused on a surface of a toner electrostatic transport member to carry toner to a developing position, whereby low potential development according to the ETH phenomenon can be realized.

In addition, since the toner is agitated and transported in a state of a mixture, in which the toner is mixed with a friction facilitating material, rather than individually, the toner is frictionally charged reliably without using corona discharge. Then, the sufficiently charged toner is separated from the mixture by a sieving function of a mesh to be supplied to the toner electrostatic transport member. Therefore, adverse influence due to charging failure of the toner can be prevented without causing scattering of the toner and generating ozone due to the corona discharge.

Various modifications will become possible for those skilled in the art after receiving the teachings of the present disclosure without departing from the scope thereof.

What is claimed is:

1. A toner supply device for supplying toner to a surface of an electrostatic transport member which conveys the toner by generating a progressive wave electric field to a developing position facing a latent image carrying member and develops a latent image on the latent image carrying member by the toner, comprising receiving means for receiving a mixture of toner composed of toner particles and a friction facilitating material composed of friction facilitating particles of an average particle diameter greater than an average particle diameter of the toner particles;

agitating and carrying means for agitating and carrying the mixture of the toner and the friction facilitating material in the receiving means, the agitating and carrying means comprising first and second agitating members; and a mesh having plural openings for communicatively connecting inside and outside of the receiving means therethrough, the shortest diameter portion of the openings of the mesh being greater than the average particle diameter of the toner particles and smaller than the average particle diameter of the friction facilitating particles, wherein the toner particles in the mixture are discharged from the openings of the mesh and supplied to the surface of the electrostatic transport member, and wherein the first agitating member is configured to discharge the toner through the mesh to the electrostatic transport member, and the second agitating member is configured to convey toner previously delivered to the developing position and not used to develop the latent image to be mixed with the toner in the receiving means.

2. A toner supply device according to claim 1, wherein:

a predetermined material is designated as the toner suitable for use; and the shortest diameter portion of the openings of the mesh has a size sufficient for allowing passage of 80% or more toner particles in the toner having a particle diameter distribution.

3. A toner supply device according to claim 1, wherein:

a predetermined material is designated as the friction facilitating material suitable for use; and the shortest diameter portion of the openings of the mesh has a size sufficient for preventing passage of 80% or more friction facilitating particles in the friction facilitating material having a particle diameter distribution.

4. A toner supply device according to claim 1, wherein each of the openings of the mesh is in the form of a non-perfect circle and has a long diameter of the portion and a short diameter portion.

5. A toner supply device according to claim 4, wherein the openings of the mesh are disposed in a posture in which a longitudinal direction thereof is along a direction perpendicular to a carrying direction of the agitating and carrying means.

6. A toner supply device according to claim 1, wherein the agitating and carrying means carries the mixture in a rotation axial direction in accordance with rotation of a rotation member having a rotation shaft and a spiral projection protrudingly provided in a spiral shape on a surface of the rotation shaft.

7. A toner supply device according to claim 6, wherein the spiral projection is a brush composed of plural raisings.

8. A toner supply device according to claim 1, wherein a material, composed of friction facilitating particles containing a nonmagnetic material is designated as the friction facilitating material suitable for use.

9. A toner supply device according to claim 1, wherein a material composed of friction facilitating particles containing a single material is designated as the friction facilitating material suitable for use.

10. A toner supply device according to claim 1, wherein a material composed of friction facilitating particles containing two or more materials is designated as the friction facilitating material suitable for use.

11. A toner supply device according to claim 10, wherein a material composed of friction facilitating particles with a surface layer coated over a core material is designated as the friction facilitating material suitable for use.

12. A toner supply device according to claim 1, wherein the agitating and carrying means comprises plural flat members provided in positions different from one another in an axial direction of a main shaft on a peripheral surface of the main shaft.

13. A toner supply device according to claim 12, wherein triangular projections are formed on surfaces of the flat members of the agitating and carrying means.

14. A toner supply device according to claim 12, wherein:

plural rib members are provided in different positions in the axial direction in parts of the main shaft where the flat members are not provided; and triangular projections are formed on surfaces of the rib members.

15. A toner supply device according to claim 12, wherein the agitating and carrying means agitates the toner and the friction facilitating material with a butterfly system or a pendulum system.

16. A toner supply device according to claim 1, wherein the agitating and carrying means has a brush structure.

17. A toner supply device according to claim 16, wherein the agitating and carrying means is in contact with the mesh.

18. A toner supply device according to claim 1, wherein a charging functional material is formed on a surface of the agitating and carrying means.

19. A toner supply device according to claim 1, wherein a charging functional material is formed on an inner surface of an agitation tank in which the agitating and carrying means is arranged.

20. A developing device for developing a latent image formed on a latent image carrying member, comprising:

an electrostatic transport member for conveying toner on a surface thereof by generating a progressive wave electric field to a developing position facing the latent image carrying member; and toner supply means for supplying the toner to the surface of the electrostatic transport member, wherein the toner carried to the developing position is adhered to the latent image on the latent image carrying member to develop the latent image, the toner supply means comprising:

receiving means for receiving a mixture of toner composed of toner particles and a friction facilitating material composed of friction facilitating particles of an average particle diameter greater than an average particle diameter of the toner particles;

agitating and carrying means for agitating and carrying the mixture of the toner and the friction facilitating material in the receiving means, the agitating and carrying means comprising first and second agitating members; and a mesh having plural openings for communicatively connecting inside and outside of the receiving means therethrough, the shortest diameter portion of the openings of the mesh being greater than the average particle diameter of the toner particles and smaller than the average particle diameter of the friction facilitating particles, wherein the toner particles in the mixture are discharged from the openings of the mesh and supplied to the toner electrostatic transport member, and wherein the first agitating member is configured to discharge the toner through the mesh to the electrostatic transport member, and the second agitating member is configured to convey toner previously delivered to the developing position and not used to develop the latent image to be mixed with the toner in the receiving means.

21. An image forming apparatus comprising:

a latent image carrying member for carrying a latent image;

a developing device for developing the latent image by conveying toner on a surface of an electrostatic transport member by generating a progressive wave electric field to a developing position facing the latent image carrying member; and toner supply means for supplying the toner to the surface of the electrostatic transport member, the toner supply means comprising:

receiving means for receiving a mixture of toner composed of toner particles and a friction facilitating material composed of friction facilitating particles of an average particle diameter larger than an average particle diameter of the toner particles;

agitating and carrying means for agitating and carrying the mixture of the toner and the friction facilitating material in the receiving means, the agitating and carrying means comprising first and second agitating members; and a mesh having plural opening for communicatively connecting inside and outside of the receiving means therethrough, the shortest diameter portion of the opening of the mesh being greater than the average particle diameter of the toner particles and smaller than the average particle diameter of the friction facilitating particles, wherein the toner particles in the mixture arc discharged from the openings of the mesh and supplied to the surface of the toner electrostatic transport member, and wherein the first agitating member is configured to discharge the toner through the mesh to the electrostatic transport member, and the second agitating member is configured to convey toner previously delivered to the developing position and not used to develop the latent image to be mixed with the toner in the receiving means.

22. An image forming apparatus according to claim 21, further comprising discharge facilitating means for facilitating discharge of the toner from the openings separately from the agitating and carrying means.

23. An image forming apparatus according to claim 22, wherein the discharge facilitating means comprises potential difference generating means for generating a potential difference between the mesh and the toner electrostatic transport member.

24. An image forming apparatus according to claim 22, wherein the discharge facilitating means comprises:

an electrode member disposed between the mesh and the toner electrostatic transport member; and potential difference generating means for generating a potential difference between the mesh and the electrode member.

25. An image forming apparatus according to claim 22, wherein the discharge facilitating means comprises vibration generating means for vibrating the mesh.

26. An image forming apparatus according to claim 22, wherein the discharge facilitating means is caused to function at least when the toner is carried by the toner electrostatic transport member.

27. A toner supply device configured to supply toner to a surface of an electrostatic transport member which conveys the toner to a developing position facing a latent image carrying member and develops a latent image on the latent image carrying member by the toner, comprising a receiving member configured to receive a mixture of toner and a friction facilitating material;

first and second agitating members, each configured to agitate and carry the mixture of the toner and the friction facilitating material in the receiving member; and a mesh having plural openings for communicatively connecting inside and outside of the receiving member therethrough, wherein the toner in the mixture are discharged from the openings of the mesh and supplied to the surface of the electrostatic transport member, and wherein the first agitating member is configured to discharge the toner through the mesh to the electrostatic transport member, and the second agitating member is configured to convey toner previously delivered to the developing position and not used to develop the latent image to be mixed with the toner in the receiving member.

* * * * *